United States Patent [19]

Ward

[11] Patent Number: 4,841,925

[45] Date of Patent: Jun. 27, 1989

[54] ENHANCED FLAME IGNITION FOR HYDROCARBON FUELS

[75] Inventor: Michael A. V. Ward, Lexington, Mass.

[73] Assignee: Combustion Electromagnetics, Inc., Arlington, Mass.

[21] Appl. No.: 131,948

[22] Filed: Dec. 11, 1987

Related U.S. Application Data

[63] Continuation-in-part of Ser. No. 944,882, Dec. 22, 1986, abandoned.

[51] Int. Cl.[4] ..... F02P 3/08; F02P 15/00

[52] U.S. Cl. ..... 123/143 B; 123/169 EL; 123/169 PA; 123/598; 123/605; 123/620; 313/141; 313/143; 315/58

[58] Field of Search ..... 123/143 B, 169 EL, 169 PA, 123/169 MG, 620, 598, 605, 596; 313/140, 141, 143, 139; 315/58, 59, 62, 209 CD

[56] References Cited

U.S. PATENT DOCUMENTS

| | | | |
|---|---|---|---|
| 703,759 | 7/1902 | Brown | 315/59 |
| 984,454 | 2/1911 | Thwaite | 123/169 MG |
| 995,989 | 6/1911 | Schaefer, Jr. | 313/140 |
| 2,684,060 | 7/1954 | Schechter | 313/140 |
| 2,942,135 | 6/1960 | McLaren | 313/139 |
| 3,037,140 | 5/1962 | Schurecht | 315/58 |
| 3,504,658 | 4/1970 | Chavis | 123/605 |
| 3,921,605 | 11/1975 | Wyczalek | 123/143 B |
| 3,958,144 | 5/1976 | Franks | 313/143 |
| 4,161,937 | 7/1979 | Gerry | 123/169 EL |
| 4,186,712 | 2/1980 | Fitzner et al. | 123/169 EL |
| 4,248,201 | 2/1981 | Tsutsui et al. | 123/634 |
| 4,324,219 | 4/1982 | Hayashi | 123/620 |
| 4,493,297 | 1/1985 | McIlwain et al. | 123/143 B |
| 4,658,185 | 4/1987 | Albrecht et al. | 315/59 |

FOREIGN PATENT DOCUMENTS

| | | | |
|---|---|---|---|
| 58-162719 | 9/1983 | Japan | 123/169 EL |
| 136109 | 12/1919 | United Kingdom | 313/143 |
| 947427 | 1/1964 | United Kingdom | 313/143 |

*Primary Examiner*—Andrew M. Dolinar
*Attorney, Agent, or Firm*—Jerry Cohen

[57] ABSTRACT

An ignition system for hydrocarbon fuels based in part on the principle of "flame discharge ignition" of coupling ignition energy to the initial flame front plasma either as a "pulsing flame discharge ignition" or an "enhanced conventional discharge ignition". Electrical, geometrical, spark, and hydrocarbon flame front plasma discharge properties are taken into account and adjusted or tailored to create a flame discharge ignition process capable of igniting very lean mixtures. The system is further improved by modifying the fuel's flame front plasma properties by increasing the ratio of the carbon to hydrogen (C/H) content of the fuel and/or by using additives to further increase the flame front plasma density without reducing the plasma recombination coefficient.

98 Claims, 12 Drawing Sheets

FIG. 8a
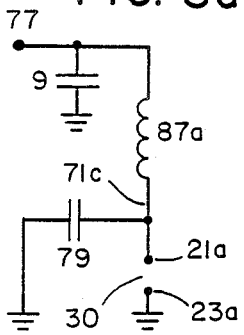
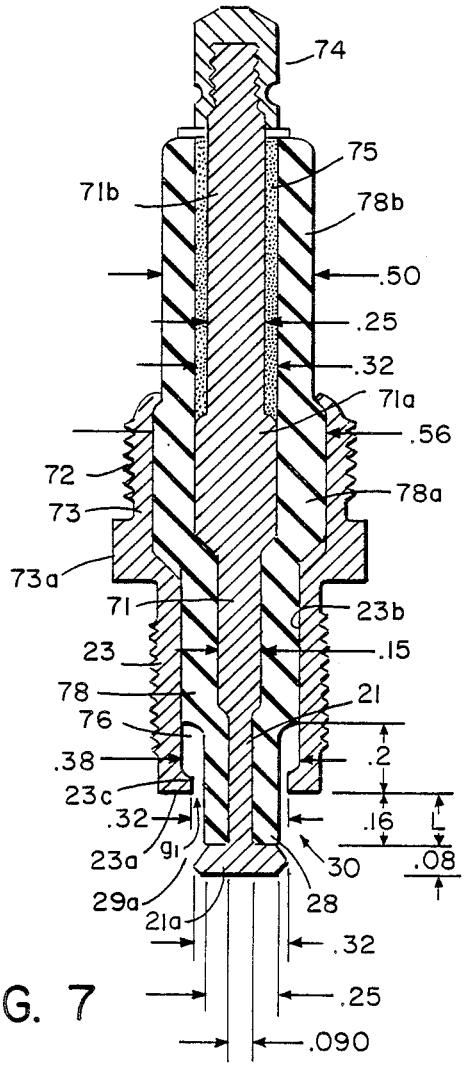
FIG. 7
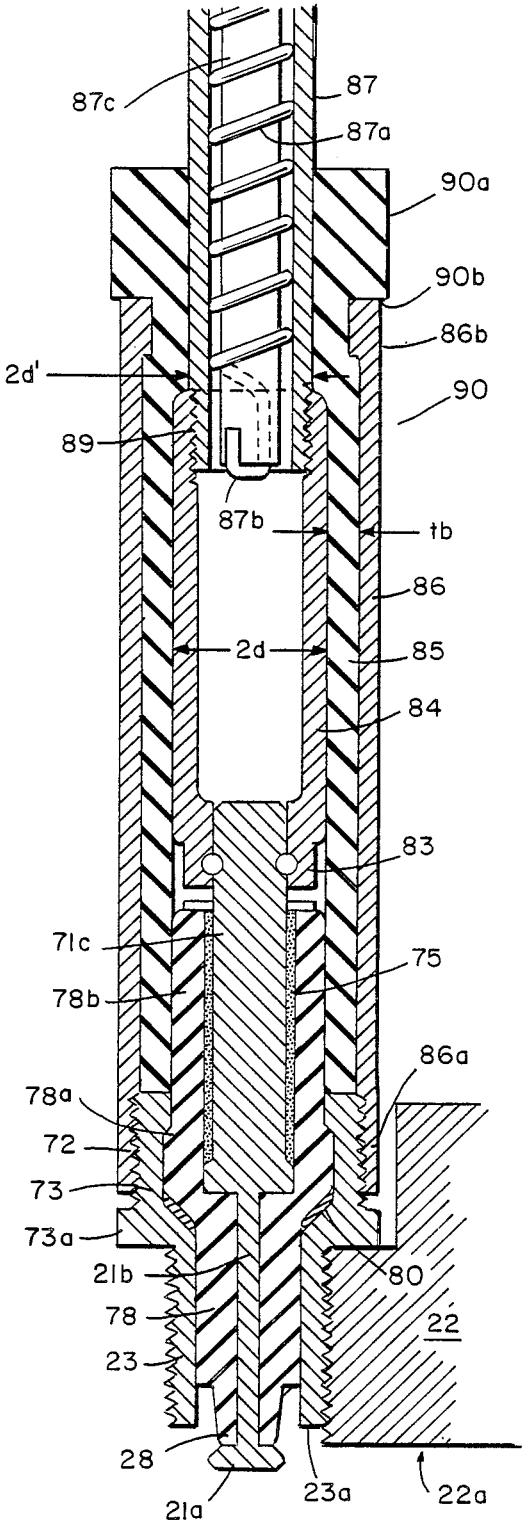
FIG. 8

ENHANCED FLAME IGNITION FOR HYDROCARBON FUELS

This application is a continuation in part of copending application Ser. No. 944,882, filed Dec. 22, 1986, now abandoned.

BACKGROUND OF THE INVENTION AND PRIOR ART

The present invention relates to fuel ignition systems, and particularly to such systems for forming electrical field discharges at the flame front of burning hydrocarbon fuels, particularly in internal combustion engines.

Considerable research has been conducted on ignition systems and on fuels for internal combustion engines with the objective of improving the combustion of the air-fuel mixture. More specifically, during the past thirty years there has been work done on improving the ability of ignition systems for igniting the fuel, especially of the inherently cleaner and more efficiently burning lean air-fuel mixtures, and also for improving the anti-knock characteristics of the fuel itself so that higher engine compression ratios can be used for higher internal combustion engine efficiency.

The prior art work on ignition has focussed on improving the ignition voltage and the spark's energy content, and on sustaining high electromagnetic (EM) fields at the flame front. Little attention, however, appears to have been given to actually improving the electrical coupling to the flame front, and to using the hydrocarbon air-fuel flame front plasma as a source of ignition plasma for absorbing electrical (discharge) energy.

Prior work on hydrocarbon fuels appears to have been largely limited to work on improving the fuel's anti-knock characteristic or octane rating and on the fuel's volatility. Little or no attention seems to have been given towards using the fuel's combustion plasma generating properties (or plasma rating as described hereinafter) as an approach for improving the ignition and combustion. The limited work on fuels appears to have occurred because, with few exceptions, no practical proposals were made to use the fuel's flame plasma generating properties in the internal combustion engine to electrically stimulate the combustion to improve lean mixture combustion.

Prior art work on spark ignition aspects are numerous, and for example, are summarized in Edward F. Obert's book, "Internal Combustion Engines and Air Pollution", pp. 532 to 566, *Spark-Ignition Engines,* Intext Educational Publishers, 1973. The work reported by Obert, and most the work since then, does not discuss the plasma properties of the flame. Earlier work by the applicant herein has been limited principally to the very high frequency (microwave) coupling to the flame plasma. For example, work on generating and maintaining a high electromagnetic field in the combustion chamber is disclosed in U.S. Pat. Nos. 3,934,566 and 4,138,980, where the concept of electromagnetically stimulated combustion is introduced. In these cases, EM stimulation can be made to occur in the entire combustion volume by high frequency electric fields resonantly stored in the combustion chamber with field strengths of order of 1000 volts/cm/atmosphere, exciting intermediate molecular levels at the flame front plasma. Other prior art of the applicant herein is disclosed in U.S. patent application Ser. No. 885,961, now U.S. Pat. No. 4,774,914 based on U.S. patent application Ser. No. 779,790, where EM flame-front stimulaion occurs near the spark plug site by means of a system designated as "EM Ignition".

In all these cases, while the concept of interacting with the flame plasma is either important or helpful, there is actually no discussion of redesigning the "ignition" system to either enhance or maximize to whatever extent flame discharge ignition naturally occurs, or to force the flame front to become an electrical discharge path for the ignition spark circuit. The closest prior art known is that of the applicant herein, namely the above referenced EM Ignition, wherein EM flame-front stimulation occurs by using a large antenna type plug tip which couples to the flame front: (1) the pre-breakdown electric fields associated with the high voltage rise of secondary pulses, and (2) the high frequency (of MHertz range) EM fields at the spark plug site arising from grounding the spark to the piston face. These electrical fields persist for up to a few microseconds (usecs). In neither case is the present invention contemplated.

Moreover, careful inspection of the antenna type plug tips of the EM Ignition system disclosed show insulator ends which are generally converging and metallic end tips which are either pointed or surrounded at the sides by insulating material. Such structures are of opposing shape to that of the present invention, and furthermore product electric field lines which are bowed outwards from the spark plug end, significantly reducing the electric field intensity from that which is disclosed with reference to the present invention.

Furthermore, in the previous cited cases, and in all the prior art work known to the applicant, there is no discussion of modifying the fuel itself to improve its flame plasma properties for preferentially absorbing electrical energy at the flame front.

A large amount of prior art work on the fuel was largely concerned with the use of lead to increase the octane rating, and is incidently related prior art in that lead reduces the electron-ion recombination coefficient to sustain a higher density plasma at the post-combustion zone or "tail" region of the flame profile which is detrimental to the present invention. Similarly, addition of alkali earth metals (with low ionization potential) to the fuel does produce a large volume, high density plasma during ignition, but since the plasma is generated principally by heating of the fuel, the density profile of the plasma follows the flame temperature profile, once again producing the main plasma in the tail region of the flame.

Other related prior art work is in the area of continuous flowing plasma jet ignitors, for example by Hilliard and Weinberg, *Nature* 259 (1976), where additional fuel is fed to a plasma jet cavity to feed chemical energy to the plasma by the locally rich burning flame. Such systems are of the dual fuel type with all the associated problems of handling of two fuels.

SUMMARY OF THE INVENTION

The present invention generally is based on having taken what is believed to be a new and different perspective on "ignition" by extending existing ignition principles and the new EM Ignition concepts to include the high density chemically produced hydrocarbon flame plasma as an intrinsic part of the ignition process, with the result that a more general and unified approach to ignition is attained. From this new ignition perspective, new optimized ignition systems have been invented, and answers found to hitherto unresolved ignition controversies.

In this new unified approach to ignition, the ignition spark, the initial flame (plasma), and the electric field at the spark plug site are viewed as interrelated, coexisting aspects or characteristics of a much more general, overall ignition process. The degree to which one usefully harnesses these interrelated ignition processes is what leads to a greater or lesser effectiveness of the overall ignition system. Moreover, the approach one takes to more optimally harness these various interrelated ignition processes depends strongly on the physical conditions or environment one is dealing with, and the result one is attempting to achieve.

The current state-of-the-art in ignition systems is believed to be the recently disclosed EM Ignition system which is designed to incorporate in a more optimal way the capacitive and inductive spark components within a very large ignition volume. The present invention builds upon these characteristics—by taking the new perspective and including in a self-consistent way the electrical spark discharge characteristics, the associated electric field, and the behavior of the resulting flame plasma in the electric field environment of the spark discharge. This new perspective has led to the invention of new ignition systems designated as ECDI and PFDI, and to the invention of a more optimized fuel for such systems, designated as EMT fuel.

The first of these new systems is a modification to the standard ignition system which provides "enhanced conventional spark ignition" (hereinafter sometimes referred to as the ECDI system), with the intention to attain optimal coupling of the naturally occurring electric field (associated with the spark discharge) to the initial flame front plasma forming at the spark plug site. This system can use either a high efficiency, high energy conventional coil to drive it, or a modification to be described and referred to hereinafter as ECDCC, which stores more energy per firing and delivers it to the "spark" with a very high efficiency of 70% to 80%, many times that of a standard ignition. The ECDI system preferably uses such as ECDCC system.

Another version of the present invention which follows from the new unified approach employs repeated discharge of electrical energy across the plasma in the flame as it propagates away from the initial spark site while still in the vicinity of the spark plug tip. Such a version is termed hereinafter as "pulsed flame discharge ignition" (PFDI). More specifically, this latter version of the present invention provides an optimized lean mixture ignition system by combining the space-time spark and flame plasma discharge characteristics and behavior with a special ignition energy delivery system and with a plug structure so as to form "ignition" sparks or discharges across the initial moving flame front or flame plasma. The system can be further improved by including an improved plasma generating property of the flame in an ignited mixture of air and a hydrocarbon fuel selected to have a higher "plasma rating" or "PR" rating of the fuel as hereinafter described.

It should be noted, with regard to the improved (EMT) fuel, that the use of lead in the fuel is undesirable since it produces a large "tail" plasma behind the flame front which robs electrical excitation energy from the front edge of the flame front plasma. Similarly, the use of alkali earth metal additives in the fuel in the present invention is undesirable if its presence produces the main plasma in the tail region of the flame, and thus tends to rob the incipient flame of electrical excitation energy.

The pulsed flame discharge ignition version of the present invention has as its practical basis the high efficiency voltage doubling coil with its high energy and very high efficiency, as described in copending U.S. patent application Ser. No. 688,030 (designated as the CDCC system), now U.S. Pat. No. 4,677,960, and the concept of a large "EM Control Volume" defined at the antenna type plug tip of the EM Ignition system described in copending U.S. patent application Ser. No. 885,961. This invention is based upon the recognition of the criticality of certain ignition parameters (such as but not limited to combinations of the spark plasma temperature and recombination coefficient, the lean hydrocarbon-air mixture flame plasma density and the electron neutral collision frequency, the ignition operating frequency, the flame speed and engine speed (RPM), the ignition pulse train temporal characteristics, the structure of the spark plug tip and the structure to which it is mounted, and the orientation of the structure and plug tip to the piston motion and more generally to the fluid motion at the plug tip) which define the pre and post breakdown spatial electric field intensity (both the magnitude and direction). When these parameters and structures are selected in the context of the present disclosure, then pulsed flame discharge ignition (hereinafter sometimes referred to as PFDI) can be attained and ignition energy can be dumped across the flame front, depositing up to hundreds of watts of electrical power at the flame front to produce intense electrical excitation energy to allow very lean mixtures to burn.

The fuel selected for use in the present invention is preferably tailored to generate a plasma with a high or boosted density at the flame front and a lower density elsewhere, i.e. it generates the plasma chemically. Such boosting is achieved by modifying the carbon to hydrogen or C/H ratio of the fuel (increasing the ratio) and simultaneously eliminating additives which reduce the plasma recombination coefficient and increase the tail plasma. Generally, additives such as low ionization potential metals are preferably not used except in very small amounts significantly lower than used heretofore for generating high density plasmas. Such trace additives may be desirable to provide a slight boosting of the density across the entire flame profile, especially along the front edge, provided that the tail density is much lower than the flame front density.

When used as a fuel in an internal combustion engine, the fuel as described above generates a flame plasma density profile which is suitable for stimulation by an intense electric field maintained in the combustion chamber, preferably in the region of the initial burn. The electrical energy is coupled at the flame front plasma, and marginally at the tail, to generate intense molecular internal excitation at the flame front to help the lean burning flame burn faster and more completely. More important, with respect to the novel ignition systems proposed herein, such fuel will further enhance their effectiveness to allow the burning of extremely lean mixtures.

To recapitulate, in the present invention ignition is viewed not simply as the electrical breaking down of air, but rather as the formation of electrical discharges which are coupled to the flame front itself which becomes the ignition spark (essentially a moving "spark"), to lesser or greater extend depending whether one is implementing an ECDI or PFDI approach, characterized in part by high to very high electrical power delivery to the mixture (of about 100 and 500 watts respectively). To achieve this, the interaction of the electric field with the spatial and time variations of the plasma discharges of the spark and moving flame are considered in detail from a new unified perspective. This is done in part with the objective of using the powerful new ignition technologies and approaches developed by the applicant in U.S. patent applications Ser. Nos. 688,030 and 885,961, to impose conditions so that these heretofore apparently unrelated ignition processes can be harnessed from the present new perspective to make ignition a process where electrical energy is delivered, not primarily to (the remnant of) the initial spark kernel or spark channel, but to the incipient flame front plasma.

OBJECTS OF THE INVENTION

It is a principal object of the present invention to provide a new and improved ignition system for a fuel-air mixture and including a plug structured so that a major portion of the length of the spark discharges therefrom extend into the mixture approximately perpendicularly to the electric field around the plug tip and the resulting initial flame front propagates into the air-fuel mixture with its front progressively parallel to the electrical field while still in the influence of the field.

Another object of the present invention is to use the high plasma generating properties of hydrocarbon flames in combination with an ignition system including a spark ignition means which provides ignition energy in which a significant part of the ignition energy is delivered to the flame; and to provide such a system in which the flame front from such a spark moves initially in a direction in which the electrical field intensity parallel to the flame front increases.

It is another object of this invention to provide a multiple pulsed flame discharge ignition such that an initial intense spark with moderately large capacitive component is formed (preferably in conjunction with a high efficiency (low turns ratio) voltage doubling ignition coil of the CDCC type) which has the major part of its length perpendicular to the electrical field intensity at the spark plug tip, and in which the flame propagating from the spark moves in a way that its direction becomes increasingly parallel to the electrical field intensity defined by the plug structure and mounting surface, so that on further pulsing of the (CDCC) ignition, electrical "spark" discharges are formed across the flame front, pumping up to hundreds of watts of electrical power into the flame front, versus the energy being delivered into the spark which forms at the same initial (spark remnant) site providing little or no assistance to the propagating flame.

It is another object of this invention to provide a system which uses the electrical field of the high discharge voltage of approximately 500 volts associated with a low spark discharge current (e.g. 50 ma to 200 ma) to improve the coupling of such field to the flame plasma; to provide such a system in which the discharge current is in the form of sine-waves with peak amplitudes in the range of 100 to 400 ma; to provide such a system which includes a large spark gap of about 0.1 inches of a projecting type spark plug tip providing a significant normal component of electric field to the spark orientation, and a button at the end of the plug tip providing a long ignition duration corresponding to a longer flame path so that the discharge electric field is coupled to the flame plasma over the larger volume defined by the button and the plug shell.

It is another object of this invention to provide a hydrocarbon fuel the composition of which is modified such that the ratio of carbon to hydrogen (C/H) in the fuel is in the range of 0.5 to 2.0 to provide a high plasma rating or PR of the fuel to improve the ability of coupling electrical energy to it.

Yet another object of this invention is to provide such a fuel in which are present low ionization potential materials in trace amounts sufficient, when a mixture of air and such fuel is ignited, to boost the plasma density across the entire flame profile or flame zone without unduly increasing the density in the tail zone; and to provide such a fuel having no more than trace amount of alkali earth metals and optionally one or more additional compounds in amounts sufficient so that upon ignition, the resulting flame plasma density is boosted with the plasma profile still exhibiting a sharply dropping plasma tail characteristic of pure hydrocarbon fuel-air combustion.

It is another object of this invention to increase the flame front plasma density generating properties in an ignited fuel-air mixture as described above in conjunction with a high octane rating of the fuel, preferably by increasing the relative content of "aromatic" fuel components to the remainder of the fuel.

It is another object of this invention to provide a combination of such a high plasma density generating fuel with a continuous flow combustion system, e.g. a turbine or burner, that uses techniques to electromagnetically stimulate combustion of the fuel.

Another object of the present invention is to use such a fuel with an EM Ignition system featuring sequentially pulsed ignition "firings" and an antenna type plug tip contoured to produce a pre-breakdown electric field distribution at the tip with electric field components distributed largely perpendicular to the spark and largely parallel to the flame as it propagates away from the tip (and is still contained in the EM Control Volume).

Another object of the present invention is to use such a fuel with a system providing a spark energy delivery efficiency greater than 50%, i.e. the CDCC system using a low turns ratio voltage doubling coil with primary circuit capacitor charged to preferably between 360 and 660 volts, and secondary circuit capacitance of about 200 picofarads contained in part in a "boot" mounted on a spark plug (or in the plug itself) which has a projecting tip for producing a large ignition volume and a large arc burning voltage of at least two hundred volts under typical operating conditions.

Another object of the present invention is to use such a fuel with an EM Ignition system with an ignition "sparking profile" characterized by the sequential generation of single sine wave sparks with a large capacitance component and a large oscillating sine wave inductive component, wherein such closely spaced single sine wave sparks are formed to the spark plug shell and/or the piston face to create high, longer duration pre-breakdown local electric fields followed by some degree of electrical discharge across the flame front around the spark plug tip.

Another object of the present invention is to use a spark plug with a partially insulated center electrode nose end which is contoured to provide focussing of the electric field which exists during all stages of the plug firing so that the plug nose becomes essentially a cylindrical electric field lens resembling a hyperboloid of one sheet for focussing the electric field to a small toroidal region surrounding the cylindrical plug end for reducing the breakdown voltage and for further guiding and coupling of the electrical spark energy to the initial flame as it propagates away from the initial spark site and into the chamber and around the large toroidal gap surrounding the plug nose end.

Another object of the present invention is to provide such a focussing lens plug with a firing end button tip made of small diameter, erosion resistant material with its maximum diameter projecting just beyond the ceramic insulator tube end of the plug nose and contoured to be part of the plug lens to further improve the electric field focussing and thus provide a more optimized electric field focussing lens plug (or EFFL plug).

Another object of the present invention is to further contour the plug nose of such an EFFL plug in conjunction with contouring of the plug shell end and positioning with respect to the cylinder head to improve the focussing to the surrounding ground surfaces comprised of the plug grounding shell end and/or edge of cylinder head around said plug shell end so as to reduce the breakdown voltage between the plug tip and said surrounding ground surfaces to further improve coupling to the initial flame front.

Another object of the present invention is to provide such an EFFL plug for the industry standard 14 mm threaded shell plug which has an insulator of approximately 0.1 to 0.12 inch thickness surrounding a 0.09 to 0.12 inch diameter center high voltage conductor at the region where the gap between the insulator and the plug grounding shell is a minimum, providing an overall insulator diameter of approximately 0.30 to 0.36 inches inside the shell near the plug firing end, and a smaller overall diameter between 0.22 and 0.26 inches for the insulator section located at the plug firing tip, and a diameter of approximately equal to and slightly greater than 0.25 inches for the high voltage metallic firing end button.

Another object of the present invention is to use such an EFFL plug with a CDCC ignition system, preferably including a smaller capacitive boot of about 50 picofarads capacitance and with spark plug wire of preferably high inductance and low resistance, where the capacitive discharge system of the CDCC system is contained along with the ignition coil in an insulating enclosure to provide high ignition system efficiency by minimizing the coil primary current path, and where EMI may be reduced by using a further enclosure of a conducting material grounded to the engine block and thus defining a further improved or optimized CDCC ignition.

Another object of the present invention is to provide a high efficiency capacitive discharge ignition system using low forward drop SCRs as the spark pulsing switches, preferably of one volt forward drop at 100 amp current, and capable of producing closely spaced multiple spark pulses of short duration of 80 to 100 usec, brought about by a speed-up shut-off circuit which naturally and simply applies a negative bias to the SCR trigger gate during SCR firing to shorten the SCR's recovery time and provide an optimized ignition pulse train for the present invention.

Another object of the present invention is to optimize said improved CDCC ignition system by including said speed-up SCR shut-off circuit so that the ignition can have a minimum pulse firing time without the SCR latching (80 usecs for current low forward voltage SCRs) and can thus have many spark pulses per ignition firing, say ten at low engine RPM and at least three at high RPM, and by further adjustment and refinement of the ignition system parameters to provide an optimized PDI system, defined as the CEI Ignition system.

Another object of the present invention is to provide a somewhat higher peak current (i.e. about 1 amp) ECDI system with a shorter spark pulse period of about 100 usecs and a low primary coil turns, i.e. 10 to 30 turns depending on the primary voltage used, and preferably a recharge circuit for supplementing the lower energy stored in the discharge capacitor of the modified ECDI system (i.e. 100 to 300 millijoules versus 300 to 500 millijoules for the standard PDI system).

Other objects of the invention will in part be obvious and will in part appear hereinafter. The invention accordingly comprises the apparatus possessing the construction, combinations of elements and arrangements of parts, and the process including the several steps and relation of one or more of such steps with respect to each of the others, all of which will be exemplified in the following detailed disclosure and the scope of the application of which will be indicated in the claims.

For a fuller understanding of the nature and objects of the present invention reference should be had to the following detailed description taken in connection with the accompanying drawings.

BRIEF DESCRIPTION OF THE DRAWINGS

FIG. 7 is an idealized, cross-sectional view of a preferred spark plug for use either alone or with the boot of FIG. 8 and suitable for use in either of the PFDI or ECDI systems.

FIG. 8 is an idealized, cross-sectional partial view of a preferred plug with a preferred capacitive boot particularly suitable for use in the PFDI system.

FIG. 8*a* is a schematic diagram of the equivalent circuit of the embodiment of FIG. 8.

FIG. 9 is a graphical representation of the spark and flame plasma distributions as a function of time resulting from ignition firing in a PFDI system preferably of a multi-sparking CDCC system with a very lean hydrocarbon fuel-air mixture, showing the various time dependent plasma build-ups and decays with time.

FIG. 11*ff* is a longitudinal cross-sectional fragmentary view of an idealized EFFL plug with an overly extended shell end with interior surfaces contoured to form an electric field lens which, in combination with the plug nose lens, further intensifies the electric field between the plug end button and an interior point of the plug shell.

DESCRIPTION OF PREFERRED EMBODIMENTS

Figure 1:
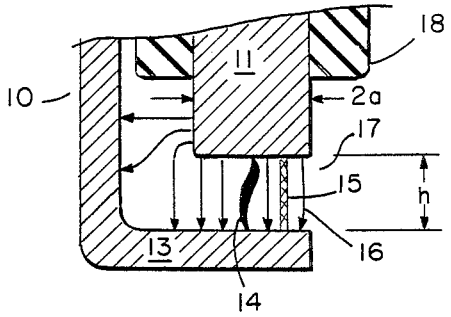
FIG. 1 PRIOR ART
FIG. 1 depicts an idealized, partial, cross-sectional view of a standard spark plug tip defining a spark gap, and showing various spark characteristics.

With the advent of EM combustion stimulation, and recently with the advent of the more practical EM Ignition technology, the idea has been introduced of viewing ignition systems for hydrocarbon fuel-air mixtures, not as electrically isolated or independent spark generators, but as a more general system which includes the flame plasma properties of the fuel-air combusting mixture as part of the ignition system or electrical circuit. When viewed in the further light of the space-time properties of the spark discharge plasma, substantially improved systems (embodying the present invention), have been developed—a lower power version based on Standard Ignition providing typically 100 watts spark power (ECDI), and a higher power version based on EM Ignition providing typically 500 watts (PFDI).

For both systems there is a restructuring of the tip of the spark plug with respect to the surface on which it is mounted. By using such a restructured plug tip in conjunction with a high energy/high efficiency ignition (a CDCC system) operating either with currents of several hundred milliamps of the "transitional glow discharge" or of one or two amperes of the "transitional arc discharge", substantial ignition energy can be coupled to the flame front either through the high field that exists for currents in the range of about 50 ma to 200 ma, or through forcing the initial flame front itself to become an intense spark discharge plasma absorbing up to hundreds of watts of electrical power (in the amps current range), and thus greatly improving the Lean Burn capabity of the system.

The "low" current or ECDI version of the present invention employs a somewhat projecting special type spark plug tip with a gap of about 0.1" for a large flame path. In the "high" current or PFDI version which typically uses up to several amps of current, a more projecting plug tip approximately 0.2 inches long is used, and is shaped such that the initial spark forms mainly perpendicular to the electrical field intensity so that on subsequent ignition pulses the coupling to the decaying ignition spark plasma is very poor, but the coupling to the flame propagating from the initial spark is strong because the flame front becomes progressively parallel to the electrical field and is able to absorb the electrical power. The flame front itself becomes the ignition spark, and the ignition circuit is completed through it.

One can further enhance these effects to realize an even leaner burn by modifying the fuel itself so that F-field energy can be more easily coupled to its air-fuel mixture flame front plasma. Such a fuel has been designated as EMT fuel. Such modified fuel is characterized by having, during combustion, a higher than normal electron plasma density at the flame front produced by the phenomenon of chemi-ionization. Preferably, the fuel has a C/H ratio near one, and more generally in the range of 0.5 to 2. Trace amounts of alkali earths may be used in combination with fuels of appropriate C/H ratios (from 0.5 to 2) and/or preferably with an overall plasma recombination coefficient that forces the tail plasma to decay rapidly.

Effective stimulation of the flame is achieved by using such an EMT fuel in IC engines where the ignition can be pulsed ON and OFF during an ignition firing, generating successively high and low electric fields in the region of the flame front. In this way electrical energy is coupled at the flame front plasma where it is needed, and to a lesser extent to the successive spark plasmas and to the tail plasma behind the flame, i.e. pulsing insures that the spark and tail plasmas are allowed to decay during the electric field OFF periods while the chemically produced flame front plasma grows progressively in volume and intensity, absorbing progressively more of the electrical energy on successive pulses while the flame is within the "EM Control Volume" (the volume over which the air-fuel flame plasma is influenced).

The modified fuel of the present invention (EMT fuel) can be used in all internal combustion (IC) engines, from gas turbines where the fuel can be used in conjunction with an EM field resonantly stored in the combustion zone, to lean burn reciprocating and rotary engines where the fuel may be used in conjunction with EM Ignition using a projecting spark plug tip for producing a large EM Control Volume with mainly perpendicular and parallel electric fields referenced to the initial spark and the propagating flame front respectively. Such a fuel is also applicable to burners, with operation similar to turbines.

FIG. 1 is a longitudinal, cross-section partial view of a nose end of a prior art type of spark plug 10, including center metal electrode 11 of diameter "2a", surrounded on its sides by nose insulator 18. Electrode 11 has one uninsulated end defining a spark gap 17 of width "h" with respect to ground electrode 13. Shown also is the spark 14 as defined by the applicant to include the initial capacitive component formed upon the breakdown of the dielectric in gap 17 and subsequent discharge of the high voltage secondary capacitance, followed by the "inductive" component resulting typically from the delivery of the magnetic energy stored in the coil of a standard inductive ignition system, and the electromagnetic (EM) electric field component 16 (solid lines with arrows pointing in the field direction); such field is now claimed by the applicant to exist (co-exist) in all phases of the ignition process.

Figure 1A:
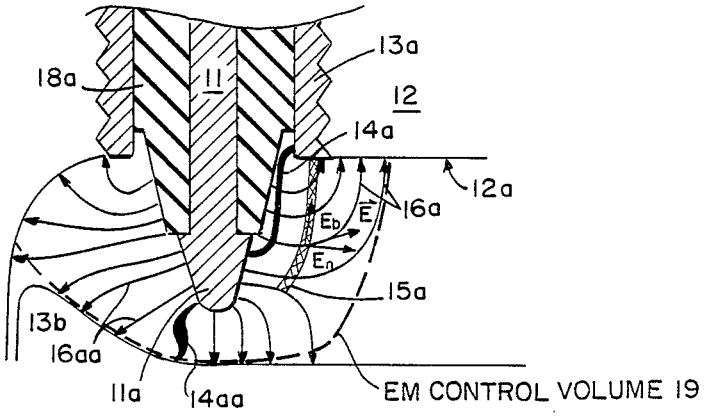
FIG. 1a PRIOR ART
FIG. 1*a* depicts a partial, cross-sectional view of an antenna type spark plug tip of an EM Ignition system mounted near the end of an internal combustion engine chamber, depicting the electric field distributions around the tip.

FIG. 1*a* is a longitudinal, cross-section partial view of a prior art "antenna type" spark plug tip recently disclosed by the applicant in pending U.S. patent application Ser. No. 885,961 depicting the enlarged region over which the electric field lines 16*a*, 16*aa* have their influence, namely the EM Control Volume 19. In this design, the plug tip 11*a* is generally pointed, as shown, to be able to focus the electric field to more readily form spark 14*aa* to the piston 13*b* (as well as to the plug shell 13*a*-spark 14*a*). Sometimes the spark (namely spark 14*a*) produced by this plug can have its direction largely normal to the electric field E but the resulting flame 15*a* (shown cross-hatched) is also largely normal to the electric field, having a large component En versus a large tangential component Et, the latter preferably. Furthermore, the conical shape of the tip 11*a* and insulator tip 18*a* with pointed end extending outwardly reduces the field intensity of the electric field (lines 16*a*) because of the large bowed path length between the surface of tip 11*a* and surface 12*a* of the cylinder head 12. In the case of spark 14*aa*, which is parallel to the E-field, no effect at all of the present invention is achieved.

Spark plugs similar to the one disclosed in U.S. patent application Ser. No. 885,961 (excepting for the tip 11*a* which protruded less and had same diameter as the main wire 11) were installed in a 1.3 liter 1985, Ford Escort engine. Using a high octane unleaded fuel, the engine produced excellent lean burn results. However, since the engine is of the hemi-head type with the spark plug located near a curved surface near one end of the combustion chamber similar to that shown in FIG. 1*a*, the plug thread tip necessarily projected well beyond the cylinder surface to achieve best results (contrary to the teachings of the present invention since it reduces the E-field converging onto the cylinder surface). The tip itself and conical shape of the insulator tip further reduced the electric field intensity over what is now seen to be preferred, as already pointed out with reference to FIG. 1*a*. Furthermore, whenever a spark was formed at the left side ofthe cylinder head (see FIG. 1*a*), the E-field coupling to the flame front propagating from that spark would be poor because the E-field is largely normal to it.

Figure 1B:
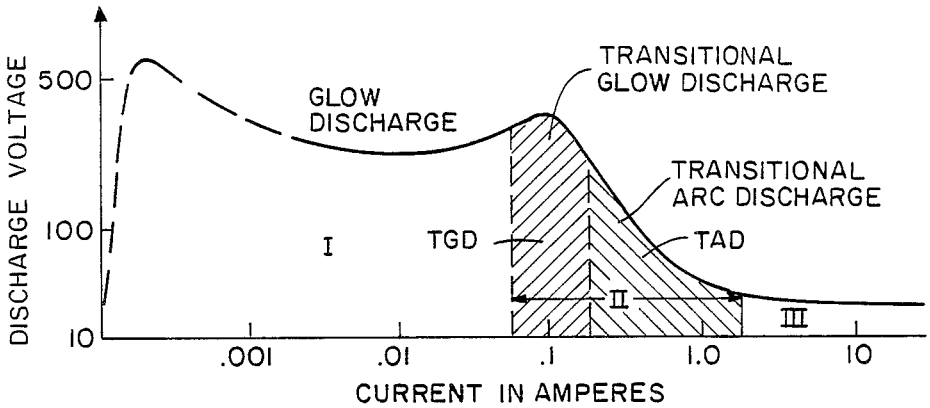
FIG. 1*b* is a graphical representation of the typical voltage-current discharge characteristic of a standard spark plug such as is shown in FIG. 1.

FIG. 1*b* depicts typical Voltage-Current discharge characteristics of the plug of FIG. 1, further showing the three principal regions of interest for the present purposes, the glow discharge region I defined as that portion of the curve up to about 50 ma (and a potential of about 500 volts); the transitional region II defined as that portion of the curve between a current of about 50 ma (voltage of about 500 volts) and a current of about 2 amps (voltage of 50 volts); and the arc discharge region III defined by an approximately constant voltage of 40 volts for currents greater than 2 amps.

For the purposes of describing the two major versions of the system of the present invention (ECDI aind PFDI), there are two sub-regions in region II, designated as TGD for transitional glow discharge, and TAD for transitional arc discharge. Region TGD spans the current range of 40 ma to 400 ma, and region TAD spans the current range of 400 ma to 2 amps. The ECDI and PFDI systems are defined by (operate within) the TGD and TAD regions respectively, as will be seen in the later discussions.

Referring again to FIG. 1, for the typical prior art spark current of 50 ma, the voltage across spark gap 17) in air or in a typical air-fuel mixture) is approximately 500 volts, representing a field strength of 5000 volts/cm for a gap width h of 0.040 inches (1.0 mm). As now viewed from the perspective of electric field of E-field flame stimulation, it will be seen that this statement implies that along with the ignition spark there exists an E-field of the required strength (1000 volts/cm/atmosphere) to stimulate the hydrocarbon fuel-air mixture flame in the spark gap 17 under almost all conditions of operation of an engine or burner. It is here asserted that electric field stimulation of the flame is a hitherto unrecognized key characteristic of low current (less than 200 ma) spark ignition. Indeed, it is hypothesize here that not only is this the case, but that once this is accepted, several long standing ignition controversies become resolved and help confirm the Electrical versus Thermal Theory of Ignition.

One such controversy is that relating to the role of current magnitude in ignition. It has been shown *Bosch Technical Report* 5, 1977 that when the current is increased from 25 ma, to 50 ma, to 100 ma, the igniting capability for lean mixtures improves progressively, and then only marginally if at all in further current increase to 200 ma and to 400 ma. As can be seen with reference to FIG. 1*b*, as the current increases from 100 ma, the field strength progressively drops, until at about 200 ma it becomes of a marginal value for enhancing the flame. That is, as the current increases, field enhancement is traded off against the size of the ignitional kernel (current). Such a trade-off is very favorable up to 100 to 200 ma as a sufficient electric field can still be mantained to enhance the combustion reactions in the spark gap. Beyond 400 ma electric field enhancement is lost, consistent with observations on igniting ability with current. Furthermore, at about 1 amp of peak current the ignition capability of a system has in some cases been observed to be less than that 100 ma. Since at 1 ampere, the E-field in the spark gap is 50 volts for a standard gap, representing the same energy delivery to the gap as at 100 ma, one can conclude that the difference is due to the loss of field enhancement at the 1 ampere current level.

Another hitherto unresolved question relates to measurements by Hancock et al. *SAE paper* 860321, 1986, which gives the optimal minimum ignition durations as 0.4 msec and 0.6 msec respectively for stoichiometric and lean flames. For a flame speed of 2.4 mm per msec and a radius of 1.0 mm of gap 17, the time of traversal is then 0.4 msec, equal to what was measured by Hancock as the time beyond which one obtains no further ignition improvement by extending the spark duration (for quiescent combustion where there is very little fluid motion through the spark gap). It is submitted that this is a further confirmation of the view that the flame is electrically enhanced while in the gap. The increased time as the mixture is made leaner is consistent, since it is known that flame speed drops with air-fuel ratio. The flame speed of 2.4 mm/msec is six times the gasoline flame speed of 40 cm/sec, corresponding to the six-fold expansion effect of the initial flame, i.e. the flame temperature is six times the gas temperature.

Finally, Hancock et al diagram differences in cycle-by-cycle variation (CBCV) as a function of ignitiona timing and gap width. Particularly, a dramatic difference is seen both in shape and magnitude of the CBCV-arc duration curves corresponding to ignition timings of 32 and 55 degrees before top dead center (BTDC) for a gap width of 3.0 mm (versus 0.9 mm where no difference is seen). It is here asserted that the difference is due to the E-field enhancement effect, i.e. that at the approximate $\frac{1}{3}$ load setting of the 7.5 compression ratio engine, at 32 and 55 degrees BTDC the air density corresponds to applied pressure in the cylinder of approximately two and one atmospheres pressure respectively. For a gap width of 3.0 mm and an assumed arc voltage of 500 volts, this further corresponds to a field strength of 750 and 1,500 volts/cm/atmosphere (v/cm/a) respectively. But this is precisely consistent with the present teaching, namely that at the value of 750 v/cm/a, E-field enhancement is marginally effective in stimulating the flame within the gap, producing a relatively flat CBCV-arc duration curve with a poor CBCV of 20%, while at 1,500 v/cm/a E-field enhancement is fully operative, showing a sharp drop in CBCV to 10% in 0.5 msecs, corresponding to the time that the flame is within the gap (and subject to E-field stimulation). For a gap width of 0.9 mm, no difference in behavior of the CBCV-arc duration curve is shown with ignition timing at 32 and 55 degrees BTDC, which is now explained since the E-field is very high in both cases, i.e. 2,500 and 5000 v/cm/a, which produces strong stimulation in both cases.

The present invention therefore serves to optimize a standard ignition system by, in addition to increasing the gap size (but not to the point where the E-field falls below 800 v/cm/a) increasing the electrode gap area, thus increasing the E-field enhanced flame travel length and the duration of the spark correspondingly. In such a case, the spark current typically starts at a value of about 300 ma corresponding to about 200 volts discharge voltage, and progressively drops, increasing the voltage and increasing the E-field stimulating effect. In principle this enhancement can be extended to an unlimited path length, the practical limitation being however the E-field strength that one can maintain.

Figure 2:
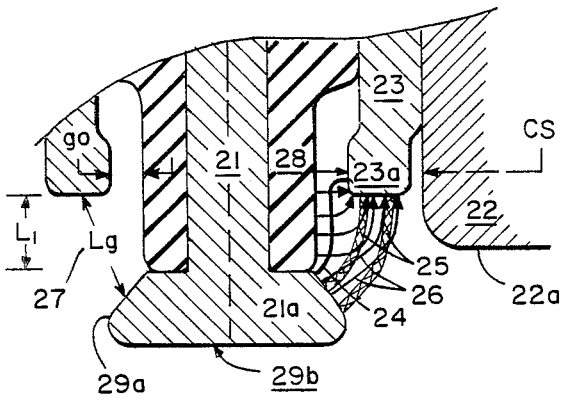
FIG. 2 is an idealized, longitudinal cross-sectional, partial view of a projecting type spark plug tip, particularly useful in the ECDI system and embodying the principles of the present invention, which view also includes a showing of an electric field distribution defined by the plug tip structure with respect to both the initial spark or arc and a propagating flame front.

FIG. 2 is a cross-sectiona longitudinal partial view of a spark plug suitable for more optimally employing the low current E-field enhanced conventional discharge ignition, or ECDI version of the present invention. This plug differs substantially from the prior art plug shown in FIG. 1 in that it omits any ground electrode per se, and differs significantly from the prior art type plug of FIG. 1*a* in that it includes a large erosion resistant metallic plug tip or "button" 21*a* (having substantially flat outer surface 29*b*) mounted on an axially disposed conductor 21 typically 0.090 inches in diameter encased by electrically insulating layer 28 of substantially constant thickness of 0.06" to 0.08" for at least a length 2L1 defined hereinafter. Disposed that the outer surface of layer 28 is electrically conductive plug shell 23 which includes projecting cylindical end portion 23*a* spaced apart from the central wire 21 by a uniform distance of between 0.02" to 0.04". Length "L1", defined as the axial distance between the button 21*a* and the bottom of end portion 23*a* is in the range of 0.06" to 0.12". A portion of the cylindrical periphery of button 21*a* forms conical frustrum 29*a* at an approximately 45 degree angle to the axis of wire 21 in a direction away from the tip. Thus, an approximately toroidal gap 27 is created between frustum 29*a* and portion 23*a* providing a large ignition volume as required. The geometry provided by forming the periphery of button 21*a* as a frustrum serves two further very important advantages, namely to intensify the E-field in the gap 27 and to reduce the detrimental effects of surface erosion from ignition sparks (because of the larger mass of button 21*a* which is preferably a Nickel alloy).

Figure 2A:
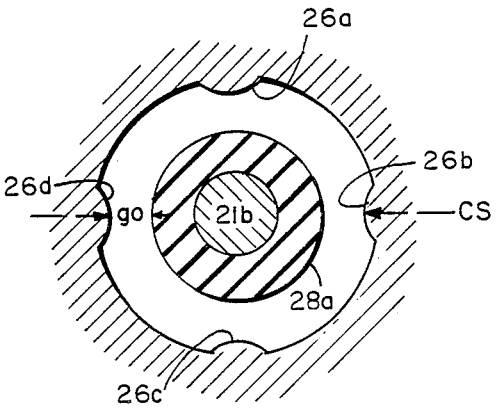
FIG. 2*a* is a cross-section taken along the plug tip of FIG. 2 including lobes for controlling the position of the initial spark.

FIG. 2*a* shows the plug of FIG. 2 in cross-section through plane defined by CS of FIG. 2, with center conductor 21*b* surrounded by insulating layer 28*a*, and several lobes 26*a*, 26*b*, 26*c*, 26*d* forming smaller gaps g0 to the surface of insulator 28*a* thereby intensifying the field in these gaps.

Inspecting the plug tip of FIG. 2, it can be seen that the length of its flame path and thus its E-field enhanced volume is significantly greater than that of FIG. 1. The E-field enhanced volume can also be increased by adding a large ground electrode across button surface 29*a* with the additional advantage that the flame path is increased by a relatively lesser amount. However, this advantage is more than off-set by the disadvantage of the large heat absorbing ground electrode, it being further relatively easy to provide a longer spark duration since the power delivery is relatively low. It is also disadvantageous to have the spark and field parallel to each other versus at some angle to each other determined by the present plug tip geometry.

In the preferred design shown, spark 24 forms through local initial breakdown in a gap g0 between shell portion 23*a* and insulator surface 28 across which almost the full ignition voltage is applied. The local discharge plasma then moves along the surface of the insulator (seeking the other electrode) and anchors itself on button 21*a* defining a spark direction largely perpendicular to the E-field lines 26; flame fronts 25 (shown cross-hatched) move away to become progressively parallel to the E-field lines 26. Because the spark 24 is principally perpendicular to the E-field, a higher initial (transient) arc voltage Varc is attained, 1½ the normal 500 volts at 0.1 amp, thus providing a higher E-field for a given gap length "Lg" during part of the discharge cycle.

Furthermore, as will be discussed more fully with reference to FIG. 2*d*, the coupling to the flame fronts 25 is improved since the E-field lines 26 become progressively more parallel to the fronts (away from the spark). Additionally, in automotive applications where a distributor is used, the over-all efficiency will be improved, as discussed with reference to FIG. 10, by the even higher spark gap voltage Varc (over the rotor gap voltage Vrotor).

The (EDCI) system thus described is further improved by using a modification to the ignition system of the CDCC type described in U.S. patent application Ser. No. 688,030. This proposed modification uses approximately five times the number of primary turns used in the prior system and about half the primary energy storage capacitance, to provide a sinewave current with an initial peak current approximately one eighth that of the prior (CDCC) system, or 300 ma, and approximately five times in the sine wave period (0.4 msec for example). Thus a 3 msec duration ignition discharge can easily be achieved with eight complete oscillations. Preferably coil turns ratio is 50 and capacitance is 4 ufd which is charged up to about350 volts providing 0.3 joules stored energy.

An actual design for such a modified coil would preferably use a standard U core/I bar combination of 1 square inch cross-section and 2.5 inch winding length, with approximately 100 turns of #14 primary wire (#13 to #15) and 5000 secondary turns of #28 wire, providing an overall very high efficiency of 60% to 80%. Such a system would be of special interest in retrofit applications where moderate leanness of operation is required, e.g. 20:1 to 21:1 AFR, and where cost is more important (versus the PFDI system to be described which is more suited to OEMs).

Figure 2B:
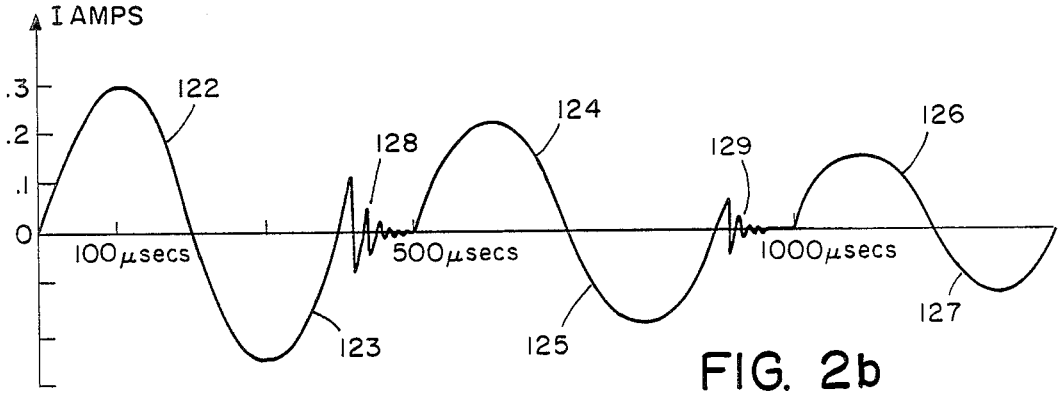
FIGS. 2*b*, 2*c* are graphical representations of preferred discharge current-voltage curves used in conjunction with the ignition ignition system having the plug tip of FIGS. 2 and 2*a*.
Figure 2C:
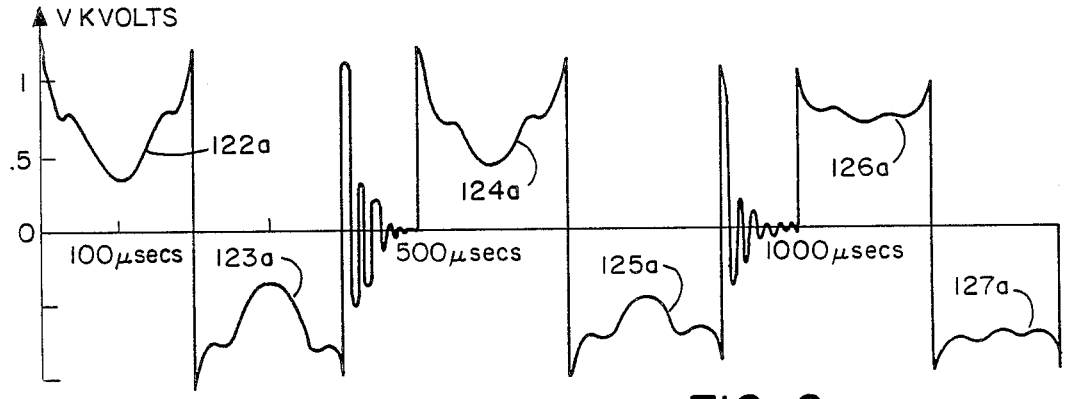

The modified ignition system (sometimes hereinafter referred to s ECDCC) is preferably used in the multipulse ignition mode as is depicted in FIGS. 2*b*, 2*c*, where the reference numerals 122 and 123 represent the two halves of the sinewave current, and reference numerals 122*a*, 123*a* represent the corresponding arc voltage waveforms, with a period of 400 usecs and a time between pulses of 100 usecs (i.e. 0 to 250 usecs), so that the subsequent "sparks" 124/125, 126/127, etc. have a chance to form across the moving flame front plasma for further possible improvement. Clearly, 300 ma was choen as the first peak to provide a strong initial spark kernel, while the sinusoidal nature of the current provides significant time durations at less than 200 ma, wherein E-field enhancement is strong as the voltages 122*a*/123*a* are high. As the current peaks of successive half-waves progressively decay to 200 ma, the E-field enhancement maximizes since the voltage achieves, the maximum value and is approximately flat (constant) at that value, i.e. the voltage waveforms 122*a*, 123*a*, 124*a*, 125*a*, 126*a*, 127*a* become progressively flatter, with greater arc time spent near the peak voltage for maximum enhancement of the flame. With reference to FIG. 1*b*, the now defined ECDI system is seen to be operated within the defined TGD region as required.

The typical rate of energy delivery of such an ECDI system is 100 watts, or five times the standard ignition, i.e. assuming an average current of 200 ma and an arc burning voltage of 500 volts. In order to increase the power delivery rate, one can attempt to modify the independent variables, i.e. either increase the spark current or the size of the spark gap. But increasing the spark current (for a constant gap) is accompanied by a reduction in the voltage (for no overall gain) and a reduction of the E-field strength. Increasing the gap size reduces the field strength.

The implication is that some other approach must be taken to increase the energy delivery rate, which has led to the other aspect of the present invention, namely the PFDI aspect. In this aspect, E-field discharge enhancement (ECDI) is abandoned, and a much larger current of several amps peak is used, which can be provided (in a practical, cost effective way) by the CDCC system of U.S. patent application Ser. No. 688,030. The relatively low arc burning voltage is then increased (to about 200 volts) by further extending the plug nose end of FIG. 2 to that shown in FIG. 2*d.*, providing a higher power of about 500 watts to the spark, but relatively little to the initial flame front as the E-field is low. As a result, another (and most significant) step was taken (in arriving at the PFDI version of the invention), namely that of forming actual plasma discharges across the flame front by repetitively pulsing the ignition in conjunction with parameter adjustments including but not limited to the plug structure, the fuel combustion properties, the spark discharge properties, and the ignition system properties. Below follows a description of such preferred embodiment of the PFDI version of the present invention and analyses necessary to understand its principles of operation.

Figure 2D:
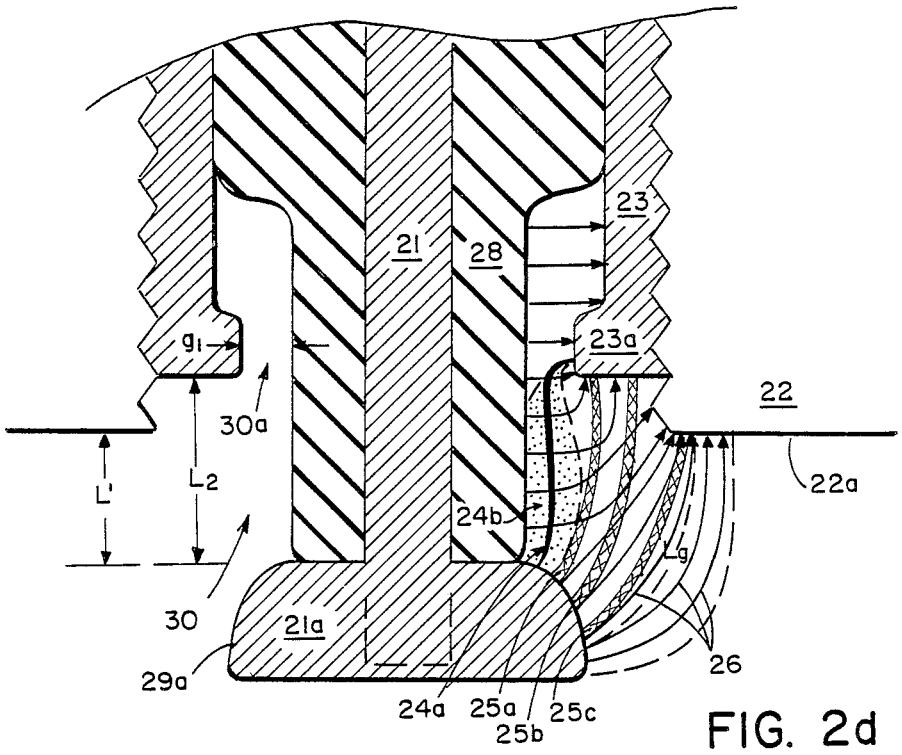
FIG. 2*d* is an idealized, longitudinal cross-sectional partial view of a projecting type spark plug tip embodying principles of the present invention and particularly useful in the PFDI system, depicting the electric field perpendicular to the spark and more parallel to the propagating flame front plasma.

Referring to FIG. 2*d* in which like numerals denote like parts (with respect to FIG. 2) there is shown plug nose 30 considerably extended beyond shell 23 by a length L2 which typically equals 0.2 inches. Since nose 30 is long relative to gap 30*a* (width g1) the E-field lines 26 are mainly perpendicular to the major part of the spark core 24*a* (the capacitance spark component), which reduces the coupling of the E-field to the existing spark or to the residual spark or spark remnant (depending on the situation). In this configuration is established some of the necessary (but not sufficient) conditions for producing enhanced ignition, but not of the ECDI type described earlier wherein the E-field associated with the spark discharge provides the flame enhancement, but rather a "pulsed flame discharge ignition", wherein the flame front plasma itself becomes the ignition plasma. That is, since the flame front, shown typically at 25*a*, 25*b*, 25*c* in cross-hatched lines, has much more of its front parallel to the E-field than does the spark 24*a*, and since the spark is a very high density plasma which tends to exclude the field, namely the normal component En, which is the predominant one here, little electrical energy can be coupled to the spark after the initial breakdown, while effective coupling can occur to the flame. However, since the discharge E-field is low (for the higher peak currents of 1–3 amps), then there is employed the alternative (PFDI) approach where the ignition is pulsed in a way that the flame front itself becomes the discharge plasma. In other words, the plasma physics of the spark, the flame plasma, the ignition, and the E-field (governed in part by the geometry of the plug and mounting structure) is used to insure that with a CDCC ignition system designed for this application and pulsed in a precise manner, ignition discharges can be made to occur across the flame front to deliver hundreds of watts of electrical power to the weak, very lean flame, providing flame stimulation of major proportions.

More specifically, a preferred embodiment of the plug tip of FIG. 2*d* has preferably center conductor 21 with diameter 0.09" terminating in a button 21*a* with a surface 29*a* representing essentially a 90 degree arc of a circle. The plug shell is preferably recessed 1/32 to 3/32 of an inch from the cylinder head surface 22*a*, defining a length shown "L" which is approximately $\frac{2}{3}$ of length "L2". Insulator 28 has its surface essentially vertical (i.e. parallel to conductor 21) and its thickness is between 0.06 to 0.09 inches. Gap g1 is in the range of 0.02 to 0.06 inches, preferably 0.04 inches. With such a geometry, spark formation 24*a* occurs with its major part normal to the E-field. First flame front 25*a* results from the inductive plume 24*b* which surrounds spark core 24*a* at the end of the first spark discharge. Flame fronts 25*b* and 25*c* are spaced apart by one mm on the scale shown, representing the flame front position $\frac{1}{4}$ and $\frac{1}{2}$ msecs later assuming moderate (1000 RPM) engine speed induced air flow which doubles the flame speed. Thus flame front 25*c* very strongly couples to the E-field since its front is almost totally parallel to the E-field, which has a relatively high intensity because of the geometry shown, i.e. path length "Lg" is only a fraction longer than length "L", and the E-field magnitude "E" is given by E=V/Lg, where V is the voltage on conductor 21*a*. Furthermore, as is seen, there is a somewhat focussing of the E-field lines (a crowding of lines 26) at the location of flame front 25*c* to further assist in the formation of a discharge across this front. Thus, it is asserted that if the ignition is repetitively pulsed ON and OFF, say every $\frac{1}{4}$ msec, so that an ON pulsing occurs when the front is at the site represented by 25*c*, a discharge will be formed through front 25*c*. To what extent this is made to happen can be more precisely defined once the flame front plasma and other characteristics are studied, which is advantageously done with reference to the preferred fuel, described with reference to FIGS. 3 to 6, and then, in turn, with reference to the ignition system characteristics. It can then be demonstrated that by proper design and selection of parameters, a highly effective PFDI system can be developed for use in most combustion systems.

Figure 3:
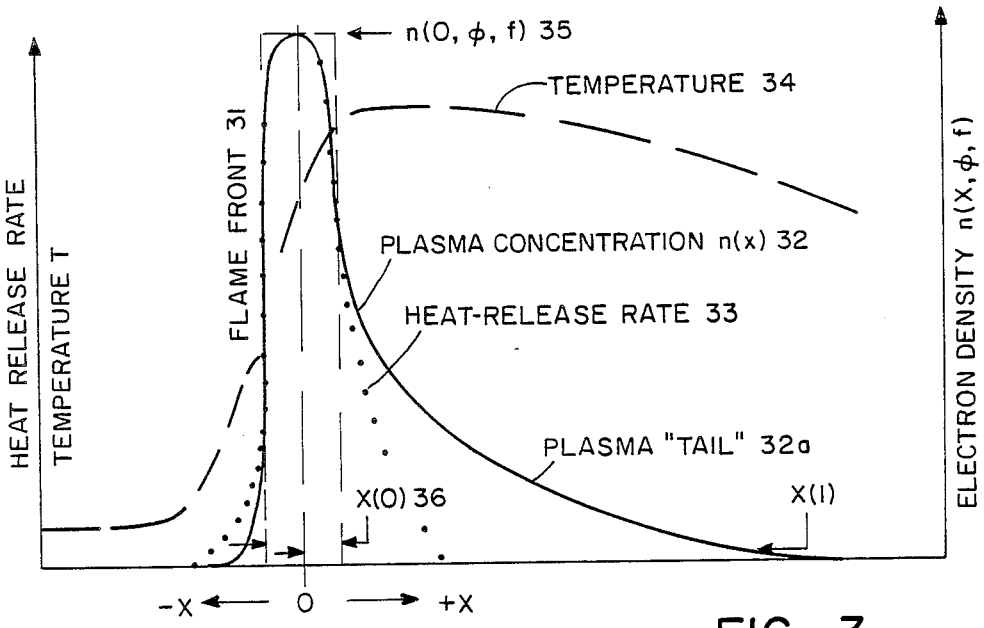
FIG. 3 is a graphical representation of a typical heat-release, plasma density, and temperature spatial distributions across the flame front of a model one dimensional flame.

FIG. 3 depicts the various spatial distributions across a one dimensional hydrocarbon (HC) fuel-air flame front. Shown is the flame front identified by reference numerals 31 defining its front edge, and further defined by the heat release curve 33 (in dotted line), the temperature curve 34 (in dashed line), and the flame plasma concentration curve 32 or density n(x) (in solid line). Flame plasma width 36 (x(0)) corresponds to the width of the reaction zone. What is illustrated here is the "chemi-ionization" nature of the HC fuel-air flame, which dictates that the density concentration curve n(x) will have its front edge coincide with the front edge of the heat release rate curve 33. The back edge of these curves also initially coincide, and then diverge to form a tail 32*a* of the density curve n(x) governed by the electron-ion recombination process to be discussed with reference to FIG. 4. The density function n(x), which is more completely designated as n(x,phi,f), depends in addition on the equivalence fuel-air ratio "phi" of the fuel-air mixture and on the type of HC-fuel "f".

It should be recognized that chemi-ionization is an unusual chemical ionization phenomenon characteristic of all HC fuel-air combustion, which was discovered about three decades ago and was found to depend on the existence of the C-H bond in the fuel. Furthermore, it was found that the peak value of the HC fuel-air flame plasma density n(0,phi,f) (or n(0) for short) is six orders of magnitude greater than the value dictated on thermal grounds, because it is chemically produced. For the present purposes, the flame plasma density is sufficiently high to be of important consideration in the ignition and combustion process. It is claimed here that it is an inherent part of ignition, that when properly viewed and implemented, becomes a key factor to the solution of the Lean Burn problem. It is the missing factor in the Electrical Theory of Ignition. The following can be defined as follows with reference to FIG. 3:

x(1)=a tail width defined as the value at which curve 32a has diminished to some predetermined low value.

N(x1)=

$$\int_0^{x(1)} n(x)dx$$

is the total plasma (electron) count across the flame front.

A flame plasma rating designation, analogous to the octane rating parameter of a fuel, can be defined as the Plasma Rating parameter "PR(f)" of a fuel "f" in terms of a profile factor PF and density factor DF:

$$PR(f)=[\text{Profile Factor } PF]*[\text{Density Factor } DF]$$

$$PF=[2*n(0)*x(0)/N(X1)]$$

$$DF=10*\log[n(0,\text{phi}=0.6,f)],$$

where log means "log to the base 10". It has been tacitly assumed that a typical or standard HC fuel is one with a C/H ratio of 0.5, which has no additives, and which has a profile factor of 1.0, (i.e. as much plasma resides in the flame front as in the tail); and its peak density 35, at an equivalence ratio phi=0.6, or 24 to one gasoline air-fuel ratio (AFR) is 1010, where "" means exponentiation. Thus its plasma rating PR equals 100.

The definition of PR of a fuel is obviously an arbitrary one, but one that permits the making of comparisons among fuels from the perspective of the present invention, and contributes to the characterization of ideal fuels. What the above equation says is that in terms of the profile factor PF, the more plasma that is within the reaction zone 26 (versus the tail) the better, since the purpose is to electrically stimulate the flame front and not the tail (the back part of the flame). In terms of the density factor DF, the higher the peak density (referenced to 10**10) the better, the objective being to preferably have an HC fuel with a PR rating of 100 or greater (referred to hereinafter as an EMT fuel).

Figure 3A:
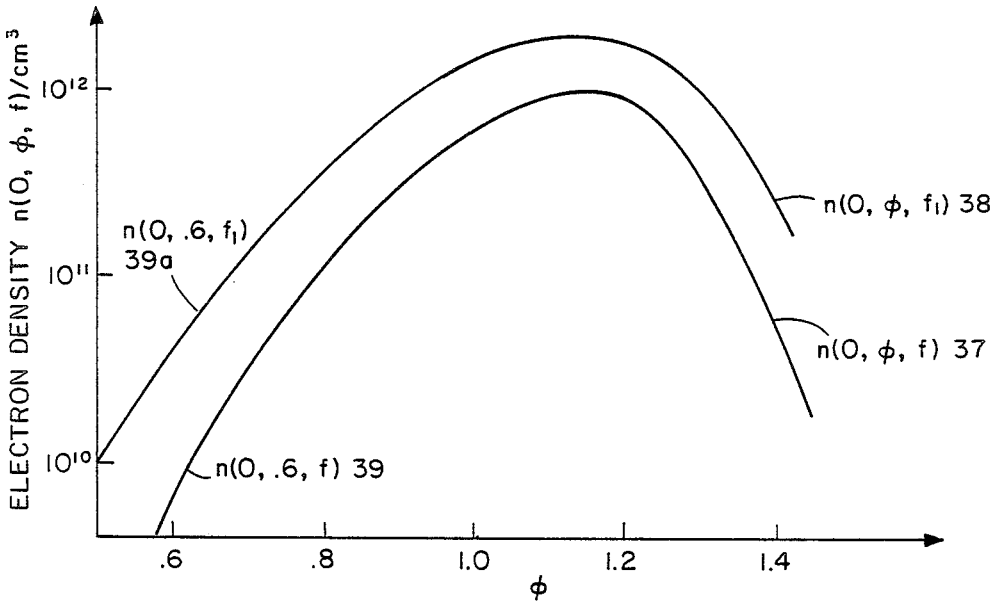
FIG. 3*a* is a graphical representation of flame plasma density distributions n(0,phi,f) versus fuel-air equivalence ratio phi of a standard fuel and a preferred fuel of the present invention.

FIG. 3a depicts the flame plasma density curve 37 as a function of air-fuel ratio phi at atmospheric pressure of a fuel f among several measured, showing the density falling from 1012 at stoichiometry to less than 1010 at phi=0.6 (point 39). As will be apparent, the fuel described by the value of n(0,0.6,f) shown here is of marginal use for the present purpose (representing a PR value of about 96). To improve the fuel property, one either has to be content to work with a higher phi value of say 0.66 (or 22 to one AFR), or one needs to treat the fuel (only slightly if one is content to work within the limit of phi=0.6).

Curve 38 represents an EMT fuel f1, with a "boosted" flame plasma density five times the average, and a PR rating of 106, (i.e. n(0,0.6,f1)=4*1010 as indicated by point 39a**, and the profile factor PF is unchanged at 1.0). The usefulness of such a fuel modification will be discussed with reference to the temporal plasma decay characteristics of the spark, which in the present invention is the characteristics with which the flame plasma competes following the striking of the first ignition spark.

Figure 4:
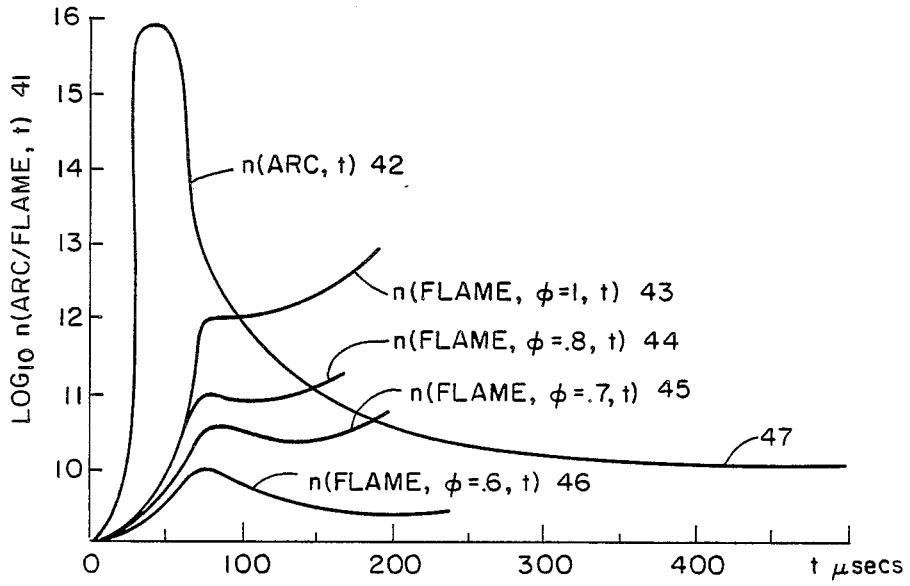
FIG. 4 is a graphical representation of the initial arc density-time distribution of a single initial short duration spark, and the flame density distributions for four equivalence ratio flames started by the spark.

FIG. 4 shows the logarithm of temporal density distribution of a single spark 42 designated as n(arc,t), corresponding to the case of a spark formed by a CDCC system (with an oscillation period of approximately 80 usecs), and the postulated temporal density development of four flame plasmas 43, 44, 45, 46 with equivalence ratios phi of 1.0, 0.8, 0.7, 0.6 respectively. It is assumed that the plasma decay rate of the arc is governed by the following recombination equation, which is a key concept:

$$n(t)=n(0)/[1+n(0)*\text{alpha}*t]$$

where alpha, which increases inversely with the temperature cubed, is taken as 2*10**(−7) cubic cm/sec, corresponding to the value for the temperature of flames and low current (1–10 amp) arcs.

Making a change in variable from t to T, where T is the time expressed in units of 50 usecs, (which is one quarter the typical time between ignition pulses of the CDCC ignition system and much less than the time corresponding to the typical flame speed time scale of one to three msecs), the above equation then becomes:

$$n(T)=n(0)/[1+n(0)*(10^{**}-11)*T]$$

A spark plasma at one atmosphere pressure with an intense capacitive spark component is expected to have an initial arc density of 10**18/cubic cm (cc), so the above equation reduces to:

$$n(T)=(10^{**}11)/T,$$

where T is in 50 usec units of time. Thus on the time scales of interest, a density value of 10**11/cc becomes the density scale, or value with which the flame plasma must compete, which is a key concept of the present invention.

The curves in FIG. 4 show the flame plasma density 43 for a stoichiometric HC-air flame rising to meet the decaying arc plasma density tail 47 in a fraction of the above defined time scale T; and for the moderately lean flame of phi=0.8, the plasma density curve 44 meets the tail 47 in about 1.0 T; and for a very lean flame of phi=0.7 the density curve 45 meets the tail 47 in about 2.0 T; and for the extremely lean flame of phi=0.6 the density curve 46 never reaches the spark tail 47. In a very general way one can infer a relationship between effective spark ignition and the plasma density of the flame, as will be made more precise with reference to FIG. 5.

Figure 5:
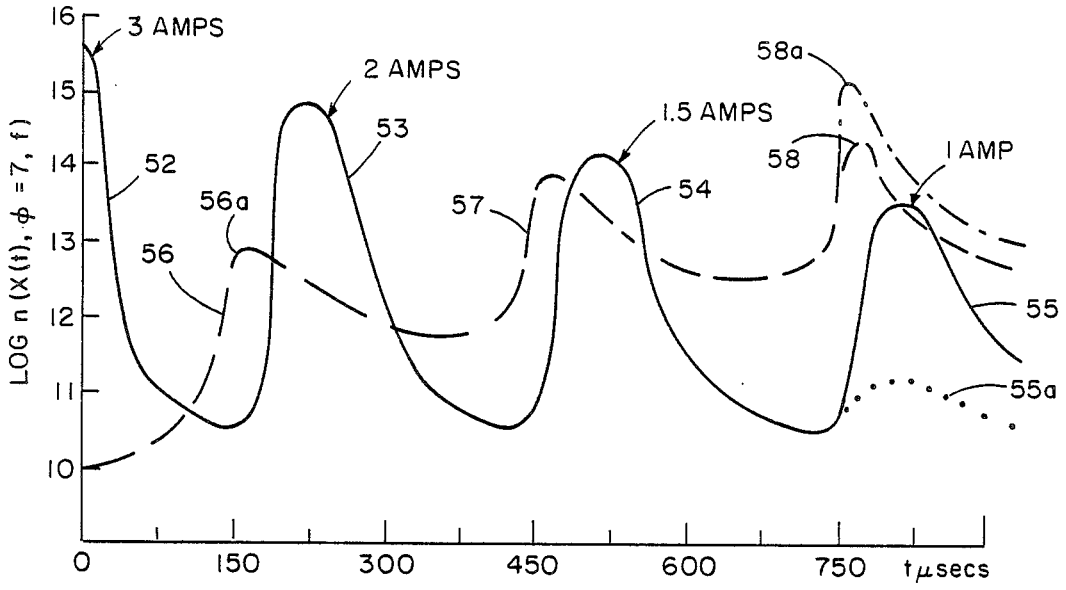
FIG. 5 is a graphical representation of the plasma density profile as a function of time of a multi-sparking arc and ensuing flame plasma in an ignition system of the present invention using an antenna type tip and a very lean flame of the preferred fuel

FIG. 5 depicts the temporal log density distributions of the spark and flame plasma of a multi-pulsing ignition of the CDCC type, pulsed every 300 usec (assuming a spark duration of 80 usec) with an EM Ignition type spark plug of FIG. 1a, in a combustion chamber with a typical HC fuel of phi ratio of 0.7, i.e. a gasoline AFR of 21 to one. The time begins with the end of the first spark showing its decay 52 and the build-up of the flame plasma at 56. The latter occurs as a result of the build-up of the E-field after the end of the sine-wave spark, which couples E-field energy (within the EM Control Volume shown in FIG. 1a). The flame plasma density increases upon retriggering of the ignition to a peak 56a because of the initial high E-field prior to and during the initial stages of the subsequent spark formation 53. The process continues, with the flame plasma growing as shown at curve 57 prior to the next spark 54.

Now if the flame kernel is still within the EM Control Volume during the spark pulsing process, then it can occur that instead of the spark plasma 55 and flame plasma 58, a discharge can take place across the flame front producing a much lower spark plasma 55*a* (at the previous spark site) and a much higher "spark" flame plasma density 58*a*. This process can be enhanced if the the fuel is modified to provide a high fuel-air flame plasma rating (PR); or if the plug tip is redesigned along principles which were discussed with reference to FIG. 2*d*. Thus, even with a standard unmodified HC fuel, by carefully designing the system (to a PDFI system of FIG. 2*d*) one can produce the "flame ignition" effect shown by curve 58*a*, delivering up to hundreds of watts to the flame front, greatly stimulating the flame.

Figure 6:
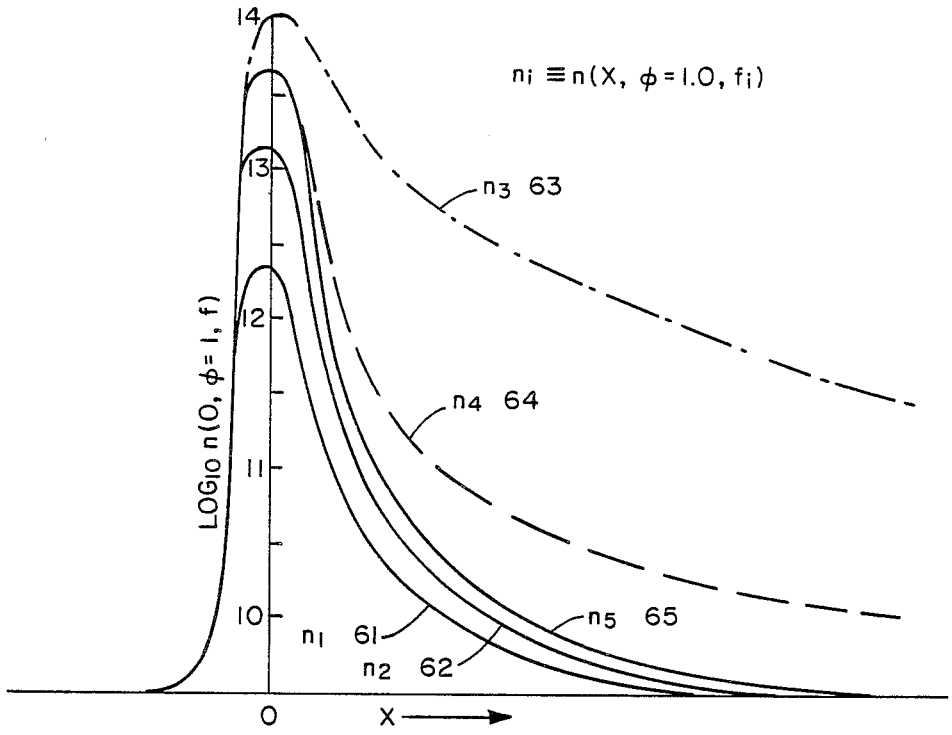
FIG. 6 is a graphical representation of the density distributions n(x,phi=1,f) as a function of the flame position for a range of fuels treated according to the present invention referenced to a standard fuel.

FIG. 6 depicts the spatial plasma density profiles of a standard HC flame 61 and others achievable by modifying the fuel. The simplest and most useful modification is to increase the C/H ratio of the fuel to as close to one as practical since the flame plasma density of the fuel is known to be maximum at a C/H ratio of one since chemi-ionization is based on reactions involving the C-H bond, which is maximum for the aromatic fuel family (benzene derivatives), which have the general formula CnH2n-6.

As a specific example of an EMT fuel which can be currently made, an inexpensive low octane fuel is taken with typically 0.45 C/H ratio (representing a fuel with on the average 8 Carbon atoms to 18 Hydrogen atoms), and there is added approximately 20% of an aromatic methyl benzene (with very high octane) with formula C7H8, and there is obtained a fuel with a C/H ratio just greater than 0.5 (and with a very high octane), which would classify as an EMT fuel useful for high compression ratio, lean burn engines.

Curve 62 represents an expected density profile n2 for a fuel with a C/H ratio close to unity and is an excellent EMT fuel with a PR rating around 108. Curve 63 is a density profile of a flame seeded with a low ionization potential alkali metal such as Cesium or Potassium, in amounts of several parts per million (or p.p.m.). While the peak ionization is very high (leading to otherwise a PR rating of about 120) the tail is so large because of the very low recombination coefficient, that the PR rating is an unacceptable value below 50. On the other hand Lithium and Sodium have a recombination coefficient ten time greater than Cesium and Potassium, so that (in the form of trace amounts of their salts or organic compounds in the fuel) they will produce a curve such as 64 with density profile n4 and a PR rating of between 60 and 100. With some further tailoring in terms of using some aromatics (which incidently also boosts Octane Rating) and using only trace amounts (of order one p.p.m. or less) of the compounds of metals selected from the group of the alkali metals Lithium and Sodium, and the alkaline earth metal Calcium, one can achieve a PR rating of 116 as in curve 65 of density n5. The latter PR value is very high, and represents an ideal EMT fuel for use in burning extremely lean mixtures with the systems of the present invention.

With this understanding of the fuel (flame plasma) aspects of the present invention, an analysis is now performed with respect to the PFDI system to integrate the remaining parts of the system. To begin with, relationships for the tangential component Et and normal component En are developed in terms of the electric field Es, assuming that the side surfaces of the insulating layer 28 of of the plug tip of FIG. 2*d* (with which the PFDI system is defined and will be referred to in the discussion that follows) are substantially parallel to the axis of wire 21, and where:

Ne=the electron density expressed in units of 10**12/cc;

Wp=the plasma frequency expressed in units of 10**9;

Nu=the electron-neutral collision frequency, which can be taken as 3*10**11 at one atmosphere;

f=the operating frequency;

Kr=the imaginary part (lossy part) of the generalized, complex, relative dielectric constant;

Then:

$$Kr=\sqrt{[(Wp^{**}2)/W^{*}Nu]}$$

$$Wp=2^{*}pi^{*}9^{*}\sqrt{[Ne]};\ W=2^{*}pi^{*}f$$

$$Et=Es$$

$$En=Es/Kr,\ \text{since } Kr^{**}2 \text{ is very large in the present cases.}$$

It is useful to consider the practical case where:

$$f=100\ KHz;\ Ne=3^{*}10^{**}10\ \text{electrons/cc};$$

which gives $$Kr=10;\ En=Es/10,$$

or a normal component of electric field En one tenth that of the tangential component Et. Based on the earlier equation for the decay of the spark plasma:

$$n(T)=(10^{**}11)/T,$$

it is noted that the value of n(T) corresponding to Ne=3*10**10 is 3.3*T or 165 usecs. From FIG. 3*a*, this value of Ne is seen to correspond to an AFR of 21:1 for a standard HC fuel. From these values it can be inferred that, neglecting the E-field strength and direction for now, the spark is equally likely to form at the old spark site as at the flame front if the ignition is refired after a delay of 165 usecs from the end of the previous spark, in an air-fuel mixture of ratio 21:1 (equivalence ratio phi=0.7).

In actual fact it may be necessary to ignite even leaner air-fuel mixtures of approximately 24:1 AFR (phi=0.6), where for other than an ideal EMT fuel not currently available, the flame plasma density is significantly lower than the spark density after 165 usecs. But what has been described above in terms of the E-field components permits this to happen, because the flame can, in principle, have a field of the order of ten times greater coupled to its front than is coupled to the spark remnant.

The situation is not quite as favorable as indicated above, because the above analysis is somewhat of an over simplification. The spark remnant has a very high field (the one initiating the spark) applied at the (spark initiating) gap 30*a*, which will tend to produce local ionization, and twist the E-field in favor of the spark remnant, producing a larger effective field along the major length of the spark remnant than is inferred from En (which requires gap g1 be kept as large as practical within other constraints, namely the electrical breakdown constraints). Also, the spark will have some Et component along its main length, which while small relative to Es, is significant. These factors imply that the field En in the spark remnant must be adjusted (raised) by a factor which ultimately is experimentally determined, and which for the present purposes is estimated at five (in the range of three to eight), modidying En to En1:

$$En1 = En/k = Es/k*Kr$$

where 1/k=5 (or 3 to 8)

With reference to FIG. 2*d*, the geometry of the tip is seen to provide a length Lg (corresponding to the most favorable flame front site 25*c*) approximately equal to the length of the spark core 24*a*, implying that the ratio of the field strength in the flame front versus the core is given by:

$$Es/En = k*Kr$$

In turn, the conservative assumption can be made that an ignition pulse occurring t usecs after the last spark will form at the initial flame front or spark remnant, depending on whether the above ratio multiplied by the corresponding square root of the plasma density ratio is greater or less than unity (assuming power absorption controls the discharge of the electrical energy). The ratio, designated as FSR for flame/spark ratio, is given by:

$$FSR = [k*Kr]*\sqrt{[n(flame,phi,t)/n(arc,t)]}$$

where the above density designations are given in FIG. 4. To first order, the flame density can be taken as a constant (for a given equivalence ratio) and the expression for the spark decay substituted to give:

$$FSR = [k*Kr]*\sqrt{[n(0,phi,f)*T]}$$

where n(0,phi,f) is expressed in units of 1011. For example, for: k=0.2, Kr=10, T=4 (200 usecs), n(0,0.6,f)=0.1 (in units of 1011), $$FSR = [0.2*10]*\sqrt{[0.1*4]} = 2*0.63 = 1.3$$

implying that the spark is 30% more likely to form at the flame site than at the previous spark site under these conditions.

Clearly, the above expression is not an exact theory, and must eventually be tailored on the basis of experimentation, but serves as a very useful and important guide in providing direction for the (PFDI) system design of the present invention.

Finally, the location of the flame 165 usecs after the spark must be considered (following the procedure that was carried out earlier with reference to flame fronts 25*a*, 25*b*, 25*c* of FIG. 2*d*). The spark of the CDCC system itself, with its typical initial 2 to 3 amp peak current and, say, two initial full sine-wave oscillations, will tend to bloom outward as the plume 24*b* and move the first flame front to a more favorable site 25*a*, while the flame speed Vf, cited as 1.6 mm/msec, will taken on a higher value in an engine as a result of of air-flow induced by the piston motion. That is, assuming a piston stroke of 8 cms, at an engine speed of 600 RPM, the average piston velocity is equal to the above quoted flame speed of 1.6 mm/msec (and to the piston speed at 45 degrees BTDC, corresponding to a typical advanced ignition timing for lean mixture engine operation). Thus, we can take the initial engine flame speed VEfi to increase approximately proportional to engine speed S plus one, or more conservatively S (in units of 600 RPM):

$$VEfi = C1*S*Vf$$

where C1 is between 0 and 1, and represents the component of the piston induced fluid motion along the flame direction.

This implies that the flame positions represented by 25*b*, 25*c* correspond to the second spark pulse at 1800 RPM and 3600 RPM respectively (for a typical value of C1 of ½). Therefore, at 1800 RPM the third ignition pulse is the one most likely to form a discharge across the flame front (for the conditions which we have been discussing), and at 3600 RPM it is the second pulse. Under conditions of highly turbulent flows or intense squish or swirl at the spark plug site, the speed VEfi can clearly be higher since these flows can impart a velocity in the direction of motion of the flame front greater than the piston velocity, making for a value of C1 greater than one.

It is to be noted that the above expression for FSR assumes the restriking of the spark at a time when the flame front is at a favorable position defined by having its front mainly parallel to the E-field near the spark plug tip upon the ignition refiring. From the above discussion clearly the flame motion can be explicitely included in the expression for FSR through a multiplicative factor on the right hand side of the equation of the form:

$$1/[1+C2/(S*T)]$$

where C2 is a constant in the range of one to five.

Finally, the critical assumption made regarding the value of the spark plasma recombination coefficient "alpha" must now be reassessed in the light of the information developed. The value of alpha was assumed to correspond to about 2000 degrees C., the peak flame front temperature. It is postulated for the ignition strategy proposed here that this is a good assumption.

For the glow discharge, the temperature of the neutral and ion species are close to the gas temperature. As the transition is made to the arc discharge, the ion temperature rises, taking on values from 1,000 to 10,000 degrees C. at currents in the range of 1 amp to 1,000 amps. It is evident in terms of maintaining a maximum value of the (spark related) recombination coefficient alpha, that preferably the peak arc currents be kept low. But for the CDCC ignition (of the PFDI system under discussion) this is the case, with the main spark energy being delivered within the current range of 1 to 3 amps.

Therefore, all that remains is to insure that the high peak capacitive currents, which would ordinarily be maximized to optimize the igniting ability of the initial spark kernel, be kept to values in the 10–200 amps range, which is done as will be seen with reference to FIGS. 7 and 8 (rather than at 1000 amps quoted by others). This implies that since the predominant temperature in the plug tip vicinity is the flame temperature, which is of a similar value to the arc current temperature of a low current arc, and since the PFDI effect typically will occur several hundred microseconds after the initial peak capacitive current (giving the initial capacitive spark channel time to cool), then it is an appropriate assumption to choose the value of alpha as was done.

Factors which enhance the formation of the discharge across the flame front to optimize the PFDI effect are summarized below:

(1) raising the PR rating of a hydrocarbon fuel to about 100 or above (so that it becomes a good EMT fuel);

(2) increasing the fluid dynamical coefficient C1 somewhat so that greater velocity is imparted to the initial flame front (without impeding its motion around the plug) by the introduction of swirl, squish, or preferably microscale turbulence at the spark plug site;

(3) increasing C1 by having the axis of the spark plug form a significant angle to the axis of motion of the piston (so that a significant component of the piston induced fluid motion appears in the direction normal to the initial flame front);

(4) minimizing the diameter of the plug tip protruding from the plug shell, so that the PDFI effect is relatively insensitive to the location around the periphery of the plug where the initial spark is formed relative to the plug's location in the combustion chamber and in the fluid flow field of the air-fuel mixture;

(5) using asymmetrical lobes (see FIG. 2*a*), e.g. on one side only of the spark initiating gap, and orienting the plug so that the spark is formed in the most favorable orientation with respect to formation of PFDI effect;

(6) designing the high voltage ignition circuit to provide moderately high initial capacitive current to insure ignition while minimizing the size of the spark remnant it leaves;

(7) increasing the time between pulses to 4T or 5T (200 or 250 usecs) for low to moderate engine RPM to both give the flame front more time to move to a more favorable position and to reduce the spark remnant density, although this is of limited use since in turn it reduces the average power delivery to the spark plug end;

(8) reducing the frequency f (which increases Kr and reduces En1) by using a high output capacitance of say 250 pfd (say 100 pfd in the coil, 100 pfd in the boot, and 50 pfd in the plug) which reduces f from the above assumed value of 100 KHz to 50 KHz or less;

(9) designing the spark plug tip as shown particularly in FIGS. 2*d* and 7, and adjusting parameters to further reduce coupling to the spark remnant and increasing coupling to the flame front plasma.

FIGS. 7 and 8 depict designs of actual plugs and a practical capacitive boot for optimally achieving the effects mentioned, and substantially include the plug tip designs of FIGS. 2 and 2*d*, where once again like numerals denote like parts. The tips of the plugs of FIGS. 7 and 8 have been arbitrarily chosen to correspond to tips of FIGS. 2*d* and 2 respectively. The plug shown in FIG. 7 is a detailed drawing of an example of a plug usable in FIG. 8, excepting for the center electrode structure, which is designed for minimizing electrical resistance and maximizing electrical capacitance and heat transfer.

The preferred embodiment of FIG. 7, which is based on a 14 mm standard plug, includes central or axial wire made up of an upper portion 71*b* of large diameter 0.25" terminating in connector 74, intermediate series portions 71*a* of large diameter 0.32" and 71 of diameter 0.15", and lower portion 21 of small diameter 0.09" terminating in 0.32" diameter button 21*a*. Diameter of portion 21 is made small to allow for better PFDI effect (to provide small overall diameter of the plug tip), although not as small so as to seriously limit the high amplitude, high frequency (MHz range) capacitive current. Upper portions 71/71*a* (and 71*b*) are of large diameter to provide low resistance to the capacitive current and maximum plug capacitance defined with respect to insulating layers 78/78*a* surrounding portions 71/71*a* respectively, which in turn are surrounded by plug shell conducting portions 23/73 respectively. Small diameter wire 21 is preferably made of copper to reduce its electrical resistance as much as practical and provide good heat transfer capability for cooling button 21*a*, which is preferably made of highly erosion resistant material such as Nickel alloy. Wires 71, 71*a*, 71*b* can be made of other metals, preferably copper plated to provide low resistance to the capacitive current.

Also (as described in connection with FIG. 2) at least a portion of the cylindrical periphery of button 21*a* forms conical frustrum 29*a* at an approximately 45 degree angle to the axis of wire 21, for focussing the E-field onto the shell end 23*a* (and cylinder head surface 22*a*) as discussed with reference to FIG. 2*d*. Thus, as previously discussed, toroidal gap 30 is created between frustrum 29*a* and shell end 23*a* (and cylinder surface 22*a* shown with reference to FIG. 8) along whose periphery flame discharges can occur as part of the PFDI system to ignite the entire toroidal gap during the ignition ON period.

A preferable dimensioning of the end section based on a 14 mm plug is shown with shell ID 23*b* taken as 0.38" along major part of 14 mm threaded, OD of tip firing end of insulator 28 taken as 0.25", and shell end interior diameter 23*c* taken as 0.32" (providing gap size g1 equal to 0.035 inches). These dimensions, taken with others shown, provide thicknesses of insulators the 78 and 78*a* of 0.11" to 0.12" for sufficient hold-off voltage and maximum capacitance of the plug, which can be further raised by increasing the length of the insulator section 78*a* sandwiched between center conductor 71*a* and shell 73 from the approximate value of ½ inch shown in approximately 1 inch, and also by using an insulating ceramic material of higher dielectric constant. Length L of insulator protrusion beyond shell end 23*a*, which is set between 0.12" to 0.24" for the PFDI system (and half that for the ECDI system), is shown as 0.16" (corresponding to the PFDI case).

With regard to the above dimensions, it is emphasized that they are chosen to conform to an overall spark plug size suitable to existing engines, where the spark plug "well" diameter may be only ⅞ inch. Clearly most of the dimensions can be sized up or down as long as the principles introduced herein are adhered to.

With regard to the sizes quoted herein, they are taken generally as plus or minus 10%, and where the term "approximate" and "about" are used preceding the size dimension, they are taken to imply larger ranges; for example "approximately" may mean plus or minus 25%, and "about" may mean plus or minus 50%. The term "of the order of (magnitude of)" has the ususal meaning of within a factor of ten either side of the number quoted.

Spark plug insulator 78/78*a*/78*b* preferably has its seat at the bottom end region 80 of the largest diameter section 73 of the plug shell, and not in the base junction 76 where insulator section 78 first communicates with the combustion chamber, which must be free of sharp points as to not cause local ionization from high voltage, leading to eventual damage of the spark plug. Junction volume 76 is used in part to prevent insulator tracking, and in part (in this application) to diffuse the electrical shorting out effect of the flame front as it moves up the junction.

Top insulator portion 78b has preferably an OD of approximately ½ inch to conform to the ID of boot insulator 90 of FIG. 8, which has preferably a inside diameter 2d of ½ inch. The large diameter is also chosen to provide a maximum capacitance in the plug itself as defined by the layers 73/78a/71a, as already mentioned. Insulator 78b also provides clearance (0.045" shown) to inner conductor 71b to accommodate sealing cement 75. Shell region 73 accommodates preferably ¾" hex, and a threaded section 72 with preferably 13/16-20 UNEF thread for use with the capacitive boot 90 to form ground contact of outer metallic tube 86 of the capacitive boot.

FIG. 8 depicts a minor variant (a simplification) of the plug of FIG. 7 in which center conductor sections 21/71 of FIG. 7 are combined into one section 21b, and sections 71a/71b (FIG. 7) are combined into one section 71c, and on which is mounted a novel capacitive boot 90. The boot is formed of elongated insulator tube 85, one end of which is seated in contact with and extends from the upper end of metallic cylinder 84 forming essentially a hollow extension of conductor 71c. Connected to the upper end of cylinder 84 is spark plug wire 87 with preferably EMI suppressing inductive winding 87a formed as a helix of low resistance wire, preferably wound around a core of magnetic material preferably loaded with resistive material which begins to absorb at the very high frequency end of the spectrum where EMI is a problem, i.e. above 30 MHz. Wire 87 is connected to end 84 preferably by means of a crimp (representing a unitary section whose distributor end of spark plug wire 87 is slid into insulator tube 85 from its bottom end prior to distributor end of wire 87 having its distributor boot installed).

In the preferred embodiment, the outside diameters of cylinder 84 and upper portion 78b of spark plug insulator are the same, e.g. ½ inch, and the resistance is preferably equal to or less than one ohm/foot resistance from the PFDI system and of the order of 10 ohms/foot for the ECDI system.

The spark plug boot is formed of elongated insulator tube 85, one end of which is seated in contact with and extends from the upper end of portion 72 of shell 73. The internal diameter of the insulator tube 85 is dimensioned to provide a snug sliding fit over both the insulator portion 78b and the tube 84. Upper end of tube 85 is provided with a top section 90a preferably approximately ½ inches long, which forms shoulder 90b to which top end 86b of outer metallic tube section 86 seats, where end 86b is of greater thickness to reduce the field intensity at its top extremity and to form a crimp there to hold metallic tube 86 in place. Metallic tube 86 surrounds cylinder 85 for its entire length except for section 90a, bottom end of tube 86 being preferably threaded to screw onto threaded portion 72 of spark plug shell.

The relative dielectric constant of the material of which insulator tube 85 is formed is preferably in the range of 6 to 30 to provide a capacitance in the range of 50 to 200 picofarads. The insulator material preferably has a low loss factor in the 10 to 100 MHz range, a breakdown voltage greater than 300 volt/mil, and an operating temperature of at least 300 degrees F. Thickness "tb" of the insulator (85) is preferably approximately ⅛ inch. Minimum diameter 2d' which captures top end of tube 84 is somewhat less than major interior diameter 2d.

The equivalent circuit of FIG. 8 is shown in FIG. 8a, where like numerals again denote like parts. Central to the schematic of FIG. 8a is wire 71c one end of which is connected to plug tip 21a separated by gap 30 from shell 23a. Wire 71c is connected through capacitance 79 to ground and through inductor 87a to terminal 77 to a source of high voltage (secondary of an ignition coil), across which the coil output capacitance 9 is connected. Capacitance 79 is formed in the embodiment of FIG. 8 by plug shell 73 and metallic tube 86 which form the outer plate of a coaxial capacitor, metallic cylinder 84 (and conductor 71c to a lesser extent) which forms the inner plate, and insulator tube 85 which provides the necessary high dielectric constant between the capacitor plates. Upon breakdown of gap 30, capacitor 79 discharges its energy very rapidly (in about one usec) through the ionized gap as moderately high magnitude currents of 50 and 400 amps at 20 to 50 MHz range frequencies, while inductor 87a provides very high impedance to the parallel path for discharging capacitor 79. Preferably, inductance of wire 87a is of the order of 50 uH/foot, serving the second function of (while minimizing EMI) presenting a very low resistance, "low" (from the EMI perspective) frequency tuned circuit with the output capacitance 9 (which typically will have a capacitance in the range of 20 to 100 pfd). Thus capacitor 9 will discharge its energy in the low (non-EMI producing) 1 to 5 MHz frequency range providing to the spark in gap 30 peak current of the order of 10 amps lasting for several usecs, and thus providing useful igniting energy to the initial spark without unduly raising the spark channel temperature (as previously discussed with reference to the spark recombination coefficient alpha.

Finally, it may be further advantageous from the EMI and the recombination coefficient (alpha) perspectives to "tune down" the discharge of the capacitive energy stored in the plug boot, which can be advantageously done by replacing large diameter central plug conductor 71c with a coil (shown in FIG. 10) of, say, inductance of 4 uHenry, which with a 100 pfd capacitance boot, will produce relatively lower frequency oscillations of approximately 10 MHz with peak currents in the range of 20 to 100 amps.

Figure 9A:
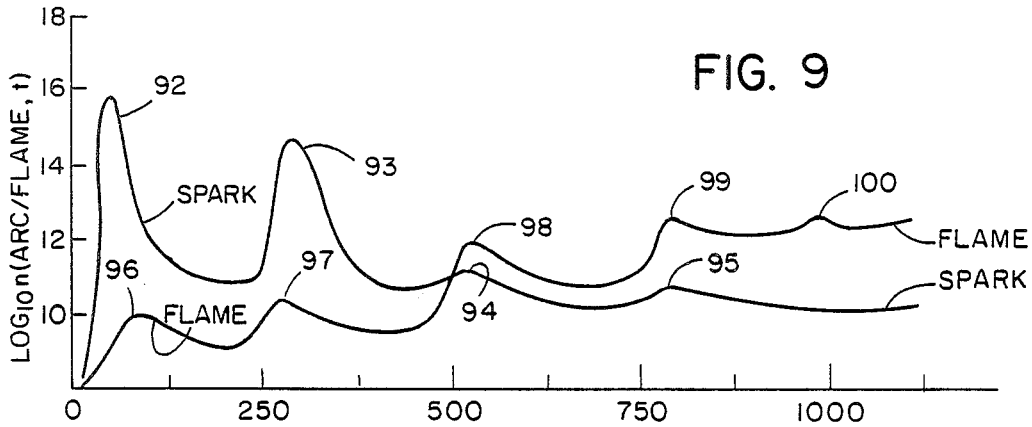
FIGS. 9*ab* to 9*af* inclusive shows a sequence of partial sectional views of a PFDI spark plug tip of FIG. 2*d* showing the magnitude and position of the spark and flame plasmas (relative to the electric field direction) as a function of time with each successive ignition firing.
Figure 9A:
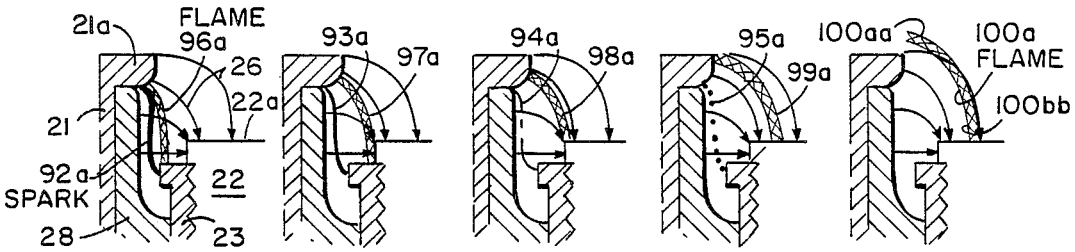

FIG. 9 depicts spark and flame plasma density distributions of a preferred ignition pulsing sequence (of the CDCC ignition) of the PFDI system using, for example, the plug tip structure of FIG. 2d or 7, and more particularly that of FIG. 2d, shown in FIG. 9a below. Shown are ignition sparks of period of about 100 usecs, and a time between pulses of (the minimum of) approximately 150 usec. The shapes 92, 93. 94, 95 are the spark density distributions on a logarithmic scale, and the shapes 96, 97, 98, 99, and 100 represent the corresponding flame plasma density distributions of a very lean flame (phi=0.6) of an existing gasoline fuel with a good PR rating, for example, a high octane unleaded fuel using aromatics to boost the octane. Of interest is the gradual build-up of flame plasma density on the first two pulses 96, 97 although most the energy is delivered to the spark as evidenced by the peaked shapes 92, 93. On the third pulse, the first "arcing" of the flame front plasma occurs, producing a density distribution at the peaked shaped 98 with a higher peak level than the spark remnant pulsed plasma peaked shape 94, since the flame is now in a position where the E-field strongly couples to its front. Thereafter, energy continues to be coupled to the flame front, producing further successive peaked shapes 90, 100, and the flame is launched, while the the spark remnant decays to a small last tiny peak 95 and then continues to decay.

FIG. 9*a* depicts five partial cross-sectional views of the spark plug tip of FIG. 2*d* (as an example of a preferred structure of the PFDI system) able to produce the density-time shapes shown in FIG. 9 through electrical action of the five ignition pulses delivering energy to the plug tip. The drawings represent the same plug tip viewed at 250 usecs intervals with like numerals denoting like parts with respect to FIG. 2*d*. Shown are the center conductor 21, a preferred button 21*a*, tip insulator 28, spark plug shell 23 (somewhat recessed from the surface 22*a* of cylinder head 22), and (four of) the electric field lines represented by 26. Each view represents an ignition pulsing at a time where the ignition energy (current) is maximum (at a peak of either of the two half sine-wave curves).

Moving left to right, FIG. 9*ab* shows the initial spark 92*a* and flame front 96*a* with mainly perpendicular E-field components; followed 250 usecs later by FIG. 9*ac* showing a weaker spark 93*a* (thin line) at the same location and flame front 97*a* with a partially parallel E-field component; followed 250 usecs later by FIG. 9*ad* showing a greatly diminished spark 94*a* (dashed line) and flame front 98*a* mainly parallel to the E-field and absorbing most of the energy (conducting most of the "spark" current); followed 250 usecs later by FIG. 9*ae* showing a further diminished spark 95*a* (dotted line) and a now larger flame front 99*a* parallel to the E-field; followed finally 250 usecs later by FIG. 9*af* showing the absence of the remnant of the initial spark 92*a* and a flame front 100*a*, moving away and growing in size, with its upper part 100*aa* moving outside the influence of the E-field and its lower portion 100*bb* growing sideways; that is, following the fourth pulsing (after 750 usecs), flame front 99*a* preferably will move sideways along the periphery of the circular edge of the plug/cylinder interface where the E-field coupling is strongest, forming flame discharges along the periphery, igniting the entire toroidal gap.

Figure 9B:
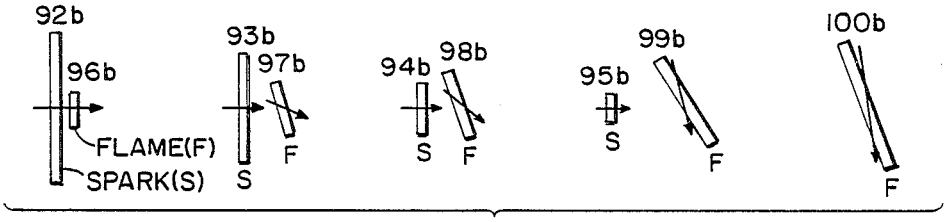
FIG. 9*b* is a graphical representation of the relative magnitude and direction of the spark and flame front plasma as a function of time with each successive ignition firing (represented by FIGS. 9, 9*a*, of a system exemplified by FIG. 10) with the direction of the average electric field superimposed on each front.

FIG. 9*b* depicts schematically in the form of bars the spark and flame plasma intensities and their average orientation referenced to FIG. 9*a*, and located to coincide in a vertical perspective with their position shown in FIG. 9*a*, on the same time basis defined in FIG. 9. The direction of the E-field relative to the spark and flame front is shown as an arrow drawn through the bars (representing an average relative direction). It is seen that the spark gradually decays from position 92*b* to 93*b* to 94*b* (with the E-field always normal to its front) while the flame plasma slowly grows from position 96*b* through position 98*b* with the E-field becoming progressively parallel, as shown and described in FIG. 9*a*. The flame plasma begins to dominate at position 98*b* over the spark at position 94*b*, and even more so at position 99*b* (over the spark at position 95*b*). Thereafter the spark at the original spark plug site (92*a* of FIG. 9*a*) disappears altogether and the flame plasma at position 100*b* intensifies with a strong E-field parallel to it and forms new fronts along the plug periphery as discussed above.

Figure 10:
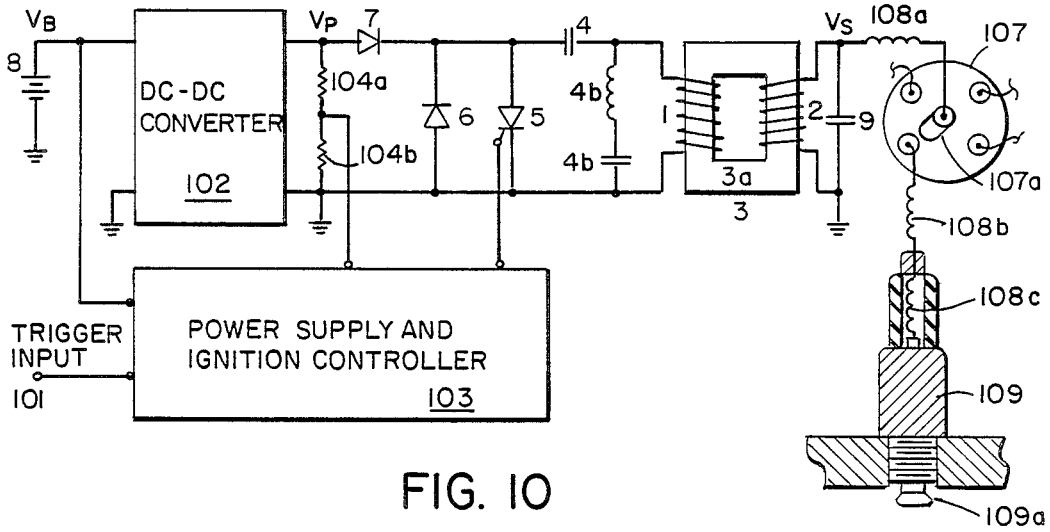
FIG. 10 is an idealized view, partially in block diagram and partially schematic, of a preferred embodiment of the complete PFDI system of the present invention suitable for use in a multi-cylinder internal combustion engine, including a capacitive discharge circuit with EM interference suppressing circuitry and cables.

FIG. 10 depicts a preferred circuit of the CDCC type comprising a high efficiency (preferably 70%–80%) DC-DC converter 102 intended to be connected to battery 8 of voltage VB, typically of 12 or 24 volts. One output terminal from DC-DC converter 102 is grounded, the other being connected to the anode of diode 7. The circuit is controlled to produce an ignition pulse train upon receipt of a trigger at input terminal 101 of power supply and controller 103 (connected to battery 8 to be powered thereby) which also regulates the output voltage by being connected to the junction of series divider resistors 104*a*, 104*b* connected across the output terminals of converter 102. Isolation power supply diode 7 has its cathode connected to cathode of diode 6 whose anode is connected to ground. Capacitor 4, SCR 5, diode 6, and primary winding 1 of special CDCC coil 3 comprise a capacitive discharge (CD) circuit in which SCR 5 is connected across diode 6 and the gate of the SCR is connected to output of controller 103. Capacitor 4 is connected to between cathode of diode 7 and high side of primary winding 1 of transformer 3, the other side of the primary winding being grounded. The transformer (coil) 3 has a closed ferrite core 3*a* with secondary winding 2 and capacitance 9.

Connected across primary winding 1 is active snubbing network formed of series-connected capacitor 4*a* and inductor 4*b*. High or hot side of secondary winding 2 of transformer 3 is connected to input of conventional distributor 107 via King lead 108*a* which, like spark plug wire 108*b* (or 87 of FIG. 8), is a low resistance, highly inductive wire. The output of the distributor is connected to spark plug 109 which may be of any of the types disclosed hereinbefore, including the further modification shown where inductor 108*c* is added to tune down the discharge of the boot capacitance (not shown) already mentioned. Such modification is further useful in the embodiment shown where a moderate capacitance of, say, approximately 40 pfd is built into the plug to produce moderately intense but low energy capacitive spark for ignition, with inductor 108*c* forming a continuous inductor with 108*b* to limit EMI. Capacitive boot (of the type 90 disclosed in FIG. 8) may be omitted if sufficient capacitance is built into the spark plug.

In operation (say of the PFDI system), a trigger pulse is received at terminal 101 and the subsequent output from controller 103 turns SCR 5 "ON", placing a high voltage Vs between the distributor rotor 107*a* and a point therein. The rotor tip gap is preferably as small as is practical, e.g. 1/64" and the rotor tip is preferably made of erosion resistant material such as Nickel. The output voltage at the distributor rises and breaks down the gap at the tip of rotor 107*a* and at the plug end 109*a*. Preferably the capacitor 4 is charged to a voltage Vp of 350 volts and has a value of approximately 8 microfarad (ufd). The leakage inductance, Lpe, of primary winding 1, is approximately 20 microhenries (uH) to give an oscillation period of 80 usecs (dictated by the recovery period of SCR 5). Snubber capacitor 4*a* is approximately 4% the value of capacitor 4, and inductor 4*b* takes on a value from zero (no inductance) up to approximately the value of Lpe.

Thus, upon breakdown, primary and secondary spark currents oscillate with an 80 usec period, with the spark current having an initial maximum current of two to three amps for an assumed turns ratio N of transformer 3 between 45 and 50. At the end of the oscillation period (assuming SCR 5 has recovered and is not retriggered), capacitor 4*a* delivers its energy to the spark as a continuously ringing, decaying oscillating with a period of 15 to 30 usecs and a peak current of 1/10 to 1/5 of the main 80 usec oscillation peak, or typically 200–300 ma of initial peak current, thus producing strong (ECDI) E-field enhancement effects. The snubbing network also serves to protect SCR 5. PFDI effect is achieved when SCR 5 is trigerred in a sequence every, say, 240 usecs (for a duration of one to three msecs) and some ECDI effect is also achieved by the discharge of energy from capacitory 4*a*, especially when the spark gap length "L" is kept at a minimum value for the PFDI system of approximately 0.12 inches.

Preferably controller 103 senses the engine RPM and adjusts not just the ignition pulse train width as disclosed in U.S. patent application Ser. No. 688,036, now U.S. Pat. No. 4,688,538 (reducing the width with RPM), but also adjusts the period between firings so that it is reduced with RPM, from say 400 usecs for up to 1500 RPM, to say 300 usecs at 3000 RPM, to say 200 usecs at 4500 RPM and higher. A preferred way to accomplish this is to use a voltage tunable oscillator adjusted so that the period between firings increases from an initial value of say 200 usecs to 400 usecs in say 3 msecs, and the pulse train width varies from 3 msecs at 1500 RPM, to 2 msecs to 300 RPM, to 1 msec at 4,500 RPM, providing an average pulse width falling with RPM as desired. Alternatively, the time between pulses may be increased with some proportion to the pulse width.

The advantage of the variable (longer) ignition period at lower engine speeds is that the flame is given time to ignite the entire toroidal gap while still influenced by the ignition, i.e. multiple flame discharges of the PFDI system can be formed around the plug periphery (within the toroidal gap 30) as the flame burns its way around, especially at the low speeds where the air motion is small and the mixture is more diffiucult to ignite.

The total CD system efficiency EFF can be assessed as follows:

$$EFF = Parc/[Parc + Pscr + Protor]$$

where:

Parc = power delivered to the spark (plug end 109*a*);
Pscr = power dissipated to SCR 5 (and diode 6);
Pcoil = power dissipated in transformer 3;
Protor = power dissipated in the rotor gap in the distributor.

Neglecting Pcoil, which can be held to 10% of Parc, the above reduces to:

$$EFF = Varc/[Varc + Vrotor + NVscr]$$

where:

Varc = average plug tip arc burning voltage;
Vrotor = average rotor tip arc burning voltage;
Vscr = average forward voltage drop of the SCR during the current conduction stage;
N = coil turns ratio.

For the typical preferred PFDI system:

$$EFF = 240/[240 + 40 + 1.6*50] = 240/360,$$

$$EFF = 67\%,$$

which is an extremely high efficiency considering power is being delivered at a rate of several hundred watts to the plug end (ten times greater than standard ignition).

Especially noteworthy is the advantage of the lower than standard turns ratio N (fifty versus one hundred), and the much larger voltage Varc versus Vrotor brought about by the large gap (which increases Varc), and the largely normal E-field component (En) to the spark, which further increases Varc over Vrotor and N*Vscr in the early stages of the current formation. For the typical preferred ECDI system:

$$EFF = 800/[800 + 350 + 1.0*50] = 800/1200$$

$$EFF = 67\%,$$

which is about five times higher than the efficiency of standard ignitions, delivering also about five times the power, although employing the same input power level. In both the above cases Pcoil is small, whereas in prior art ignition systems Pcoil is generally the principal contributor to the system inefficiency.

While the discussion of the PFDI system has concentrated on gasoline engine applications, PFDI is clearly applicable to all combustion systems including "spark" ignited diesel engines where the application is of particular interest. In such applications, one is dealing with fuel spray velocities (where the fuel contains entrained air) one order of magnitude greater than the fluid/flame velocities associated with gasoline engines. Hence, in such applications one needs to reduce the time between pulses to about T (50 usecs) and orient the plug tip so that it is in the appropriate part of the spray, and optionally use asymmetrically lobed plugs to appropriately direct the spark relative to the spray.

Additionally, it should be recognized that while the main application for the PFDI embodiment of the present invention is in the lean burn engine area, the principle on which PFDI is based is of a much broader scope. PFDI is based on providing electrical "ignition" means for air-fuel mixtures during a period of time Tign when the ignition is still active and the flame is still at its initial growth stage and in the region of influence of the ignition system. In PFDI, the flame launched by the initial ignition spark is progressively favored in terms of absorbing the ignition energy provided during Tign, over the energy absorbed by the plasma at the previous spark site (i.e. by the spark remnant). The present PFDI invention provides a small gap defined by two opposed electrodes, one of which is partially insulated; across the gap between the electrodes the full voltage is applied creating a very high E-field region causing an initial ionizing plasma. The plasma forms into a spark channel by being dragged and bent by the E-field to an exposed part of the otherwise insulated electrode (which preferably forces the major part of the spark length to form perpendicular to the originally ionizing E-field). The plasma is thus anchored to form a stable electrical spark discharge—in a way that reduces the electrical coupling to the spark remnant upon subsequent turn-off of the ignition and its refiring (as part of a multiple pulsing ignition having a train of pulses making up on ignition firing). On the other hand, the flame that is launched moves such that for some well defined early intermediate period of time Tign, the electrical coupling to the flame is strong. FIG. 2*d* depicts an optimum way to accomplish this. Moreover, with such a design where the end button is appropriately contoured and the plug shell recessed from an appropriately contoured cylinder head, one can get such a strong focussing of the electric field onto the cylinder head edge, that even without the presence of the ionizing flame (and just from the presence of plasma from the outward moving spark plume) the secondary discharges form outwards and away from the spark plug insulator surface between the plug tip and the cylinder head. Thereafter, as the flame moves around the rim, the subsequent ignition pulses discharge across the flame front to ignite the entire toroidal gap.

Further, the invention is not limited to fixed electrodes. For example, within the time Tign and in conjunction with the pulse train period, a movable element (e.g. a piston of a conventional engine, or a rotor of a Wankel engine) can be designed to move so that coupling to the spark (or spark remnant) is reduced and coupling to the flame improved, all at slightly later times following the ignition spark, and when the flame is at a slightly different location; i.e. the gap which defined the initial spark increases in size, while the gap which defines the positions to which the flame moves decreases in size.

it is emphasized that since concepts disclosed herein relating to PFDI (and ECDI and EMT fuel) differ in part substantially from prior art concepts, and introduce substantially different perspectives on igition (e.g. that delivering large amounts of energy to the spark channel is wasteful), there then necessarily follows a whole new range of trade-offs which should be made in optimizing the system. The broad concepts or principles on which PFDI is based have been presented (and supported by one or more particular preferred embodiments), and these support within the framework of their disclosure) a range of important trade-offs. Specifically: (1) In disclosing the dual nature of flow velocity in both helping the flame more as well as inhibiting its motion in igniting the entire toroidal volume within the ignition period, it is seen that an intermediate flow velocity (e.g. one having a low swirl number) is desirable, especially when other factors are considered. (2) In building capacitance in the secondary circuit, from among the capacitance of the ignition coil, boot, and plug, a preferred design is to provide about 20% capacitance in the plug, 40% in the boot, and 40% in the coil, for approximately 200 pfd total capacitance in order to moderate the temperature of the capacitive spark. (3) In terms of improving the focussing effect of the electric field for the discharging of the field energy across the propagating flame front upon repetitive firing of the ignition system of the PFDI system, the structure and position of the plug shell end relative to the mounting cylinder surface i.e. recessed from it, is important in achieving the best PFDI effect. (4) In operating the CDCC ignition system for the PFDI case, given the preferred 2T to 5T (150 to 250 usec) time between pulses and the desire to have, say, eight pulses at low RPM, it is not practical to recharge the CD capacitor between firings, so maximizing CDCC system efficiency becomes important to be able to sustain such eight pulses on one discharge, leading to an ignition coil design with approximately 24 primary turns (for 350 volts) tighly wound (coupled) to an approximately 1.2 inch square cross-section ferrite core with a turns ratio of 45 and a capacitor of approximately 8 ufd, for highest efficiency and somewhat reduced current. (5) With regard to the ECDI system disclosed, the principle of operation can be used with moderate effectiveness even with spark plugs with ground electrodes, by modifying their construction; for example, taking a spark plug with an extended insulator nose of say $\frac{1}{8}$" and extended center conductor wire of say $\frac{1}{4}$" beyond the insulator, one can add multiple ground electrodes (typically two to four) which surround and run parallel to the center conductor, and are bent near their ends to partially cover the center conductor tip and form an axial spark gap of approximately 0.08"; the ground electrodes also alternatively joined together to form a closed nest around the center conductor, and the center conductor preferably dimensioned to have a somewhat larger diameter of 0.12" to minimize erosion, while maintaining a side clearance of approximately 0.1" between the parallel sections defined by the center and ground electrodes by increasing the shell ID to approximately $\frac{3}{8}$" for a 14 mm plug; upon firing the ECDCC ignition, the spark will form axially at the tip, and the flame will then move in part up along and between the parallel wires with its front perpendicular to the axis (defined by the center conductor direction), supported by the electric (ECDI) field between the 0.1" gap, and further assisted by the piston induced flow (which in this case is in the direction of motion of the flame along the wires for the plug mounted axially with the piston motion, i.e. C1 is one); in this way by using the principles disclosed herein of the ECDI system in conjunction with the high efficiency ECDCC ignition operated in a pulsed mode for long durations (of up to 5 msecs), one can guarantee ignition of a large volume around the plug end of a spark plug, which is a simple modification to existing spark plugs, having multiple ground electrodes. (6) Finally, it should be noted that the trend in the automotive industry has been towards smaller diameter spark plugs with 14 mm thread and $\frac{5}{8}$" hex bodies (and even 12 mm plugs); in most cases there is not a very important reason for this; hence, it would be advantageous, in terms of providing a larger periphery of the plug shell end, and hence a larger toroidal gap to be ignited (with either the ECDI or PDI systems), to use spark plugs with larger diameter, such as the older 18 mm plugs still in use in some applications; and generally to scale up some of the parts from between 10% to the full 40%, say 20% for the center conductor wire to a 0.11" diameter, 10% for the insulator tip thickness to say 0.09", which would leave a substantial edge on the plug shell end of approximately 3/16" (for a 0.04" radial coaxial gap), allowing for a contouring of the edge to, say, a concave surface for improving the electric field focussing within the toroidal gap defined by the gap between the edge and the button at the end of the center electrode.

Figure 11:
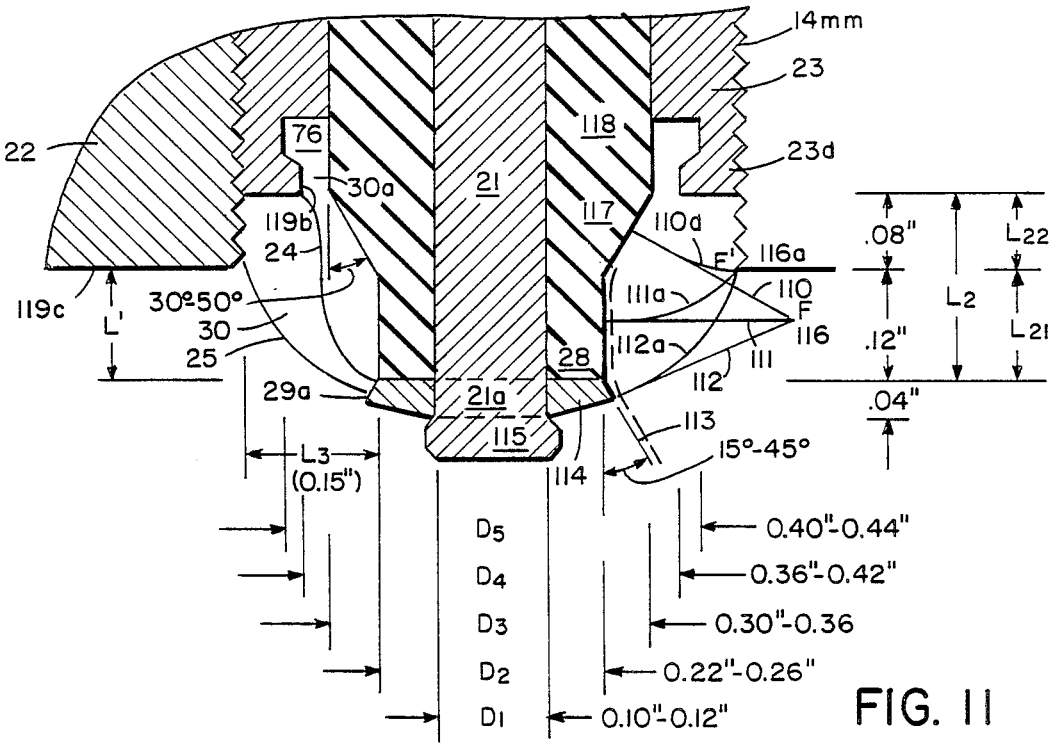
FIG. 11 is a longitudinal cross-sectional partial view of an electric field focussing lens (EFFL) spark plug end defining a toroidal gap and contoured such that it embodies the principle of focussing of the electric field to the vicinity of the cylinder head edge region into which, and around which, the initial flame propagates and thus improves coupling of the electric energy to the initial propagating flame front while simultaneously reducing the size of the end button and keeping the initial spark pulse away from the surface of the insulator.

In the disclosure that follows there is revealed a further improvement of the spark plug firing end configuration to produce improved coupling to the initial flame front, as well as improved design of the overall ignition system to improve PDI, ECDI, and EMT fuel effects as they pertain to achieving optimized ignition. The present disclosure is based in part on the recognition that the electric field focussing effects discussed earlier can be significantly improved by contouring not just the spark plug end button as previously disclosed but by also contouring the insulator nose in conjunction with the end of the spark plug shell and cylinder head. This can be done to obtain a cylindrical electric field focussing "lens" with a focus point, or rather focus circle (since the "lens"0 herein is a cylindrical lens resembling a hyperboloid of one sheet), such that the electric energy can be further guided for reducing breakdown and improving coupling to the moving initial flame front. An further benefit of such contouring of the insulator end is that it also leads to a minimum size of the end electrode or button for minimum physical perturbation of the combustion chamber and minimum absorption of combustion energy by it. Also such focussing permits the spark firing of a very large gap without the need for the small spark initiating partially insulated auxiliary gap already disclosed. FIGS. 11 to 11*ff* reveal embodiments of the electric field focussing lens plug end, or "EFFL" plug, as it will be sometimes referred to hereinafter.

Referring to FIG. 11 in which like numerals denote like parts (with respect to FIG. 2, 2*d*, and 7) there is shown a longitudinal cross-sectional partial view of an electric field focussing lens (EFFL) plug end defining a toroidal gap 30 between the center high voltage portion and the ground shell end portion 23*d* and cylinder head 22. The spark plug nose is contoured such that it embodies the principle of focussing of the electric field, in this case in the vicinity of the cylinder head edge region 119*b*/119*c* around which the initial flame propagates. The insulator end is made up of three sections, a large diameter section 118, a converging section 117 which typically converges at an angle between 30 and 50 degrees to the vertical, and an essentially straight section 28 as disclosed earlier. The "lens" is made up of the surface 28*a* of insulator section 117 with the electric field line or ray 110 normal to its surface ("normal ray 110"), the surface 28*b* of the end insulator section 28 with a normal ray 111, and surface 29*a* of the end button 21*a*/114, which makes an angle between 15 and 45 degrees to the vertical, with a normal ray 112, the rays 110, 111, and 112 converging to a focus point F designated by numeral 116 and defined as the "lens focus" F. Since the "lens" defined by surface 113 is an electric field lens it is influenced by the surrounding electrical conducting grounding surfaces 22/23*d* to form a "ground focus" F' somewhat shifted in position from point 116 (lens focus F) to the edge ground conductor surface point 116*a*. This occurs because rays 110, 111, 112 are bent (distorted) by the presence of the electrical conductor surfaces 22/23*d* to form new rays 110*a*, 111*a*, and 112*a* respectively, terminating at point 116*a*, the ground focus F'. Clearly, the closer F' is to F, the more intense is the normal electric field at the point F'.

There has thus been constructed an essentially electrostatic lens 113 which focusses the electric field to a region 116/116*a* where later spark pulses such as 25 of a multiple spark pulsing ignition train occur. The focussing region is far away from the plug end surfaces 28*a*/28*b* and at the far reaches of the toroidal volume 30 to enable significantly improved coupling of the electric field energy to the initial films front propagating outwards and away from the initial spark 24. This is accomplished while simultaneously reducing the size of the end tip 21*a*/114, which is shown made up of an erosion resistant hollow button 114 which is crimped onto the center conductor 21 by means of the crimp 115.

The relatively sharp changes in angle of the surfaces making up lens 113 help keep the initial spark 24 away from the surface of the insulator while the relatively thick insulating region 118 helps prevent damage to the insulator portion around the spark initiating auxiliary partially insulated gap 30*a* defined by shell surface 119*a* and the insulating surface across it.

The plug end design shown is approximately six times scale and is based on a 14 mm plug shell, which is shown recessed into the cylinder head as disclosed earlier. However, in this design the protecting junction volume 76 is built into the shell, simplifying the insulator end 118/117/28 design (but reducing the spark tracking surface), i.e. the shell end has the shape 23*d* cut into its end, forming both the junction volume 76 and one surface (119*a* ) of the spark initiating gap 30*a*. The dimensions shown for the various diameters are representative of a 14 mm plug, providing a tip insulator 28 thickness of about 0.05" and an insulator thickness at the base 118 of 0.09" to 0.12", enabling portion 118 to withstand the full secondary voltage without voltage puncture.

The diameter of the center wire 21 is somewhat larger than previously disclosed to conform to the somewhat larger diameter D2 of the insulator end. This is because it has been found that the initial spark pulse 24 and some of the follow on spark pulses generally end at the junction 29*b* of the base edge of the surface 29*a* of button 114 and the outer edge of the insulator 28 so there is not much advantage to having a button much larger in diameter than D2 except as it pertains to contributing to the formation of lens 113. There is advantage to having a larger insulator diameter D2 of 0.22" to 0.26" as shown to bring surface 29*a* and edge 29*b* closer to the edge 119*b*/119*c* so that the spark pulses (which may follow the initial spark pulse 24) occurring in the preferred multiple pulsing ignition can more easily reach the surfaces 119*b*/119*c*. Thus, there is shown wire and insulator diameters D1, D2 somewhat larger than disclosed earlier, and a button diameter only 10% to 20% larger than D2 to conform to the end diamater D2. Clearly, it is further advantageous to be using the somewhat larger center conductor diameter (D1) wire, in the range of 0.10" and 0.12", to improve its electrical and thermal conductivities.

The other dimensions D3, D4, D5 are given so as to provide a gap width 30*a* and junction volume 76 consistent with what was disclosed earlier for a 14 mm plug. Nose length 12 is divided in an approximately $\frac{2}{3}$ ratio for the two lengths L22 and L21 corresponding to insulator section 117 and 28, i.e. 0.08" and 0.12" for L2 equal to 0.2". Typically, the ratio of L22/L21 will be in the range of 0.3 to 0.4, and L2 will be in the range of 0.15" to 0.30".

Figure 11A:
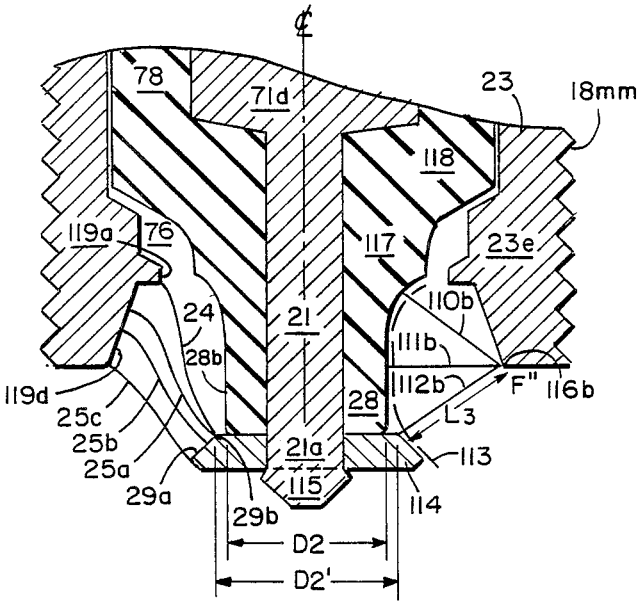
FIG. 11*a* is a longitudinal cross-sectional partial view of the plug end of an EFFL spark plug, of a variant design compared to FIG. 11, based on an 18 mm plug with the shell end further contoured to both act as the approximate focal point circular edge and to provide a gradual transition from an initial spark pulse formed in the interior to the subsequent spark pulses of a single ignition system firing.

FIG. 11*a* is a longitudinal cross-sectional partial view of an EFFL spark plug end based on an 18 mm plug, with like numerals denoting like parts with respect to FIG. 11, and with the shell end section 23*e* further contoured to act both as an "ideal ground focus" F" (116*b*), defined as a focus where F and F' coincide, as well as to provide a tapered spark or arc "runner" secton 119*d* along which the spark pulses 25*a*, 25*b*, 25*c*, can form and "run" as the flame front moves away from the initial spark 24. Moreover, the lens focussing effect can be so strong that under some or all ignition operating conditions, the spark forms across the large gap designated by the spark 25*c* rather than initiating across the much smaller auxiliary gap 30*a*. This results in the formation of a very large initial spark well away from the plug nose insulator surfaces 28*a*/28*b*.

Such spark formation is more readily accomplished by advantageously using the much larger plug end dimensions available from the larger diameter 18 mm plug which provides greater flexibility in contouring surface 28*a*/28*b*/29*a* to form, for example, a curved surface approximating a section of a parabola which will provide a more intense and well defined focus F" (point 116*b*), i.e. the approximately parabolic lens 113 will focus the electric field normal rays 110*b*, 111*b*, 112*b* to the extremity of the shell edge (point 116*b*) or just beyond point 116*b*. In such a design there is, in effect, provided a preference for the spark to follow the flame moving along the periphery of the shell end, as is also disclosed with reference to FIG. 11*c*, which may be especially useful for the ECDI case. In such a design, the diameter D2' of base edge 29b of button 114 may be of somewhat larger (i.e. 10% to 30%) than the diameter D2 of the end of insulator 28 to reduce the distace L3 (along ray 112b) to a (nonetheless large) 0.1" to 0.2" distance.

In the 18 mm plug case of FIG. 11a it is also particularly simple to form the seat 120 of the insulator to the shell 23 near the shell end for better cooling of the plug nose 28. Also, the diameter of the center conductor wire 21 can be increased to a large diameter 71d of say 0.3" relatively close to the shell end as shown so that with an inside diameter of 0.53" of the shell 23 a relatively large capacitance per unit length is formed with the insulating layer 78, which is preferably of high purity alumina (93% to 99.9%) with a dielectric constant of approximately nine. A plug capacitance of about 30 picofarads is attainable with a shell length of one to two inches. Finally, the tip 115 may also be shaped and dimensioned so that under ignition firing conditions where ignition timing is near TDC and the engine cylinder pressure is maximum, ignition firing may occur to the piston face from tip 115 which may form a relatively small gap of say 0.060" to 0.12". The scale of FIG. 11a is approximately five times full scale.

Figure 11B:
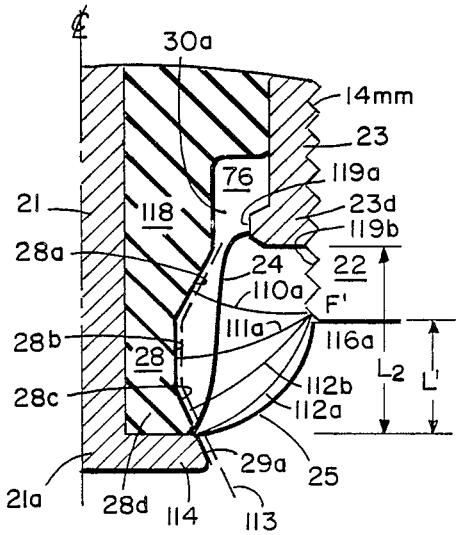
FIG. 11*b* is a half longitudinal cross-sectional partial view of an EFFL plug, of a variant design compared to FIG. 11, wherein the insulator end is further contoured to provide a somewhat larger end diameter for assisting in keeping the initial spark pulse away from the insulator surface.

FIG. 11b is a half longitudinal cross-sectional partial view of an EFFL plug based on the design of the 14 mm plug of FIG. 11, with like numerals denoting like parts with respect to FIG. 11. The main difference shown here is a further contouring of the insulator nose to add a section 28d with surface 28c, providing a somewhat larger end insulator diameter for assisting in keeping the initial spark pulse away from the insulator surface, i.e. section 28d increases the path the initial spark would take if it was to form on a path along surface 28c, 28b, 28a, and then across gap 30a, versus along the depicted path 24. In this design, lens 113 is also a somewhat more symmetric lens with rays 110a, 111a, 112a, and 112b focussing to the ground focus F' (point 116a).

Figure 11C:
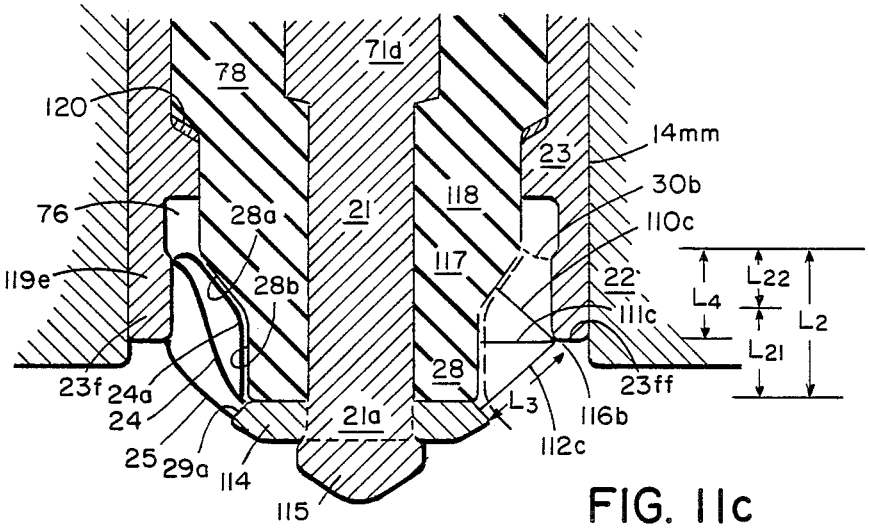
FIG. 11*c* is a longitudinal cross-sectional partial view of an EFFL plug, of a variant design compared to FIG. 11, with the plug nose end and shell end contoured so that the nose end lens focusses directly onto the edge of the shell end so as to reduce the breakdown voltage and provide a larger spark gap for a given maximum output voltage.

FIG. 11c is a longitudinal cross-sectional partial view of an EFFL plug based on the design of the 14 mm plug of FIG. 11, with like numerals denoting like parts with respect to FIG. 11, with the main difference being the dimensioning and contouring of the insulator sections 117/28 and the shell end 23f so that the lens 113 focusses its normal rays 110c, 111c, 112c directly onto the edge of the shell to produce an ideal ground focus F" (point 116b) as also achieved in the larger 18 mm plug embodiment of FIG. 11a. The portion 23f, especially the end portion 23ff, behaves as a ground for the initial and/or follow on spark pulses represented by 25, and section 23f behaves as an arc runner should the initial spark form at the inside location indicated by curve 24.

This plug design is also approximately six times full scale, with dimensions D1 through D5 referenced to FIG. 1 given approximately in this case by D1=0.11", D2=0.23", D3=0.33", D4=0.39", and D5=0.42". Lengths L2, L21, L22, and L3 are approximately 0.16", 0.1", 0.06", and 0.12"respectively, with L3 representing the preferred length for the ECDI case. L21 and L22 are taken in conjunction with shell end section 23f of length L4, shown as approximately 0.1", to focus the electric field at point F" (116b), the inside edge of the shell. Note that as previously discussed, the initial spark may form either along path 25 (as a result of the intense electric field at F" which initiates the ionization), or either along 24 or 24a due to ionization in gap 30b, although as already stated curve 24 represents the preferred path versus the substantially longer surface path 24a which would ordinarily be the preferred path were it not for the shaping of the insulator nose 118/117/28.

In this plug end design there is shared a feature already disclosed with reference to FIG. 11a, namely the formation of the seat 120 near the plug end and the increase of the center conductor diameter 21 from about 0.11" to about 0.16" (conductor 71d), along with an increase, in this case, of the shell interior diameter from about 0.33" to about 0.39" along insulator section 78 to provide a moderately high capacitance per unit length while providing a thickness of insulator 78 of at least 0.11" to prevent insulator puncture.

Figure 11D:
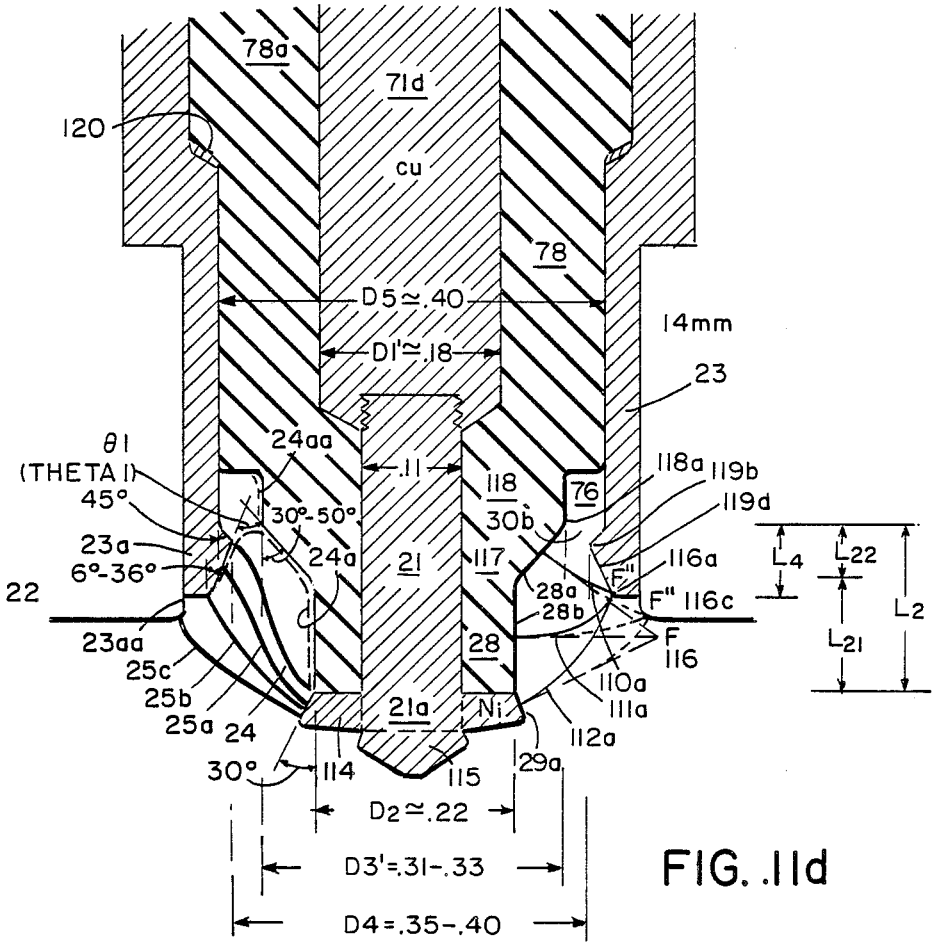
FIG. 11*d* is a longitudinal cross-sectional partial view of an EFFL plug, of a variant design compared to FIG. 11, with the plug end and shell end contoured so that the nose end lens focusses somewhat beyond the shell end and near the cylinder head edge and such the interior end surface of the shell forms a gradual slope so that in combination with the electric field focussing effect the spark pulses are encouraged to move outwards and around the toroidal gap defined by the plug end.

FIG. 11d is a longitudinal cross-sectional partial view of a more optimized 14 mm EFFL plug based on the designs of the plug ends of FIGS. 11, 11a, and 11c, with like numerals denoting like parts with respect to FIGS. 11, 11a, and 11c. The dimensions D1 through D5 are essentially similar to those listed with reference to FIG. 11c, as are dimensions L4 and L22, while lengths L2 and L21 are somewhat longer, about 0.18" and about 0.12" respectively, to form a focus F (116) somewhat beyond the shell edge 23gg, and to produce a somewhat more extensive spark length (which can be increased by proportionally increasing the length L2 by up to 50%).

In this design, several of the special features disclosed with reference to FIGS. 11, 11a, and 11c are incorporated herein, with some of the more pertinent enumerated as follows:

(1) formation of a sharp angle of section 117 (about 40 degrees to the vertical) which both helps push the focus point F further out for improved coupling to the outwardly moving flame front, as well as increasing the surfce path length 24a (and 24aa) relative to path length 24 to encourage formation of initial sparks along path 24 (or 25b) which is away from the insulator surface 28a/28b;

(2) shaping of the shell end 23g to form a gap 30b between the inside shell corner 119b and the insulator edge 118a, where the shell edge point 119b of the gap 30b is displaced slightly downwards (0.01" to 0.03") from edge 118a to further help keep the initial spark pulse away from the plug nose insulator surface;

(3) contouring of the inside surface 119d of the shell end section 23g to form a slope of 6 to 36 degrees to the vertical and an inclusive angle thetal of 36 to 90 degrees with slope line 28a to improve the focussing of ray 110a onto shell edge 23gg and to create an arc runner surface 119d which encourages spark pulses to move sequentially from the path 24 to paths 25a, 25b, 25c, and other paths further out and around the periphery of the shell edge 23gg and cylinder head edge 116c, designated as a second ground focus F1" (116c) (in addition to the ground focus F" (116a));

(4) recessing the shell edge 23gg slightly, e.g. 1/32", from the cylinder head so as to provide in effect three foci F", F1", F, each one further away yet and each one more intense than the other to encourage spark pulses of a multiple pulsing ignition to move out and along with the flame front to continually couple spark energy to the moving flame front; and (5) minimizing the thickness of the insulator layers 78 and 78a by increasing the diameter of center wire 21 from approximately 0.11" to about 0.18" (diameter D1') to provide maximum capacitance without puncture of the insulator, and also minimizing the resistance and inductance of center wire 71d, which is preferably made of copper.

Figure 11F:
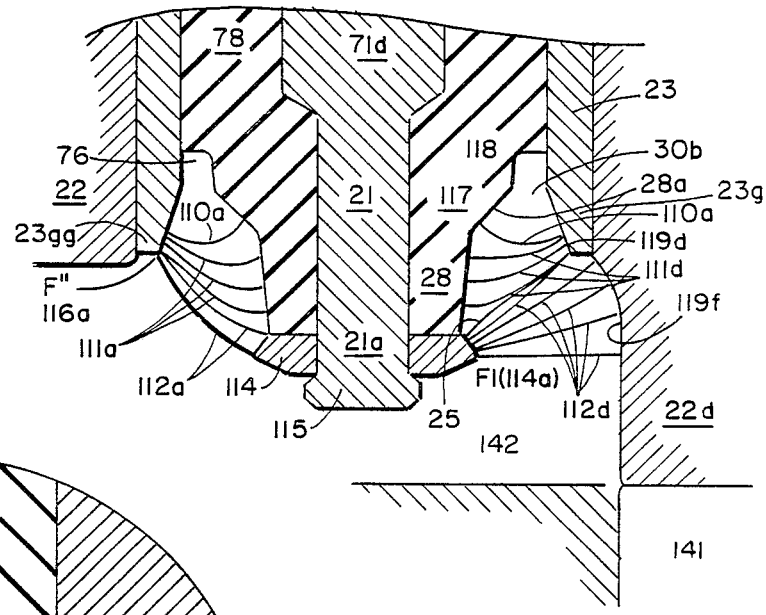
FIG. 11*f* is a longitudinal cross-sectional partial view of an EFFL plug, of a variant design compared to FIG. 11, located near a sidewall of an engine cylinder which is contoured along with the plug shell interior to produce further electric field focussing to the spark plug end button.
Figure 11F:
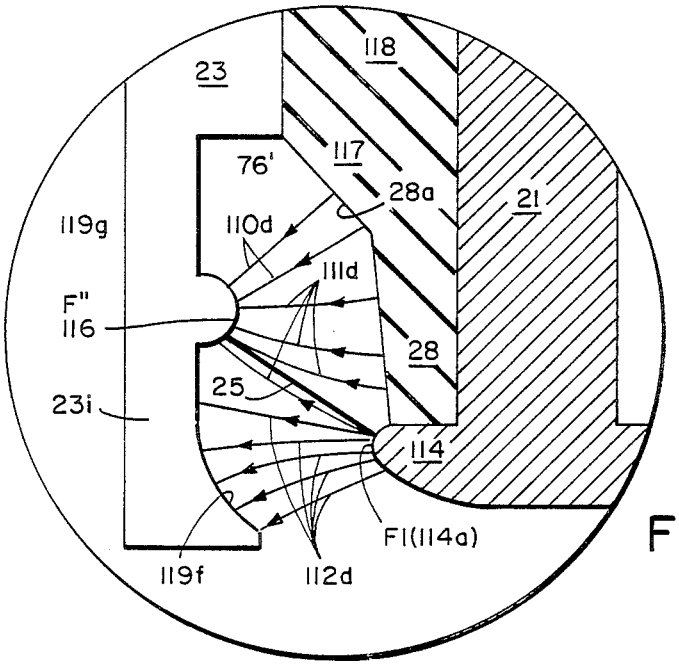
Figure 12:
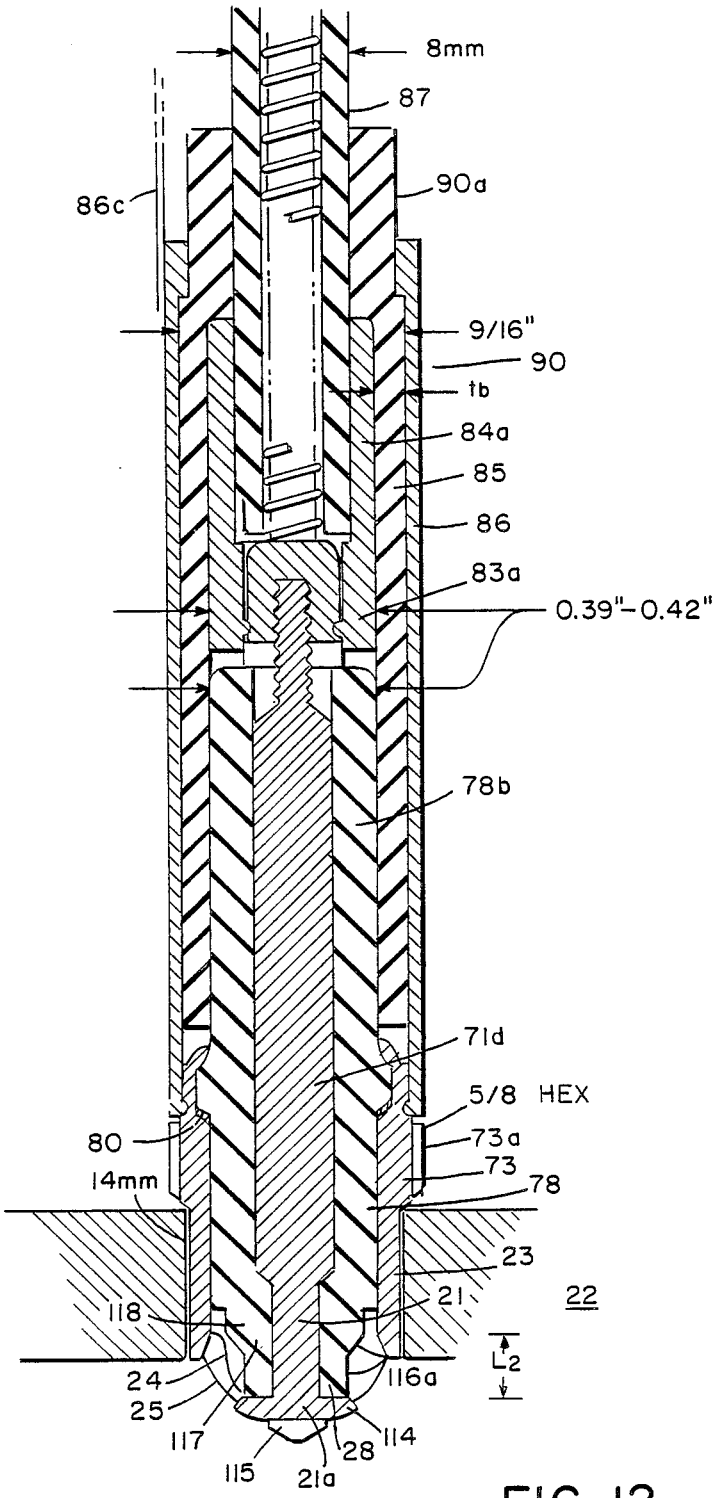
FIG. 12 is an idealized, cross-sectional partial view of an EFFL plug which is of particularly simple construction with a preferred particularly simple, flexible, low EMI, moderately low capacitance (30 to 50 picofards) capacitive boot to which is connected a preferred high inductance, low resistance, low EMI spark plug wire.

These and other features make the plug end especially useful for the PDI case where large high current sparks are formed which follow the flame front as it moves out and around the periphery. It is also to be noted that the indented point 119b may be absent (diameter D4=0.40 for D5=0.40) in which case the corner point 119b is preferably directly across insulator edge 118a, forming a minimum horizontal gap, as shown in FIGS. 11f and 12.

Figure 11E:
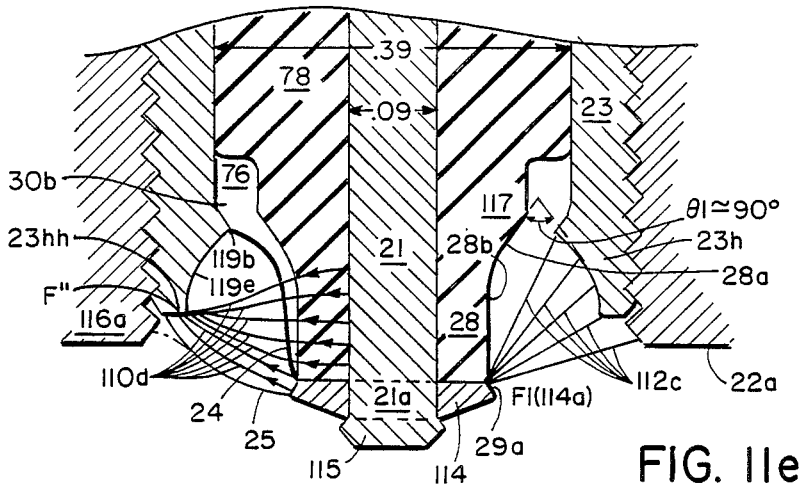
FIG. 11*e* is a longitudinal cross-sectional partial view of an EFFL plug, of a variant design compared to FIG. 11, with the interior end surface of the shell further contoured so that it in turn becomes a partial electric field lens which in combination with the plug nose lens helps intensify the electric field between the plug end button and the plug shell edge.

FIG. 11e is a longitudinal cross-sectional partial view of an EFFL plug based on the design of the 14 mm plug of the previous figure (FIG. 11d), with like numerals denoting like parts with respect to FIG. 11d, the main difference being the dimensioning and contouring of the inside surface 119e of the shell end 23h so that it in effect becomes a ground focussing lens to reinforce the plug nose lens 28a/28b29a and concentrate the electric field lines to the spark plug end outer regions, i.e. to the plug end button 114 and the shell edge 23hh. The diameter of the center conductor 21 is made somewhat smaller (0.9" shown) as well as the diameter of the back portion 118 of the insulator to provide a thicker shell end section 23h for forming the ground lens 119d. With an 18 mm plug one already has the necessary thickness of shell end 23h so that the cener conductor wire and insulator can be maintained at a larger diameter. The ground lens 119e can be viewed as a refinement of the runner surface 119d of FIG. 11d and FIG. 11a (the 18 mm plug).

For ease of visualization and as a way of defining the ground lens 119e, it is shown with its normal rays 112c focussing onto edge 29b as if it is the source of the electric field, with the edge 29b designated as focus F1, point 114a, i.e. these rays are drawn independent of the plug nose (as if it was not present) as a way of defining the shape 119e, recognizing that the plug nose clearly distorts the rays 112c. In its simplest form, ground lens 119e is similar to that of FIG. 11d, except that it is somewhat curved and makes a larger angle to the vertical to form an inclusive angle thetal equal to approximately ninety degrees.

In the left half of the drawing are shown the actual electric field lines 110d formed from the plug nose, exhibiting a tendency of the field to concentrate at the edge point 23hh of the shell end 23h, namely focus F" point 116a. There is thus a preference for the spark to form along curve 25 rather than 24, except under a limited number of conditions, including at higher pressures and when there is a significant fluid velocity normal to the cylinder head surface 22a. In this way, by selectively dimensioning and contouring both the plug nose and plug shell end, one can achieve an optimum degreee of focussing of the electric field.

FIG. 11f is a longitudinal cross-sectional partial view of a more optimized 14 mm EFFL plug based, more particularly, on the designs of the plug ends of FIG. 11d and FIG. 11e, with like numerals denoting like parts with respect to FIG. 11d and FIG. 11e. In this case, the plug end is located near the perimeter 22b of a curved surface 119f such as an engine cylinder head end section, which in effect behaves as a ground lens 119f already disclosed with reference to FIG. 11e, focussing electric field lines 112d onto plug end button 114 shown somewhat extending beyond the diameter of insulator 28 to form a focus F1 (114a). The plug nose itself forms the usual ground focus F" (116a) from the field lines 110a/111a/112a. The two foci F1 and F" encourage the spark pulses to form along a curve joining them, such as curve 25, launching a flame front which moves outwards and into regions of high electric fields so that the initial flame front becomes bathed from all sides with electric field energy which feeds the flame as it moves into the unburnt gas (including along the perimeter of the shell). In this embodiment the shell edge 119b is not protruding and is directly across insulator edge 118a as disclosed earlier as one preferred embodiment of the design of the gap 30b.

The fragmentary partial view FIG. 11ff, based on FIG. 11f, which like FIG. 11f is also approximately six times full scale, has like numerals denoting like parts with respect to FIG. 11f, and serves to show an alternative preferred embodiment of a plug end showing the formation of the two foci F1 (114a) and F" (116a) with the spark 25 joining the foci, as in FIG. 11f. In this embodiment, volume 76 is in effect eliminated and replaced by 76', which is defined by surfaces 28a and 119g, and the entire plug nose is in effect contained inside the elongated shell 23i, which can either be a solid cylinder or an axially segmented cylinder.

The main advantage of this design over other similar designs is the formation of the foci F1, F", which allow for a very large spark (gap) 25 and which provide an electric field distribution which bathes the spark/flame in a strong electric field to stimulate the initial flame front propagating from the spark pulses 25 formed along the toroidal volume contained between the two foci. In principle, one can ignite the entire enormous volume contained between the plug nose and plug shell 23i during the time in which the preferably multiple pulsing ignition is ON by using the longer duration ECDI system or a variant of it.

FIG. 12 is an idealized, cross-sectional partial view of an EFFL plug which is of particularly simple construction and with a preferred particularly simple, flexible, low EMI, moderate capacitance capacitive boot 90 to which is connected a preferred high inductance low EMI spark plug wire 87. In this figure, as before, like numerals denote like parts with respect to FIGS. 8 and 11.

The main feature of this embodiment versus that of FIG. 8 is the use of an internally flexible boot 90 made possible by using a flexible, lower dielectric constant material 85, such as a lightly (30%) loaded silicone rubber, with relative dielectric constant of 5 to 10 to provide a boot capacitance between 30 and 50 picofards. The use of a lower secondary plug/boot capacitance is based on the recent recognition that having a large capacitive initial spark is not desirable as it intensifies the initial spark plasma remnant. Rather, lower overall capacitive energy is preferred, delivered in a very short time to produce a very intense but lower overall energy capacitive spark, attained by building 10 to 20 picofarads (pf) in the plug shell section and 30 to 50 pf in the boot, and providing very low resistance at high frequencies (i.e. 100 MHz) in center conductor 71d/21 (e.g. by silver plating it). In this way, one can use a lower dielectric constant material 85 which is flexible, and contained in a casing 86 which may also be flexible (e.g. of braid, as in ground strap), and in turn the boot can be made to fit snuggly over the spark plug insulator 78b by allowing the elastomer 85 to stretch out and over the upper insulator 78b of the plug.

In other respects plug boot 90 is similar to that of FIG. 8, except that in this embodiment it is designed to fit a ⅝ inch spark plug hex of a 14 mm plug shell and thus has a smaller outer diameter and an elastomer 85 outer diameter of about 9/16 inches. Another simplifying feature of this design is the use of a spark plug wire crimping element 84a of typical length 1" to 2" which also acts as the inner conductor of the capacitor defined by layers 84a/85/86. Also noteworthy is the elongated section 78 of the spark plug to provide a preferred 15 to 20 picofarads of plug capacitance in conjunction with the large diameter (0.18") center wire section 71d and outer shell section 23/73. Optional shield 86c can be used to add capacitance and further suppress EMI.

In a preferred embodiment, the entire structure has a capacitance of about 60 pf, about 15 pf in the plug section contained in the spark plug shell 23/73, about 10 pf in the upper portion of the plug (along upper insulator section 78b), and about 35 pf along the layer between the crimping element 84a and the metallic casing 86. Also, as previously disclosed and shown herein, the plug upper insulator section 78b and crimp element 84a preferably have the same outside diameter to accomodate a constant inside diameter of (preferably elastic) dielectric material 85.

Figure 13:
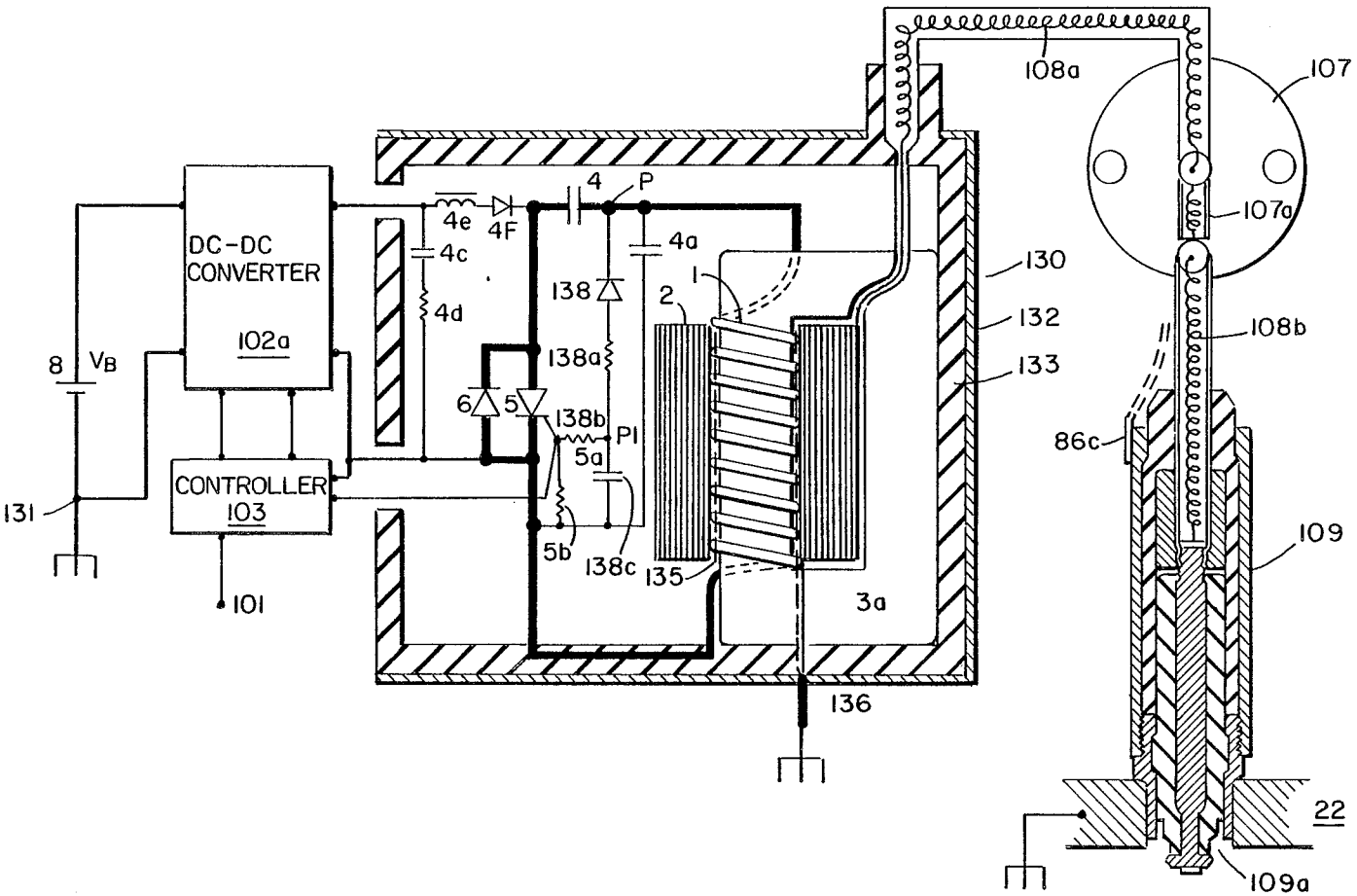
FIG. 13 is an idealized view, partially in block diagram and partially schematic, of a preferred embodiment of an optimized form of ignition of the present invention, referred to as the CEI Ignition, suitable for use in a multi-cylinder internal combustion engine.

FIG. 13 is an idealized view, partially in block diagram and partially schematic, of a preferred embodiment of the optimized CEI Ignition suitable for use in a multi-cylinder internal combustion engine. The ignition is based on that of FIG. 10 and operates as disclosed there, and the drawing follows that of FIG. 10, with like numerals denoting like parts with respect to FIG. 10. DC-DC converter 102a includes output diode means and voltage regulating means internal to it (explicitely shown in FIG. 10).

As already stated, the ignition system depicted in FIG. 13 represents the optimized system developed based on the principal disclosed herein and in other related patents and patent applications, and is sometimes referred to henceforth as the CEI Ignition. It has several distinguishing features (improvements) over the system depicted in FIG. 10, in the areas of improved efficiency, improved EMI, improved operation, and improved effectiveness in igniting lean mixtures.

The CEI ignition preferably uses the more optimized plug and boot 109 disclosed in FIG. 12, and as already disclosed provides multiple spark pulses per ignition firing approximately every 250 to 400 usecs with a typical spark firing period of 80–100 usecs. This period is in part determined by the recovery time of the SCR, which is typically 35 to 40 usecs for a low forward drop standard recovery SCR. In the more optimized CEI Ignition it is preferable to have more short duration (single sinusoid) spark pulses rather than fewer longer duration ones in order to be able to influence the initial flame front over an overall longer duration, i.e. for about three miliseconds (msec) at low engine speeds and one msec at high engine speeds. This is accomplished by using, in part, two further improvements.

The first is a speed-up turn off circuit which reduces the SCR turn-off time 5 to 10 usecs by applying a negative bias voltage to the gate 5a of the SCR 5. This voltage is obtained from point P (the high voltage end of the coil primary winding 1) which has a negative electrical polarity during the first and last quarter cycles of the capacitor 4 discharge cycle. By connecting diode 138, resistor 138a (order of magnitude 5 Kohms resistance), capacitor 138c (of about 0.2 uFarads) in series between point P and ground as shown, and then connecting point P1 (intersection of resistor 138a and capacitor 138c) to the gate 5a of SCR 5 as shown through resistor 138b (of order of 100 ohms), one impresses an average negative voltage of about minus one volt to the gate 5a ( for a 400 volt capacitive discharge (CDCC) system) and reduces (improves) the SCR recovery time. Resistor 5b is typically 50 ohms and for the typical SCR used in this application, such as the Motorola MCR265-8, is built into the SCR.

Preferably the SCR used in conjuction with the fast turn-off circuit has a low forward drop of 1 volt at 120 amps peak current of coil primary winding 1, achievable by improving the SCR design over existing state-of-the-art parts such as the MCR265 by using a larger die, larger leads, etc., and by taking advantage of how the part is used in the present application (e.g. not requiring reverse hold-off voltage, etc).

The second improvement relates to modifying the CDCC discharge circuit (aleady disclosed) by either reducing the size of the discharge capacitor 4 (from, say, 8 to 5 uFarads) and retaining the voltage doubling feature disclosed in the recently issued U.S. Pat. No. 4,677,960, or reducing the operating voltage (from, say, 350 volts to 200 volts) while retaining or increasing capacitance of discharge capacitor 4 (from, say, 8 to 12 uFarad). Preferably in both cases, the voltage recharge circuit 4c/4e/4f is used. In this way, less energy is delivered per 80–100 usec spark pulse, while the same total energy is deliverable by using the recharge circuit comprised of capacitor 4c, choke inductor 4e, and diode 4f (with resistor 4d eliminated) to deliver more spark pulses with higher energy in the follow-on spark pulses relative to the initial spark pulse. This strategy is consistent with the perspective of not delivering much higher (low frequency 10 KHz) spark energy in the initial pulse versus the follow-on pulses. Capacitor 4c preferably has a value about equal to that of capacitor 4, or about equal to a value by which discharge capacitor 4 is reduced, e.g. about 3 uFarads for the case where capacitor 4 is reduced from, say, 8 to 5 uFarads. Inductance value of choke 4e is determined such that upon firing of SCR 5 it will oscillate (with choke inductor 4e, capacitor 4, and coil primary winding 1) through one half of a cycle just prior to SCR refiring (typically 250 to 400 usecs), delivering charge to capacitor 4 and preventing SCR latching. The choke inductance 4e has a value of about 10 millihenries for the typical CDCC ignition disclosed herein.

With regard to maintaining the voltage doubling feature, an equation has been developed (based on the disclosure in U.S. Pat. No. 4,677,960) which specifies the coil turns ratio N in terms of input voltage Vp, the maximum desired secondary output voltage Vs, the value Cp of the discharge capacitor 4, and the value Cs of the secondary output capacitor 9 (FIG. 10). It is given by:

$$N=[(Vp/Vs)*(Cp/Cs)]*[1+\sqrt{[1-(Cs/Cp)*(Vs/Vp)**2]}]$$

and simplifies to:

$$N=[Vs/(2*Vp)]*[1+(\tfrac{1}{4})*(Cs/Cp)*(Vs/Vp)**2]$$

for the case where (Cs/Cp)*(Vs/VP)**2 is much less than one, the condition one works to achieve in the CDCC system.

It is seen that reducing the coil output capacitance Cs, by lowering the capacitance of the plug and boot (disclosed herein as an improvement), helps also in reducing the coil turns ratio N and thus increasing ignition system efficiency. It also permits a lower value of discharge capacitor Cp as disclosed above in one form of the more efficient, more suitable recharge circuit configuration of the ignition where Cp was specified as 5 uFarads (uF).

By way of example, we take Cp=5 uF, Cs=160 pF, Vp=350 volts (assuming a 400 volt capacitor), Vs=33 Kvolts, to obtain:

$$N=[33{,}000/700]*[1+0.07]=50$$

which is a desirably low turns ratio.

With regard to the design of the optimized coil for the PDI system (of the CEI Ignition), there is preferably used a ferrite or other low loss core with cross-sectional area of approximately one square inch (or less if practical) and with high saturation flux density, and preferably a winding window opening three inches long by one inch wide with about 25 turns of primary wire, and a coil turns ratio N of about 50 (for 400 volt rating capacitor 4). Such a design (for the case where the primary 1 and secondary 2 windings are wound over the same section of the core 3*a*) will give a coil leakage inductance of 20 to 30 uHenries (uH) to provide the preferred discharge period of 80 to 100 usecs for a 6 to 10 uF discharge capacitor 4. For a lower value of discharge capacitor of, say, 5 uF, one can increase the coil leakage inductance in order to maintain the preferred 80 to 100 usec discharge period. This is achieved by reducing the length to width ratio of the core window (from 3:1 to, say, 2.5:1), or by using a lower inductance (permeability) core, and/or by increasing the number of turns of the coil windings 1 and 2. A smaller core area can be incorporated by using materials of higher saturation flux density of, say, 6 to 12 KiloGauss, such as nickel iron, should the cores be cost competitive and efficient. Recent improvements in the technology of low cost iron powder cores (improving efficiency) may make them ideal candidates for the present application which preferably uses low to moderate inductance material cores.

For the ECDI system, or a variant of it with characteristics between ECDI and PDI, including say, a peak spark current of one amp and a frequency of operation of, say, 10 KHz, one could use a lower voltage system of, say, 200 volts (250 volt capacitors) with a high capacitance of 8 to 12 uF for capacitor 4 (allowing for a relatively low coil leakage inductance to obtain the 10 KHz frequency). In such a system, while a turns ratio of about 100 is dictated, only 15 turns of primary winding are required (for a one inch square core), and so the core size is actually reduced because of the smaller primary winding because of the fewer turns of smaller primary winding wire and smaller size secondary winding because of the similar turns of smaller size secondary wire. Since less energy is stored in the discharge circuit (250 mjoules) one would need the recharge circuit if more energy is called for.

In applications where size and cost are important, one can design the CDCC coil for the CEI Ignition with the primary 1 and secondary 2 windings wound colinear as shown in FIG. 13, but with the three legs of the core 3*a* exterior to the windings eliminated. The single (open) core interior to the windings provides fairly tight coupling between the coil windings so that the peak voltage is reduced by only 5% (for a ferrite core), which is easily compensated for by increasing the turns ratio by 3%. The efficiency is hardly reduced, and any reduction in discharge period may be compensated for by using a slightly larger discharge capacitor 4 or by other methods already disclosed.

To further improve ignition system operation, especially for ignitions for engines which run at high RPM, one can use two SCRs, where one is fired on the first pulse and the other fired for the remaining pulses of an ignition pulse train.

If the recharge circuit is not used, capacitor 4*c* may still be kept as a lower value 0.1–0.2 uFarad second snubbing capacitor (with resistor 4*d* set at a low value of 1 to 10 ohms, or zero). Such a capacitor will also work with capacitor 4*a* to deliver high frequency, lower peak (ECDI) current spark energy to the spark discharge following the SCR shut-off, as disclosed with reference to FIGS. 2*b*. 2*c*, and 10.

Another main feature of the more optimized CEI Ignition is the placement of the the coil and entire discharge circuit in the same enclosure 130 made of non-magnetic material including preferably an insulator casing 133 and an open metalic casing 132 for providing electrical shielding while not absorbing useful electrical energy. This helps to both minimize EMI and optimize the electrical capacitive discharge ignition efficiency by minimizing the length of primary wire 1. Further improvement in EMI (and other forms of interference, including conductive interference), is achieved by placing a Faraday shield 135 (an open loop) between the coil windings 1 and 2, and connecting it with the low side of the secondary wire at a convenient point 136.

Another preferred embodiment of the CEI Ignition in terms of obtaining the value of (boot) capacitance Csb of about 50 pf near the spark plug is to use a shield 86*c* such as metallic braid over the spark plug wires 108*b*, which in this case would be straight, large diameter metallic wires providing very low inductance Lsb (0.1 to 1 uH), very low resistance, and the required capacitance to produce an intense but relatively low energy capacitive spark upon initial breakdown (spark formation). For the typical values of Csb of 60 pf and an assumed value 0.6 uH for Lsb, the source impedance Zsb is given by:

$$Zsb=\sqrt{Lsb/Csb}=100 \text{ ohms.}$$

But the EFFL plugs disclosed in FIGS. 11 to 11*ff* typically have a breakdown voltage Vb of 8 to 12 Kilovolts at atmospheric pressure (for the typical 0.12" to 0.20" focussing spark gap), leading to an initial peak capacitive current Isb (assuming Vb=10 KV) of:

$$Isb=Vb/Zsb=100 \text{ amps}$$

at atmospheric pressures, which is in the range of values for the breakdown capacitive spark for the application of this invention. The spark plug wire can be designed to provide a range of values of capacitance and inductance (per unit length) by adjusting the center conductor diameter and dielectric constant and thickness of the insulator. In this way the desired level of peak current and capacitive energy can be obtained for best ignition. In such an embodiment, the King lead 108*a* preferably would be of highly inductive absorptive wire with very low capacitance to ground.

The concept of source impedance is useful in disclosing and defining the parameters of the CDCC ignition to be used with the EFFL plug which make up the CEI Ignition. The source impedances Zp, Zs of the primary and secondary circuits respectively for current flow during the sparking period can be shown to equal:

$$Zp=1/(2*pi*f*Cp)$$

$$Zs=N*Zp$$

with the equivalent resistance, Rarc, of the spark gap given in terms of the arc burning voltage Varc and arc current Iarc as:

$$Rarc=Varc/Iarc$$

For the disclosed PDI version of the preferred embodiment of the CEI Ignition, f is taken to equal approximately 10 KHz, Cp to equal about 8 uF, and N to equal approximately 50, giving:

Zp=2 ohms

Zs=100 ohms leading to a 2 amp value of arc (secondary circuit) current Iarc for the average primary circuit voltage Vp of 200 volts (where Vp ranges from 350 down to 100 volts during ignition firing):

$$Iarc=Vp/Zs=200/100=2 \text{ amps}$$

But the typical EFFL plug with the 0.1"-0.2" gap as used in the PDI system disclosed herein has an arc voltage Varc of about 200 volts at 2 amps current, leading to an arc resistance Rarc of:

$$Rarc=Varc/Iarc=200/2=100 \text{ ohms}$$

implying perfect matching betweed the CDCC power supply and EFFL spark plug. Hence, one achieves optimization of energy transfer while providing the other benefits disclosed herein, especially and most importantly, direct electrical discharging across the flame front to produce flame discharge ignition.

For the EDCI system the equivalent arc resistance is at least an order of magnitude higher while Zs is not equivalently as high, so that in this case the system has been designed to make use of the high electric field that naturally exists across the preferred toroidal gap to couple electrical energy to the flame front plasma. A range of hybrid systems can be designed based on the CDCC system and EFFL plug disclosed herein (and the hydrocarbon fuel used) to produce variants of the optimized CEI ignition system all falling within the scope of this disclosure of this invention.

It should be recognized that a practical consideration accompanying and aiding the development of the CEI Ignition, particularly the more optimal arrangement of parts in the enclosure 130, is a totally new type of DC-DC converter, called a Current Pump (disclosed in U.S. patent application Ser. No. 885,912 and corresponding foreign applications), which has many new positive features including insensitivity to where the load is placed to thus permit the arrangement of parts shown within enclosure 130. Moreover, the development of the current pump and several other inventions including the CDCC ignition system of U.S. Pat. No. 4,677,960, the predecessor EM Ignition, and the present invention (which works to optimally couple electrical energy to the air-fuel mixture and to the propagating initial flame front ) have lead to the optimized CEI Ignition disclosed herein.

The summarize, the CEI Ignition is a system which redefines ignition, both in terms of what should be achieved, and how it should be achieved, providing a practical and highly effective ignition of unprecedented capability. At its basic level, the CEI Ignition takes the initial flame into account in a systematic way as part of the more complete "ignition process" in order to most effectively influence it. Equally imporrtant, practical ways to achieve this optimal lean mixture ignition have been disclosed herein. They involve using, in a synergistic way, the developments disclosed in the present invention, together with earlier inventions (CDCC, Current Pump, and EM Ignition) to provide major improvements in lean burn capability (of four to five air-fuel ratios), which have been corroborated by precise testing both on current design engines and on next generation engines still under development.

Finally, with regard to the toroidal gap, and more specifically with regard to the more general "coaxial gap", it should be noted that the term "coaxial gap" as used herein is intended to refer to the volume of space between two coaxial electrodes and should not be construed to include any specific radial or axial limitation unless expressly stated.

Therefore, it is particularly emphasized with regard to the present invention, that since certain changes may be made in the above apparatus and method without departing from the scope of the invention herein involved, it is intended that all matter contained in the above description, or shown in the accompanying drawings, shall be interpreted in an illustrative and not in a limiting sense.

What is claimed is:

1. A high efficiency, high output power electrical ignition system for igniting air-fuel mixtures in a combustion chamber of an internal combustion, or IC, engine, comprising in combination:

(a) means defining a spark plug and spark plug boot of combined capacitance Cspb to ground between 30 and 80 pf, said spark plug including a plug firing end having a central electrode and second electrode means disposed about said central electrode so as to provide a spark gap of at least 0.06" between said electrodes, across which gap one or more spark pulse discharges and electrical fields arise upon application of electrical energy to said plug;

(b) ignition firing circuit means for energizing said plug and comprising capacitive discharge ignition means including ignition coil means with primary and secondary winding of turns ratio N, input capacitor means of capacitance Cp connected to a power converter means for charging to a peak voltage $V_p$ and other side of the capacitor connected to the hot side of the coil primary winding, switch means S for discharging primary energy stored in said input capacitor Cp to energize the coil, the coil secondary to primary turns ratio N defined approximately by the formula FN:

$$N=[Vs/(2*Vp)]*[1+(\tfrac{1}{4})*(Cs/Cp)*(Vs/Vp)**2],$$

wherein Cs is total secondary circuit capacitance, including Cspb, and Vs is the peak output voltage of said coil whose secondary winding is connected to the center electrode of said spark plug;

(c) means defining an IC engine portion including at least one combustion chamber with a movable compressing member therein creating air motion inside said combustion chamber including at least one of microscale turbulence, squish, or swirl, wherein said spark gap is exposed to said air motion such that under normal operation of said IC engine said spark discharges provide an arc burning voltage Varc substantially greater than that produced in still air;

such that in the typical operation of said IC engine the ignition provides ignition spark discharge power output Parc greater than 100 watts at a discharge system efficiency EFF greater than 40% and at an overall ignition system efficiency EFF-tot, including the power converter means, greater than 30%.

2. In an ignition system for an internal combustion device having a combustion chamber with spark plug means mounted on a mounting structure with an interior surface with a ground firing edge or ground electrode defined as the region between and including the spark plug means outer second electrode or shell end and said interior surface region adjacent said shell end, a central firing end or nose comprising a partially insulated end section of the central electrode of said spark plug means further comprising a ceramic nose with a metallic firing tip or button set at its end forming a coaxial gap with said firing edge, sparking means provided by said spark plug means for igniting an air-fuel mixture in said combustion chamber, means for delivering electrical energy to said sparking means to ignite said mixture, said sparking means producing per ignition firing one or more spark pulse discharges and electrical fields upon application of said electrical energy to said spark plug means to ignite the toroidal volume defined by said coaxial gap, the improvement comprising:

a shaping and disposing of said firing end and firing edge such that they form an essentially electric field or electrostatic focussing lens, or EFFL, for focussing the electric field onto or near said firing edge, said coaxial gap between said button and said ground electrode being greater than 0.06", said EFFL feature of said plug means substantially reducing the voltage required to electrically break down the coaxial gap to form spark discharges relative to an equal gap formed between infinite coaxial uniform cylinders.

3. In a system as defined in claim 2 wherein said button and ceramic of said nose defining said firing end are shaped and disposed so as to produce a focussing of said electrical field between said firing end and the outer region of said firing edge defining said coaxial gap such that upon sparking by means of multiple pulse discharges of electrical energy there is formed at least one spark extending from said central electrode to said outer firing edge.

4. In a system as defined in claim 3 wherein the shape of said button and said ceramic of said nose are such that taken together they form a generally non-uniform cylinder with a concave surface in the axial direction resembling essentially a hyperboloid of one sheet with the maximum button diameter being about two thirds of the base or maximum diameter of the ceramic nose end.

5. In a system as defined in claim 2 wherein more than one of spark pulse discharges are provided and said electrodes and gap are shaped and disposed so that the length of the initial one of said pulse discharges extends into said mixture more perpendicularly to said electrical field around said plug nose than the front of an outwardly moving flame front which is positioned at the time of the subsequent pulses, and wherein said spark discharges create at least one flame with a front propagating into said air-fuel mixture essentially parallel to said electrical field to accept a significant amount of said electrical energy.

6. In a system as defined in claim 5 wherein in at least one condition of operation of said internal combustion device at least one flame front becomes itself an electrical discharge path upon sequential discharges of said energy across said electrodes.

7. In a system as defined in claim 2 including multiple pulsing spark discharges with intervals for repeatedly firing said multiple pulsing discharges is less than ½ millisecond, and wherein said means for delivering electrical energy to said sparking means is a capacitive discharge, or CD ignition system including switch means, ignition coil with a turns ratio N, a discharge capacitor of capacitance Cp connected to primary winding of said coil with a total coil secondary circuit output capacitance Cs, said capacitor Cp being charged to a maximum input primary voltage Vp, said values Vp, Cp, and N being selected such that for a given value of Cs a peak coil secondary voltage Vs is produced upon triggering of said switch sufficient to electrically breakdown said coaxial gap.

8. A system as defined in either of claims 1 or 7 wherein for a given value of Cs and Vs said values Vp, Cp, and N are selected such that Lambda is less than 0.2, where Lambda=(N**2)*Cs/Cp, and according to said formula FN, where FN is given by:

$$FN: N=[Vs/(2*Vp)]*[1+(\tfrac{1}{4})*(Cs/Cp)*(Vs/Vp)**2].$$

9. A system as defined in claim 8 wherein coil secondary winding capacitance Csc is made small, i.e. less than 50 pf, such that the turns ratio N is minimized according to said formula FN.

10. A system as defined in claim 8 wherein said means for delivering said electrical energy is structured to provide multiple separated sinewave spark pulse discharges per ignition firing of spark current pulse duration between 80 and 120 usecs and with at least one peak sinewave pulse current of between 0.2 and 4 amps.

11. A system as defined in claim 10 wherein said ignition coil has a minimum core cross-sectional area of about one square inch, a peak output voltage Vs of approximately 30 Kvolts, coil winding turns ratio N of approximately 50, primary voltage Vp of approximately 350 volts, wherein capacitance Cp and Cs are selected and designed to satisfy the conditions of the formula FN and Lambda, with Cp being in the range of 3 to 9 ufarads.

12. A system as defined in claim 11 wherein said ignition coil core is an essentially straight open core with the approximately one square inch cross-sectional core area being the minimum core area and an axial length over which the primary and secondary wires are wound colinearly.

13. A system as defined in claim 12 wherein between 20 and 40 turns of primary wire of resistance about 10 milliohms is wound directly on top of a section of said core, secondary winding is wound essentially on top of the primary winding, primary leakage inductance is in the range of 20 to 60 microhenries, and the source impedance Zs is about 100 ohms.

14. A system as defined in claim 13 wherein secondary winding is low capacitance winding which is wound in axial sections, as with a universal winding machine, with the sections separated by electrically insulating material of low dielectric constant to provide a coil secondary output capacitance of less than 40 pf.

15. A system as defined in claim 13 wherein the spark plug capacitance Csp of said spark plug, i.e. capacitance between center conductor of said plug and ground, is between 30 and 60 pf.

16. A system as defined in claim 15 wherein said plug capacitance is attained in large part through use of high dielectric constant material for the plug insulator of relative dielectric constant of about 30.

17. A system as defined in claim 15 including high inductance low resistance suppression spark plug wire of about 100 uHenry/foot inductance and about 1 ohm-/foot resistance, with spark plug wire constructed to have a low capacitance to ground, i.e. of a relatively loose inductance winding pitch the thick, low dielectric constant material covering over said wire, such that its in-place capacitance to ground is less than 50 picofards.

18. A system as defined in claim 11 wherein said ignition system further includes a recharge circuit, to provide additional energy to capacitor Cp between ignition pulses in one ignition firing, comprising a capacitor CO, an inductor LO, and a diode DO, wherein capacitor CO has a capacitance between one third and one times the capacitance of capacitance Cp, said recharge circuit being defined as an LCD circuit.

19. A system as defined in claim 18 wherein capacitance Cp is approximately 5 ufarads, the sum of capacitance Cp and CO is in the range of 6 to 9 ufarads, and inductance LO is in the range of 3 to 30 millihenrys.

20. In a system as defined in either of claims 1 or 7 wherein said multiple spark pulse discharges between said central and outer electrodes of said spark plug take the form of spark pulses of initially between 200 and about 1,000 milliamperes of current and a firing period of between 100 and 300 microseconds.

21. In a system as defined in claim 20 wherein said means for delivering said electrical energy is structured to provide sufficient energy to breakdown the dielectric of said mixture and to provide a field strength of at least 2000 volts/cm between said electrodes from a voltage of at least 500 volts associated with a current between about 100 ma and 400 ma for said spark discharges.

22. In a system as defined in claim 21 wherein the current of said spark discharges is produced by an ignition system including a transformer having a coil turns ratio of between 50 and 80 and primary voltage Vp of approximately 300 volts, and wherein said ignition system comprises ignition system with capacitor Cp of capacitance of about 4 microfarads, i.e. between 2 and 6 ufarads, and a primary leakage inductance of between 80 and 400 uHenries.

23. In a system as defined in claim 22 wherein said ignition system further includes a recharge circuit of the type LCD with a capacitance value CO between $\frac{1}{3}$ of Cp and one times Cp.

24. In a system as defined in claim 23 wherein about 60 turns of wire are used in the coil primary winding to provide a high primary winding inductance and high primary leakage inductance and a high secondary source impedance Zs between 200 and 800 ohms.

25. In a system as defined in either of claims 1 or 2 wherein said mixture comprises a hydrocarbon fuel, which upon ignition generates a flame plasma density profile suitable for stimulation by an intense electrical field maintained in the combustion chamber in the vicinity of said gap by coupling said electrical energy to the electron plasma at said flame front.

26. In a system as defined in claim 25 wherein the composition of said hydrocarbon fuel is such that the ratio of carbon to hydrogen therein is in the range of 0.5 to 2.0.

27. In a system as defined in claim 26 wherein said fuel includes low ionization potential materials in trace amounts sufficient, when said mixture is ignited, to boost the plasma density across the entire profile of said flame front with the plasma profile still exhibiting a sharply dropping plasma tail characteristic of the flame front ionization profile of pure hydrocarbon fuel-air combustion.

28. In a system as defined in claim 27 wherein said low ionization potential materials are compounds of metals selected from the group consisting of lithium, sodium, and calcium.

29. In a system as defined in claim 25 wherein said mixture includes a fuel with sufficient aromatic hydrocarbon compounds so that upon ignition, the resulting peak plasma density of said flame front is boosted by at least a factor of 2 over that of a typical commercial gasoline fuel, with the plasma profile still exhibiting a sharply dropping plasma tail characteristic of pure hydocarbon fuel-air combustion.

30. A system as defined in claim 4 wherein said EFFL of said plug means comprises said center conductor with the diameter D1 at the insulating plug nose section being approximately 0.11", button diameter D1' being approximately 0.26", minimum diameter D2 and maximum diameter D3' of insulating nose sections making up said EFFL feature of said insulating nose section being approximately 0.24" and 0.32" respectively, and maximum diameter D5' of insulating section interior to plug shell being approximately 0.40".

31. A system as defined in claim 30 wherein total combined axial length L2 of insulating lens forming sections D2 of length L21 and D3' of length L22, i.e. L2=L21+L22, is between 0.12" and 0.24", and ratio of L21 to L22 is about 2.

32. A system as defined in claim 31 wherein said EFFL spark plug focusses on a circular edge disposed between interior corner edge of shell end and just beyond shell end on combusion chamber side.

33. A system as defined in claim 32 wherein said end button is composed of erosion resistant materials of sufficient thickness to satisfy the spark erosion requirements of said plug and thin enough to further concentrate electric field lines onto its perimeter to further reduce the breakdown voltage, said thickness being in the range of 1/32" to 1/16".

34. A system as defined in claim 33 wherein said firing edge defined by said spark plug shell end contains lobes which further concentrate the electric field onto said lobes to further reduce the breakdown voltage.

35. A system as defined in claim 33 wherein said center conductor has an endmost section extending beyond outermost surface of said button which may also act as a crimp to hold the button, said endmost section permitting spark plug firing to a movable member defining essentially an axial gap when ignition firing occurs near TDC of the IC engine comprsing said internal combustion device, wherein said movable member is piston, rotor, or other air-fuel mixture compression means, such that the maximum to minimum spark gap breakdown voltage of said spark plug in said IC engine is in the range of approximately four times the most conditions of operation of said engine excluding idling conditions.

36. A system as defined in claim 35 wherein said coaxial gap is greater than 0.10" and minimum size of said axial gap is less than or equal to said coaxial gap.

37. A system as defined in claim 32 wherein plug shell end is slightly recessed from said cylinder head surface and said focus circle coincides more closely to circular cylinder head interior edge located just beyond shell end defining a ground focus F'.

38. A system as defined in claim 32 wherein said focus circular edge coincides with said spark plug shell end.

39. A system as defined in claim 31 wherein surface of said insulating nose section of length L21 is essentially parallel to said center electrode, and surface of said nose section of length L22 and surface of said end button each form an angle theta1 and theta2 repsectively of 15 to 45 degrees with surface of section L21 to form an essentially concave surface.

40. A system as defined in claim 39 wherein said angle theta1 is approximately 30 degrees and said angle theta2 is approximately forty degrees.

41. In a system as defined in either of claims 1 or 4 wherein said spark plug has a capacitance Csp of about 40 pf, wherein said capacitance is between plug center conductor, insulating layer, and outer metallic casing shell primarily along casing sections defined by the threaded so called "reach" section and the large diameter casing section on which is normally placed a hexagonal shape.

42. In a system as defined in claim 41 wherein said insulating layer fits closely to said center electrode outer surface and to said shell inner surface along the portions of said reach of length Lreach and along portion of said casing of length Lcasing.

43. In a system as defined in claim 42 wherein said insulating layer is high purity alumina of relative dielectric constant of approximately nine and thickness of approximately 0.1" and length Lcasing is at least one inch to help provide said capacitance Csp.

44. In a system as defined in claim 42 wherein said insulating layer is of material of high dielectric constant with a relative dielectric constant of about thirty.

45. A system as defined in claim 1 wherein said switch means S comprises one or more in-parallel low forward voltage drop SCRs with one or more in-parallel diodes across them used to control and switch multiple sine-wave pulse spark discharges.

46. In a system as defined in claim 45 wherein efficiency EFF is further improved by use of two SCRs and two diodes with forward voltage drops of approximately 1.0 volts when each device conducts currents of 50 amps.

47. In a system as defined in claim 45 wherein efficiency EFF is further improved by operating primary circuit at a high voltage of about 600 volts leading to a lower turns ratio N of about 30 such that conditions of formula FN and Lambda less than 0.2 remain satisfied, where Lambda=(N**2)*Cs/Cp.

48. In a system as defined in claim 45 further including an SCR speed-up turn-off circuit comprising an in series connection of a diode, high value resistor R1sp, and a capacitor Csp connected across said primary winding of said coil with cathod of diode connected to the hot side of said primary winding and capacitor to ground side, and a low value resistor R2sp connected between gates of said SCRs and intersection between capacitor Csp and resistor R1sp.

49. In a system defined in claim 48 wherein input capacitor Cp is a 400 voLt rating capacitor and values of components making up the speedup shut-off circuit are about 6 Kohms for R1sp, about 0.05 uF for Csp, and about 400 ohms for R2sp.

50. In a system defined in claim 45 wherein said power converter is a Current Pump DC-DC converter of efficiency greater than 70%.

51. In a system as defined in claim 45 including snubbing capacitor means of at least one snubbing capacitor connected across the primary winding of said coil wherein total capacitance of said snubbing capacitor means is between 0.05 uF and 0.25 uF.

52. In a system as defined in claim 51 wherein inductor means of inductance of the order of magnitude of one microhenry is connected in series with said snubbing capacitor means.

53. In a system as defined in claim 45 including distributor means connected to hot side of said secondary winding, the output of said distributor means being connected to said plug, said distributor means having a rotor and at least one distributor point separated from the tip of said rotor by a gap of about 1/64", said rotor tip being formed of a material resistant to erosion from electrical discharges.

54. In a system as defined in claim 45 wherein a Faraday shield is placed between primary and secondary windings of said coil and said shield is connected to low side of said secondary winding, and the entire coil is placed in a metallic enclosure.

55. In a system as defined in either of claims 1 or 4 including capacitive boot for said spark plug, said plug having elongated central electrical conductor with an opposite connector end at end opposite to said firing end, an insulating layer surrounding said central conductor except adjacent the ends thereof, and a metallic spark plug shell surrounding part of said insulating layer, said boot comprising, in combination:

an electrically conducting cylinder having one end thereof with an internal diameter dimensioned to fit snugly over said connector end of said conductor and to provide electrical contact therewith;

a metallic, hollow tube disposed coaxially about said cylinder and dimensioned to fit snugly over at least part of said plug shell to provide an electrical contact therewith; and a second layer of electrically insulating dielectric material of substantially constant thickness disposed between said tube and said cylinder so that said tube, cylinder, and second layer constitute a capacitor, a least a portion of said second layer being a tubular extension that is disposed to fit snugly about said spark plug insulating layer.

56. A system with a boot as defined in claim 55 including an inductive helix of low resistance wire coupled electrically to said connector end of said spark plug conductor.

57. A system with a boot as defined in claim 55 wherein the exterior of said plug shell and the interior surface of said portion of said tube providing electrical contact to said shell are respectively provided with matching threads.

58. A system with a boot as defined in claim 57 wherein said tube and the thread on the interior of said tube are designed so that when the threads of said tube and shell are partially engaged good electrical contact is made between said conducting cylinder and said opposite end of said conductor, and said dielectric layer covers almost completely said insulating layer of said plug.

59. A system with a boot as defined in claim 55 wherein said dielectric layer is of flexible material of relative dielectric constant between about 4 and 20 to provide said boot with a capacitance between about 20 picofarads and 60 picofarads.

60. A system with a boot as defined in claim 55 wherein the outer diameters of said cylinder and surrounding dielectric layer are respectively $\frac{3}{8}''$ to $\frac{1}{2}''$ and $\frac{1}{2}''$ to $\frac{3}{4}''$ and the overall length of said boot is between 1 and 4 inches.

61. A system with a boot as defined in claim 55 including a spark plug wire connected to said opposite end of said cylinder, said wire having a resistance of the order of magnitude of one ohm/foot and being wound to form a helix with an inductance of order of magnitude of 50 microhenries/foot.

62. A system with a boot as defined in claim 57 including a spark plug wire and a recessed end of said cylinder which is entered by said wire and wherein said dielectric material just beyond the recessed end of said cylinder has a smaller diameter than the overall diameter of said cylinder so as to fit snugly over the outer diameter of said wire and act as a seat for said recessed end of said cylinder.

63. In a spark ignition combustion system for igniting and combusting a hydrocarbon fuel-air mixture, the combination comprising:

(a) means for initiating and maintaining spark ignited combustion in repetitive cycles in a compression-/expansion combustion volume and for feeding a hydrocarbon fuel-air mixture of high flame-front plasma density thereto, each such cycle comprising a spark ignition period comprising an initial and follow-on ignition stage wherein combustion is initiated, (b) spark ignition means for creating an initial spark/-flame kernel during the initial spark ignition period which includes an initial breakdown spark of said ignition means, and for producing from said kernel during the follow-on stages of operation of said spark ignition means at least one outwardly moving flame front into said volume and an electric field capable of sustaining a plasma discharge in said outwardly moving flame front, said system constructed and arranged such that said outwardly moving flame front propagates into the fuel-air mixture during the follow-on ignition stage such that under normal operation of said combustion system said electric field is sufficiently parallel to said outwardly moving flame front, and the plasma density at the flame front of said moving flame is sufficiently high such that an increasing fraction of the electrical energy available in the follow-on ignition stage is coupled to said moving flame relative to that which is coupled to the spark remnant of said initial kernel, to thus enhance the combustion reactions of said outwardly moving flame fronts of lean hydrocarbon fuel-air mixtures and of otherwise difficult to ignite hydrocarbon fuel-air mixtures.

64. A system as defined in claim 63 wherein said ignition means includes means for production of multiple spark pulses, and said follow-on ignition stage is accomplished by provision of means for production of at least one spark pulse following the initial spark pulse.

65. A system as defined in claim 64 wherein said sufficiently parallel electric field produces a flame plasma discharge at the front of said outwardly moving flame front in at least one condition of operation of said combustion system.

66. A system as defined in claim 65 constructed and arranged so that said flame discharge formation is further enhanced by pulsing said ignition system in a time dependent way, providing the initial spark remnant sufficient time to decay while said outwardly moving flame front is still growing, such that the coupling of the electric field of the follow-on spark pulses to the flame front progressively grows while coupling to the spark remnant progressively diminishes.

67. A system as defined in claim 65 constructed and arranged so that said flame discharge formation is further enhanced by increasing the flame front plasma density without significantly changing the shape of the tail plasma by modifying the fuel by either or both increasing the C/H ratio of the fuel to above 0.50 or adding trace amounts of low ionization material in a selective way to the fuel.

68. A system as defined in claim 65 constructed and arranged so that said flame discharge formation is further enhanced by using the in-volume air motions of said combustion system to help quench the density of plasma of the spark remnant of said kernel while helping move at least one of said outwardly moving flame fronts into positions that enhance their ability to absorb ignition electrical energy to form said flame discharge.

69. A system as defined in claim 65 wherein said flame discharge formation is enhanced by timed motion of said compression means of said compression/expansion means relative to the timing of said ignition operation.

70. A system as defined in claim 69 wherein timed motion of said compression means is such that said sufficiently parallel electric field relative to a moving flame front is achieved by the movement of said compression means to enhance formation of said flame discharge.

71. In a system as defined in claim 70 wherein a spark pulse is formed to said compression means in achieving said sufficiently parallel electric field.

72. A system as defined in claim 65 wherein said ignition means is a CD system with input capacitance Cp of about 6 ufarads, i.e. of between 3 and 9 ufards, charged to a voltage Vp of approximately 350 volts and with an ignition coil of turns ratio N of approximately 50.

73. A system as defined in claim 72 wherein said ignition means includes a recharge circuit LCD with capacitor of capacitance CO between one and four ufarads and inductor LO of inductance about 10 millihenries.

74. A system as defined in claim 73 wherein said LCD circuit is designed, i.e. component values of LO and CO are selected, such that each of the energy pulses capacitor CO delivers through said inductor LO to the discharge capacitor Cp between spark pulses of a multiple spark pulse train of an ignition firing is complete just prior to or essentially at the time of the following spark pulse discharge.

75. A system as defined in claim 74 wherein time between initiation of a spark pulse and initiation of the subsequent pulse of the multiple pulsing train is approximately 300 usecs, which is approximately equal to the time required for the recharge circuit LCD to deliver energy to capacitor Cp between the ignition pulses of an ignition spark firing.

76. A system as defined in claim 74 wherein said discharge and said recharge LCD circuit parameters Cp, N, CO, LO are selected to be approximately equal to, i.e. within 25%, of the following values: 6 ufarads, 50, 2.5 ufarads, 12 millihenries respectively, and wherein the spark discharge period is approximately 100 usecs.

77. A system as defined in claim 65 wherein spark ignition means includes at least one spark plug with a central spark plug nose end including an insulated section designed to produce said initial spark kernel with its direction more parallel to the surface of the insulated nose section, and hence more perpendicular to the electric field which arises during the follow-on spark pulses, and wherein said plug is further designed and mounted on a mounting structure by means of its outer shell such that at least one of said outwardly moving flames has its front become progressively more parallel to said electric field of said follow-on pulses as said moving flame moves away from said initial spark kernel and into the combustion chamber formed in said compression/expansion volume and ignition system.

78. A system as defined in claim 77 wherein said spark plug nose end, spark plug shell, and mounting structure are designed such that said initial spark kernel does not contact the insulating section of said nose end.

79. A system as defined in claim 63 wherein said spark ignition means includes ignition spark discharge circuit and spark/flame travel plug gap means including a sparking gap across which said initial spark kernel is formed, said ignition discharge circuit and said plug gap constructed and arranged so that following the initial breakdown spark in the sparking gap an electric field Edis of greater than 800 volts/cm-atmosphere associated with the spark discharge occuring in said follow-on ignition stages is maintained across flame travel section of said plug gap during typical light to moderate load operation of said combustion system for a fraction of at least about 1/5 of the total spark discharge period, and wherein the average power delivered to said spark gap is at least about 100 watts.

80. A system as defined in claim 79 wherein electrical discharge current Idis of said spark discharge following the breakdown spark includes a spark current value of about 100 ma which is associated with a local maximum of the spark discharge voltage Vdis of the transitional glow discharge and hence the maximum electric field Edis attainable for spark currents in the range of 0.01 to 2 amps.

81. A system as defined in claim 80 wherein said flame travel plug gap, i.e. plug gap excluding sparking gap, is defined by the region between the surface of an extended spark plug partially insulated center conductor nose and at least one essentially elongated ground electrode with the sparking gap formed between an uninsulated section of said center conductor and a section of the ground electrode.

82. A system as defined in claim 81 wherein said sparking gap is approximately 0.08" and the flame travel plug gap is on the average approximately 0.1".

83. In a system as defined in claim 82 wherein ground electrode comprises more than one wire adjacent center conductor nose which form said flame travel plug along their lengths and form the sparking gap along near their ends or tips.

84. In a system defined in claim 83 wherein length of said elongated ground electrodes is about ¼ inch, i.e. between ⅛ and ⅜ inch.

85. A system as defined in claim 84 wherein said ignition spark discharge circuit is kept on during an ignition firing for a duration of several milliseconds defined approximately according to the time it takes for a flame front inititated at the sparking gap to travel along the flame travel gap of about ¼ inch.

86. A system as defined in claim 80 wherein said ignition discharge circuit comprises multiple pulsing CD circuit with peak pulse currents in the range of 100 ma to 1,000 ma and single sine wave spark pulse duration of about 200 useconds.

87. A system as defined in claim 86 wherein capacitor of said CD circuit has a capacitance Cp of about 4 ufarads and the primary voltage to which said capacitor is charged is approximately 350 volts, and the peak current in the initial spark pulse of the multiple spark pulsing train is about 800 ma.

88. A system as defined in either of claims 72 or 87 including capacitor snubbing means of capacitance about 5% of Cp which produces, following each spark pulse, continuous ringing decaying spark current oscillations lasting for at least about one half the period between the ignition spark pulses to produce strong (ECDI E-field enhancement effects during the period between spark pulses.

89. A system as defined in claim 88 wherein said ignition means includes a recharge circuit LCD.

90. A system as defined in claim 89 wherein the time period of oscillation of the single sinewave spark pulses arising from the discharge of said capacitor Cp is about 50%, i.e. between 25% and 75%, of the total pulsing period made up of the sum of the spark pulse period and the time between said spark pulses.

91. A system as defined in claim 67 wherein trace amounts of low ionization material are added to the fuel in amounts of the order of magnitude of one p.p.m. to raise the Plasma Rating of the fuel.

92. In a system as defined in claim 91 wherein said low ionization materials are compounds selected from the class consisting of lithium, sodium, and calcium.

93. In a system as defined in claim 91 wherein the peak flame front plasma density is double that of an average unleaded fuel.

94. In a system as defined in claim 72, wherein for a given value of Cs and Vs, said values of Vp, Cp, and N are further selected such that Lambda is less than 0.2 and further according to the formula FN, where Lambda=(N**2)*Cs/Cp and the formula FN being:

$$N=[Vs/(2*Vp)]*[1+(\tfrac{1}{4})*(Cs/Cp)*(Vs/Vp)**2],$$

wherein Cs is total secondary circuit capacitance and Vs is the peak output voltage of said coil.

95. In a system as defined in claim 94 wherein said ignition coil has an essentially straight section of core of cross-sectional area of approximately 1.5 square inches and a primary number of turns Np of approximately 16.

96. A pulsed flame discharge ignition system for an internal combustion engine, said system comprising capacitive discharge means for providing an oscillatory discharge means so as to be energized thereby, plug means having a pair of coaxially disposed electrodes separated by a coaxial spark gap of about 0.15 inch, said plug means having a central nose end so shaped and disposed as to provide an electrostatic focussing lens resembling a hyperboloid of one sheet.

97. In a system as defined in claim 96 wherein the tip of said spark plug means comprises a central electrical conductor ending in a button having a diameter of that portion of said central conductor in contact with said button, and a coaxially disposed electrically conducting sheath separated from said central conductor by a dielectric so that said button and the corresponding end of said sheath form coaxial spark gap.

98. In a system as defined in claim 97 wherein the outer surface of said button is substantially flat and the periphery of said button is shaped as a frustum having its smaller diameter end connected to said central conductor.

* * * * *